US011030924B2

(12) United States Patent
Key

(10) Patent No.: US 11,030,924 B2
(45) Date of Patent: Jun. 8, 2021

(54) LABEL MEASUREMENT SYSTEM FOR A CONTAINER

(71) Applicant: SpinLabel Technologies, Inc., Miama, FL (US)

(72) Inventor: Stephen M. Key, Glenbrook, NV (US)

(73) Assignee: SPINLABEL TECHNOLOGIES, INC., Boca Raton, FL (US)

( * ) Notice: Subject to any disclaimer, the term of this patent is extended or adjusted under 35 U.S.C. 154(b) by 0 days.

(21) Appl. No.: 16/595,437

(22) Filed: Oct. 7, 2019

(65) Prior Publication Data

US 2020/0035130 A1 Jan. 30, 2020

Related U.S. Application Data

(63) Continuation of application No. 14/462,409, filed on Aug. 18, 2014, now Pat. No. 10,438,516, which is a (Continued)

(51) Int. Cl.
*G09F 3/00* (2006.01)
*G09F 3/02* (2006.01)
(Continued)

(52) U.S. Cl.
CPC ..... *G09F 3/0288* (2013.01); *B65D 23/14* (2013.01); *G09F 3/02* (2013.01); *G09F 3/04* (2013.01); *B65D 2203/12* (2013.01); *G09F 2003/021* (2013.01); *G09F 2003/0208* (2013.01); *G09F 2003/0213* (2013.01); *G09F 2003/0216* (2013.01); *G09F 2003/0219* (2013.01); *G09F 2003/0251* (2013.01);
(Continued)

(58) Field of Classification Search
CPC . G09F 3/0288; G09F 3/02; G09F 3/04; G09F 2003/021; G09F 2003/0213; G09F 2003/0219; G09F 2003/0251; G09F 2003/0273; G09F 2003/0208; G09F 2003/0216; G09F 2003/0272; B65D 23/14; B65D 2203/12; Y10T 29/49826
See application file for complete search history.

(56) References Cited

U.S. PATENT DOCUMENTS 2,804,103 A * 8/1957 Wall ..... G01F 19/00 141/381
6,212,803 B1 * 4/2001 Key ..... B65C 3/065 215/252

(Continued)

FOREIGN PATENT DOCUMENTS

WO WO-03017174 A1 * 2/2003 ..... G06F 19/00

*Primary Examiner* — Cassandra Davis
(74) *Attorney, Agent, or Firm* — Stanton IP Law Firm, P.A.

(57) ABSTRACT

The present application is directed to a rotating shrink label measurement systems for a container and methods thereof. A base label may be adhered to the container, and measurement information displayed on the base label. A top label may cover at least a portion of the base label. The top label may be rotatable about the base label to a specific unit of measurement. The top label may have a transparent window allowing measurement information for the specific unit of measurement to be visible through the transparent window. The container and top label may be enclosed by a tamper evident sleeve.

6 Claims, 53 Drawing Sheets

Related U.S. Application Data continuation-in-part of application No. 13/485,795, filed on May 31, 2012, now abandoned.

(60) Provisional application No. 61/534,320, filed on Sep. 13, 2011, provisional application No. 61/881,844, filed on Sep. 24, 2013, provisional application No. 61/867,207, filed on Aug. 19, 2013.

(51) Int. Cl.
*G09F 3/04* (2006.01)
*B65D 23/14* (2006.01)

(52) U.S. Cl.
CPC ..... *G09F 2003/0272* (2013.01); *G09F 2003/0273* (2013.01); *Y10T 29/49826* (2015.01)

(56) References Cited

U.S. PATENT DOCUMENTS

| | | | | |
|---|---|---|---|---|
| 6,385,878 | B1 * | 5/2002 | Key | G09F 3/0288 40/306 |
| 6,581,773 | B2 * | 6/2003 | Kaplan | A61P 11/14 206/534 |
| 8,479,919 | B2 * | 7/2013 | Kaplan | B65D 51/002 206/459.5 |
| 2008/0162188 | A1 * | 7/2008 | Kripalani | G16H 10/65 705/3 |
| 2014/0030680 | A1 * | 1/2014 | Gilchrist | G09B 19/00 434/127 |

* cited by examiner

LABEL MEASUREMENT SYSTEM FOR A CONTAINER

CROSS-REFERENCE TO RELATED APPLICATIONS

The present application a continuation of U.S. patent application Ser. No. 14/462,409, filed on Aug. 18, 2014, titled "Label Measurement System for a Container," which is a continuation in part of U.S. patent application Ser. No. 13/485,795, filed on May 31, 2012, titled "Label Measurement System for a Container," which claims the benefit and priority of U.S. Patent Application Ser. No. 61/534,320, filed on Sep. 13, 2011, titled "Interactive package to properly illustrate the correct dosage of medication," and claims priority to provisional U.S. Patent Application Ser. No. 61/881,844, filed on Sep. 24, 2013, titled "Rotating Shrink Over Shrink with Included Dosing Device and Tamper Evident Sleeve," and claims priority to provisional U.S. Patent Application Ser. No. 61/867,207, filed on Aug. 19, 2013, titled "Rotating Label Apparatus and Method for Properly Dosing Medication to a Child or Patient," each of which is hereby incorporated by reference in their entirety.

FIELD OF THE INVENTION

The present application is directed generally to labels, and more specifically to labels for consumer product containers that function as an aid to determine the correct dosage of medication.

BACKGROUND

Containers for consumer products have a limited amount of outer surface area for placement of labels on the container. This may pose a challenge to manufacturers of these consumer products to fit all of the information they want to deliver to the consumer, or are required by law to deliver to the consumer, in this limited area. In particular, packaging for prescription medications may be required to specify a significant amount of information concerning dosage and frequency of consumption.

More than three billion prescriptions are written each year in the United States, and an estimated $18 billion is spent on over-the-counter medications. Both prescription and over-the-counter medications are intended to be consumed by a patient according to specific instructions for dosage and frequency. Non-compliance with these instructions has been identified as a major obstacle to the effective delivery of health care. Compliance typically means consuming the correct dosage at the correct frequency as specified in the prescription or on the over-the-counter medication packaging. According to the World Health Organization, only about half of patients with chronic diseases living in developed countries comply with their medication instructions. The reasons for non-compliance are varied, ranging from simple forgetfulness, to confusion, to ambivalence. However, the effects of non-compliance are staggering, resulting in an estimated $290 billion dollars per year in avoidable medical expenses. Additionally, studies have shown that non-compliance results in about 125,000 deaths annually in the United States, and leads to 10-25 percent of hospital and nursing home admissions.

Many liquid medications are packaged and sold with some type of dose-dispensing device that may be used to accurately measure the recommended dose based on instructions on the label, product packaging, or separate printed literature included with the package. However, consumers may not use the dose-dispensing device included with the package. For example, the instructions for a medication may indicate the dosage in teaspoon or tablespoon amounts. The consumer may use a household spoon instead of the dose-dispensing device. These spoons are not necessarily meant to accurately measure a teaspoon or tablespoon amount, and overdosing or underdoing may occur.

In addition, some consumers may not be able to read the proper dosing instructions provided in text form with the medication because of vision problems or illiteracy. In other situations, the units of measure specified in the instructions may not match the units of measure on the dose-dispensing device. When the medication is in pill, tablet, or capsule form, the consumer may not understand how many pills constitute a dose.

SUMMARY

The present application is directed to rotating shrink label measurement systems for a container. An exemplary rotating shrink label measurement system may comprise a container, and a base label adhered to the container. The base label may have a back surface and a front surface, with measurement information comprising a plurality of values for a physical characteristic of a user of the container printed on the front surface. The label measurement system may further comprise an opaque top label covering at least a portion of the front surface of the base label. The top label may be rotatable about the base label, and may comprise a polymer film that shrinks when exposed to an energy source. In various embodiments, rotating the top label may have a transparent window allowing at least a portion of the printed measurement information to be displayed through the transparent window. Rotation of the top label may cause the transparent window to display measurement information for a specific unit of measurement. The specific unit of measurement may further comprise a gradient line. The system may further comprise a predetermined second container coupled to the container. A tamper evident sleeve may enclose at least a portion of each of the container, the opaque rotating top label, and the predetermined second container. The gradient line may indicate a level of material dispensed from the container into the predetermined container.

According to additional exemplary embodiments, the present application may be directed to rotating shrink label measurement systems for a container. An exemplary rotating shrink label measurement system may comprise a container, and a base label adhered to the container. The base label may have a back surface and a front surface, with measurement information comprising a plurality of values for a physical characteristic of a user printed on the front surface. The base label may comprise a polymer film that shrinks when exposed to an energy source. The label measurement system may further comprise an opaque top label covering at least a portion of the front surface of the base label. The rotating top label may be rotatable about the base label. In various embodiments, the rotating top label may have a transparent window allowing at least a portion of the printed measurement information to be displayed through the transparent window. Rotation of the top label may cause the transparent window to display measurement information for a specific unit of measurement. The specific unit of measurement may further comprise a gradient line. The system may further comprise a predetermined second container coupled to the container. A tamper evident sleeve may enclose at least a portion of each of the container, the opaque rotating top label, and the predetermined second container. The gradient line may indicate a level of material dispensed from the container into the predetermined container.

According to further exemplary embodiments, the present application may be directed to rotating shrink label measurement systems for a container. An exemplary rotating shrink label measurement system may comprise a container, and a base label adhered to the container. The base label may have a back surface and a front surface, with measurement information comprising a plurality of values for a physical characteristic of a user of the container and a plurality of gradient lines associated with the plurality of values for the physical characteristic of the user printed on the front surface. The label measurement system may further comprise an opaque top label covering at least a portion of the front surface of the base label. The top label may be rotatable about the base label, and may comprise a polymer film that shrinks when exposed to an energy source. In various embodiments, rotating the top label may have a transparent window allowing at least a portion of the printed measurement information to be displayed through the transparent window. Rotation of the top label may cause the transparent window to display one of the values for the physical characteristic of the user and a predetermined one of the gradient lines. The system may further comprise a predetermined second container coupled to the container. A tamper evident sleeve may enclose at least a portion of each of the container, the opaque rotating top label, and the predetermined second container. The gradient line may indicate a level of material dispensed from the container into the predetermined container.

According to still further exemplary embodiments, the present application may be directed to methods for measuring material dispensed from a container. An exemplary method may comprise receiving a container, and adhering a base label having a back surface and a front surface to the container, with units of measurement printed on the front surface of the base label. At least a portion of the front surface of the base label may be covered by an opaque rotating top label. The opaque rotating top label may comprise a polymer film that shrinks when exposed to an energy source. A transparent window may be placed within the opaque rotating top label, such that at least a portion of the printed units of measurement may be visible through the transparent window. A predetermined second container may be coupled to the container, and at least a portion of the container, the opaque rotating top label and the predetermined second container may be enclosed by a sleeve. The sleeve may comprise a polymer film that shrinks when exposed to an energy source. The method may further comprise providing at least one perforation in the sleeve, and allowing the sleeve to tear along the at least one perforation, thereby allowing the predetermined second container to be decoupled from the container. The top label may be allowed to rotate to a specific unit of measurement, and an indicia associated with the specific unit of measurement may be displayed. An opening on the container for dispensing material may be provided, and the material may be dispensed until it is dispensed at or near an amount approximated by the indicia.

DETAILED DESCRIPTION

The present application is directed to rotating shrink label measurement systems for a container. An exemplary rotating shrink label measurement system may comprise a container, and a base label adhered to the container. The base label may have a back surface and a front surface, with measurement information comprising a plurality of values for a physical characteristic of a user of the container printed on the front surface. The label measurement system may further comprise an opaque top label covering at least a portion of the front surface of the base label. The top label may be rotatable about the base label, and may comprise a polymer film that shrinks when exposed to an energy source. In various embodiments, rotating the top label may have a transparent window allowing at least a portion of the printed measurement information to be displayed through the transparent window. Rotation of the top label may cause the transparent window to display measurement information for a specific unit of measurement. The specific unit of measurement may further comprise a gradient line. The system may further comprise a predetermined second container coupled to the container. A tamper evident sleeve may enclose at least a portion of each of the container, the opaque rotating top label, and the predetermined second container. The gradient line may indicate a level of material dispensed from the container into the predetermined container.

Figure 1:
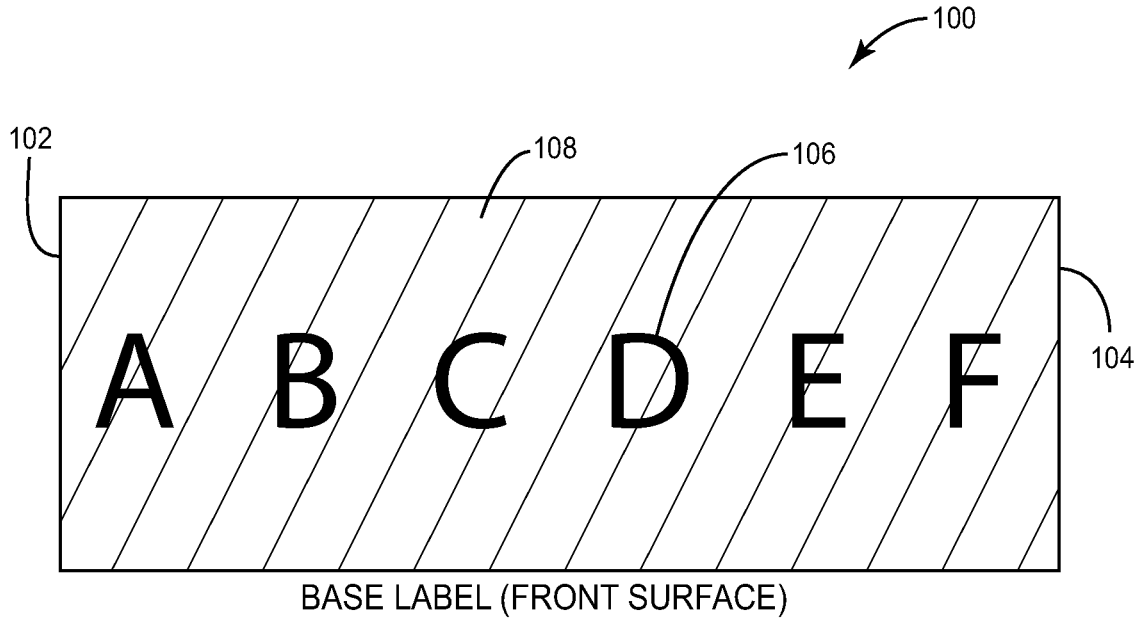
FIG. 1 is a front view of an exemplary label according to various embodiments.

FIG. 1 illustrates various embodiments of a front surface 108 of a base label 100 for an object, such as a medication container, according to various embodiments. The base label 100 comprises a leading edge 102 and a trailing edge 104. While the leading edge 102 is oriented to the left and the trailing edge is oriented to the right as presented in FIG. 1, the orientation of the leading edge 102 and the trailing edge 104 could be reversed depending on which edge is first applied to the object. Both orientations are within the scope of the present disclosure. Base label front surface 108 may comprise writing or other indicia 106 thereon.

As used herein, the leading edge refers to the first edge to be affixed to the object and the trailing edge refers to the second edge to be affixed to the object or the overlapping leading edge. Depending on the orientation of the label and the object when the label is affixed to the object, either edge of the label may be the leading edge. The orientations presented in the figures are for convenience and are not intended to be limiting in any way.

Figure 2:
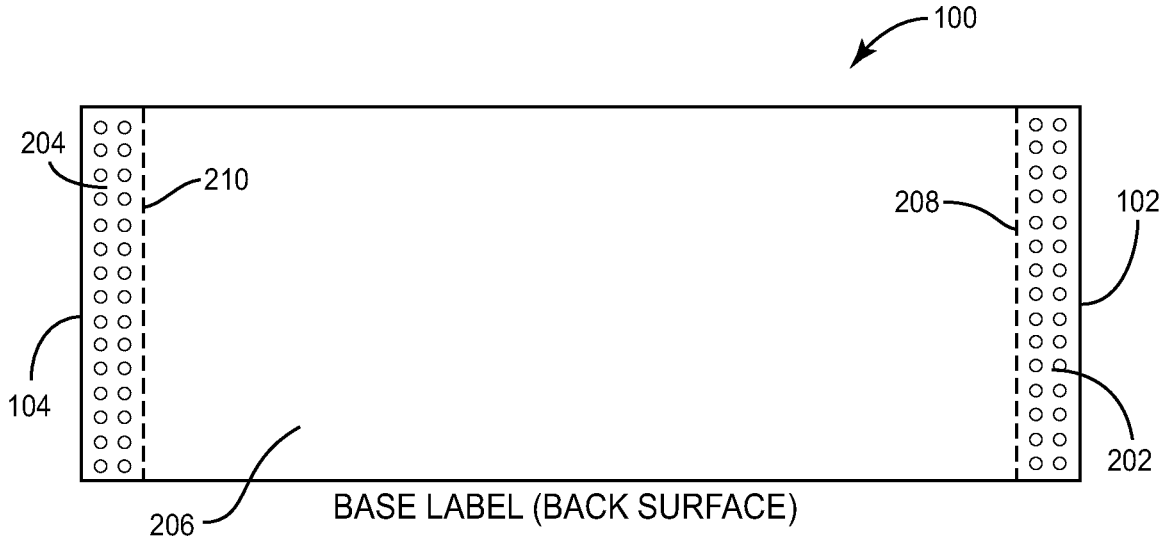
FIG. 2 is a back view of an exemplary label according to various embodiments.

FIG. 2 illustrates various embodiments of a back surface 206 of the base label 100. In various embodiments, the base label back surface 206 comprises two strips of adhesive 202 and 204 on or immediately adjacent to the leading and trailing edges, 102 and 104, respectively. Base label leading edge adhesive 202 may have a boundary 208 defined as its limit on the base label back surface 206. Base label trailing edge adhesive 204 may also have a boundary 210. While FIG. 2 illustrates that the adhesive strips 202 and 204 are generally close to the base label leading and trailing edges 102 and 104, respectively, it is understood that the adhesive strips 202 and 204 may be continuous or discontinuous, and may extend across any portion of the base label back surface 206, including the entire base label back surface 206. In various embodiments, a length of the base label 100 may be selected to be slightly longer than a circumference of the object on which it is placed, such that the trailing edge 104 overlaps the leading edge 102, and the trailing edge 104 is affixed to the leading edge 102. In various embodiments, the length of the base label 100 may be selected to be approximately the same as the circumference of the object on which it is placed, such that the leading edge 102 and the trailing edge 104 do not overlap.

Figure 3:
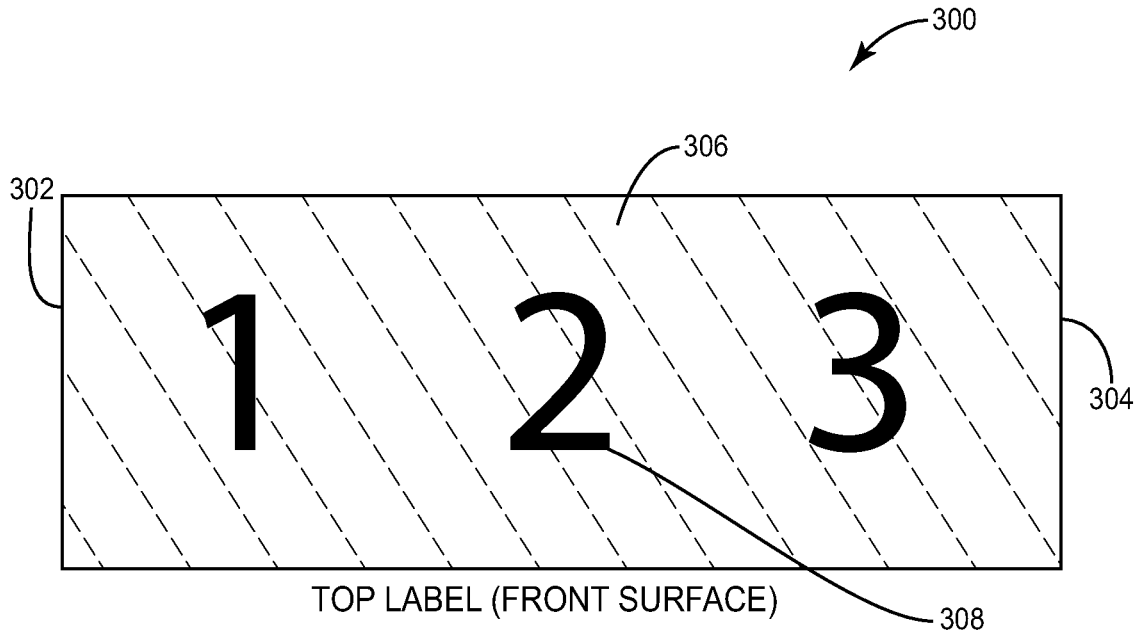
FIG. 3 is a front view of an exemplary label according to various embodiments.

FIG. 3 illustrates various embodiments of a front surface 306 of a top label 300. Top label 300 comprises a leading edge 302 and a trailing edge 304, and indicia 308 may be imprinted on the top label front surface 306.

Figure 4:
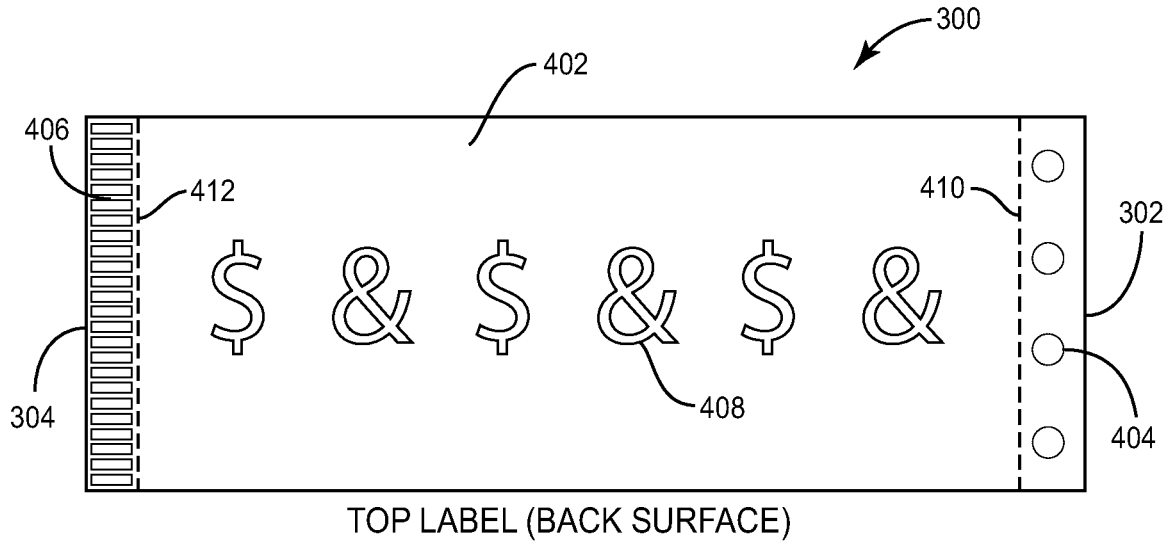
FIG. 4 is a back view of an exemplary label according to various embodiments.

Various embodiments of a back surface 402 of the top label 300 are illustrated in FIG. 4. The top label back surface 402 may comprise various indicia 408 printed thereon, as well as two strips of adhesive 404 and 406 on or immediately adjacent to the leading and trailing edges, 302 and 304, respectively. Top label leading edge adhesive 404 may have a boundary 410 defined as its limit on the top label back surface 402. Top label trailing edge adhesive 406 may also have a boundary 412. While FIG. 4 illustrates that the adhesive strips 404 and 406 are generally close to the top label leading and trailing edges 302 and 304, respectively, it is understood that the adhesive strips 404 and 406 may be continuous or discontinuous, and may extend across any portion of the top label back surface 402, including the entire top label back surface 402. In various embodiments, the adhesive strips 404 and 406 are confined to areas near the leading and trailing edges 302 and 304, respectively, so as not to obscure or interfere with the top label back surface indicia 408.

The base label adhesive 202, 204 and the top label adhesive 404, 406 may be applied in a variety of patterns as can be appreciated by one skilled in the art. The adhesive 202, 204, 404, 406 may be applied in strips, dots, droplets, circles, rectangles, squares, triangles, lines, and the like, as well as combinations of patterns.

A length of the top label 300 may be selected to be slightly longer than a circumference of the object on which it is placed, such that the top label trailing edge 304 overlaps the top label leading edge 302, and the top label trailing edge 304 is affixed to the top label leading edge 302. In various embodiments, the length of the top label 300 may be selected to be approximately the same as the circumference of the object on which it is placed, such that both the leading edge 302 and the trailing edge 304 do not overlap and are affixed to the base label front surface 108.

Figure 5A:
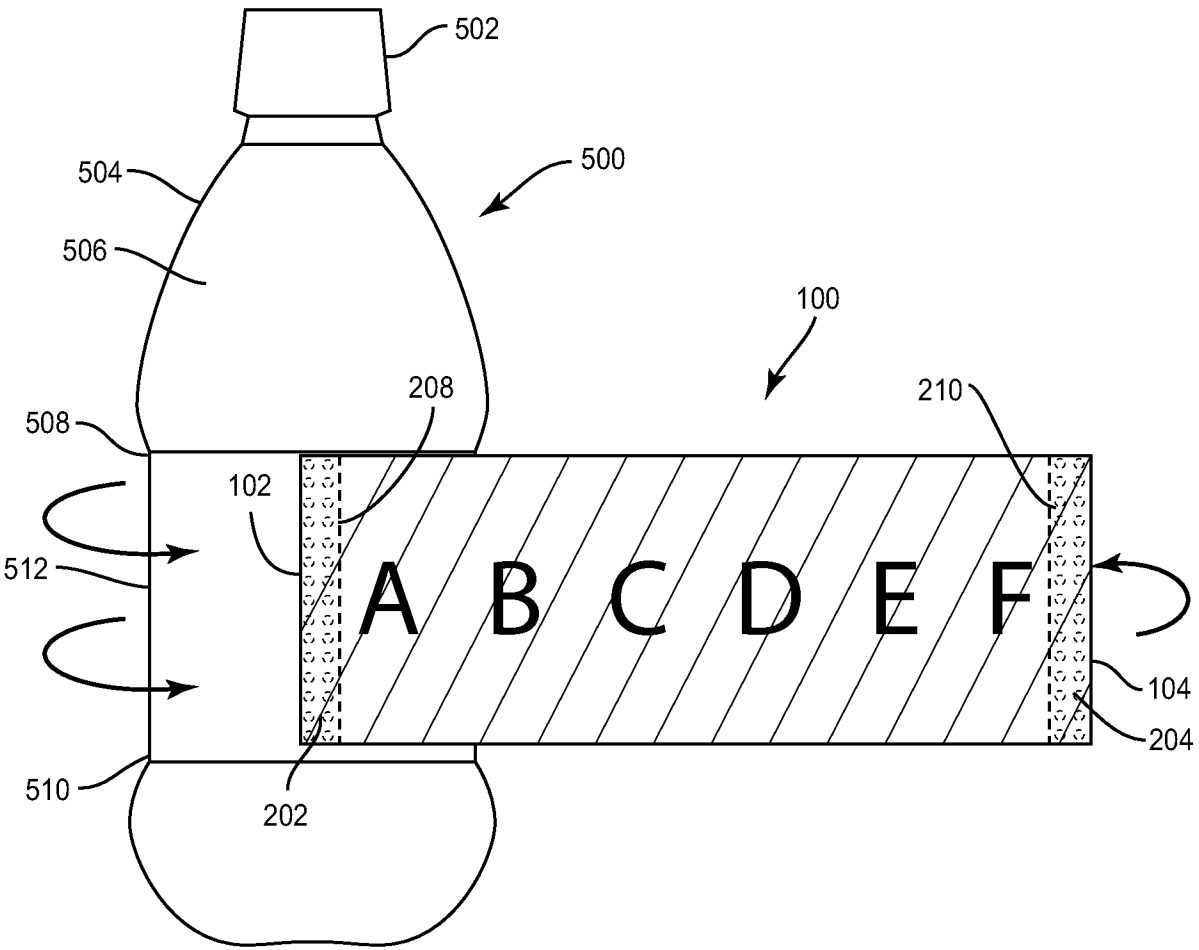
FIG. 5A illustrates a leading edge of an exemplary label affixed to a container according to various embodiments.

FIG. 5A illustrates the application of the base label 100 to an exemplary container 500 according to various embodiments. The container 500 may be a glass or plastic bottle, or other type of container such as a metal can or a cardboard receptacle. The container may be round, rectangular, square, or any other shape known in the art. The term "container" is used here for convenience to describe exemplary embodiments. It is understood that the container may be any object, including non-containers. Container 500 may comprise a cap 502 removably secured to a body 504. Various embodiments of the body 504 may have an exterior surface 506 that comprises a upper label panel 508, a lower label panel 510, and a recessed surface 512 interposed between the upper label panel 508 and the lower label panel 510. As discussed below, the base label 100 may be applied to the container 500 at the recessed area 512 between the upper label panel 508 and the lower label panel 510.

In various embodiments, the top label 300 may be rotatable about the base label 100, as discussed below. In these embodiments, the upper label panel 508 and lower label panel 510 may function to restrict upward and downward movement of the top label 300 in relation to the container 500 such that the top label 300 generally remains in a position covering at least a portion of the base label 100.

Figure 5B:
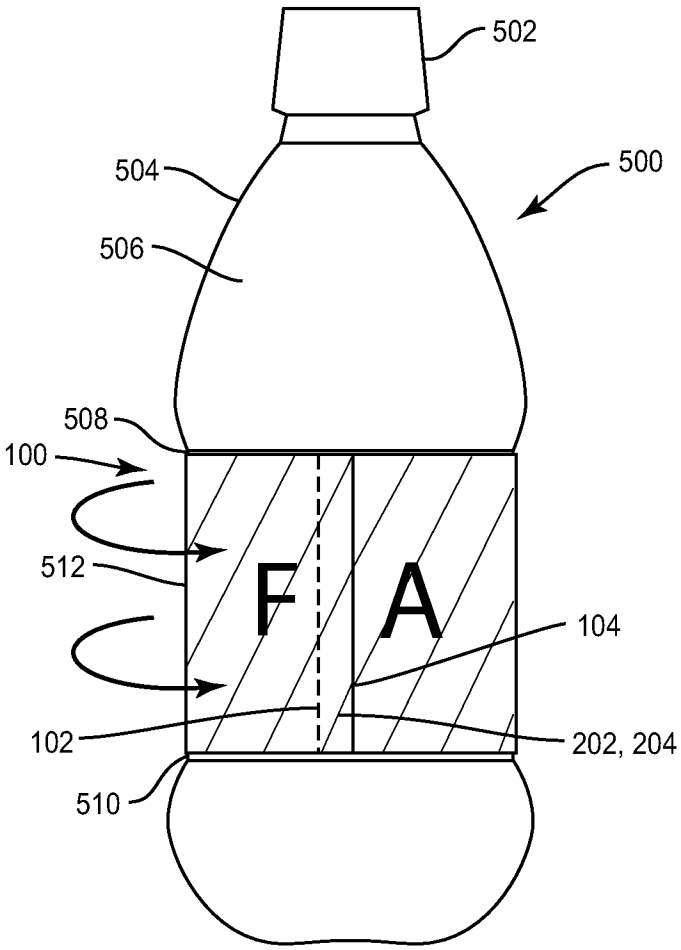
FIG. 5B illustrates an exemplary label secured about a container according to various embodiments.

FIG. 5B illustrates the container 500 with the base label 100 affixed to the container 500. Initially, as illustrated in FIG. 5A, base label leading edge 102 is placed in contact with the recessed surface 512 of the container 500 and affixed to the container 500 by the leading edge adhesive strip 202. With relative motion between the container 500 and the base label 100, the base label 100 may be wrapped around the container 500 with the base label trailing edge 104 now overlapping the base label leading edge 102 such that the leading edge adhesive strip 202 holds the base label leading edge 102 to the container 500 while the trailing edge adhesive strip 204 holds the base label trailing edge 104 to the overlapped base label leading edge 102.

Figure 6:
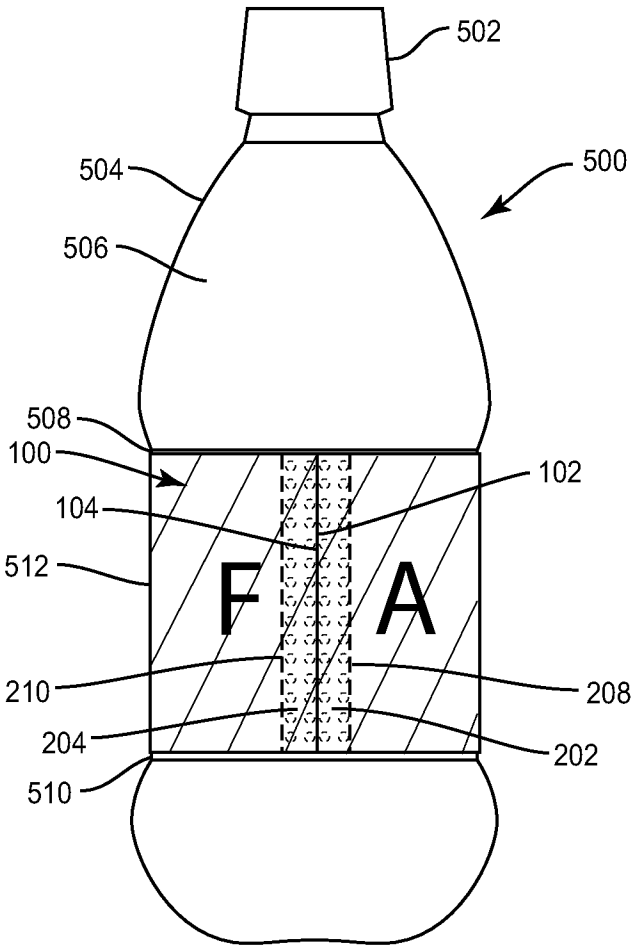
FIG. 6 illustrates an exemplary label secured about a container according to various embodiments.
Figure 7:
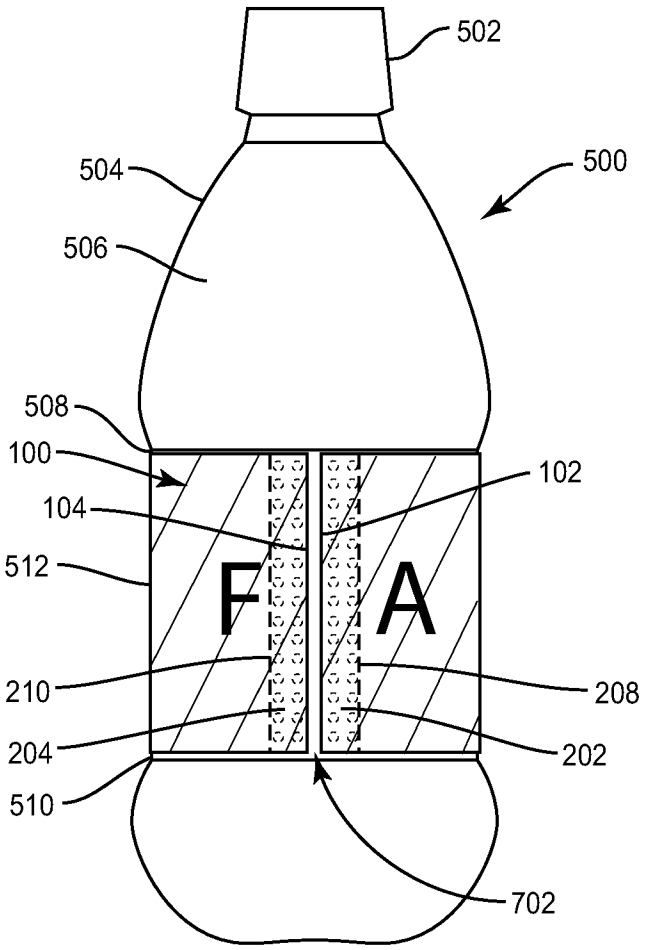
FIG. 7 illustrates an exemplary base label secured about a container according to various embodiments.

In various embodiments as illustrated in FIG. 6, the length of the base label 100 may be substantially the same as a circumference of the recessed surface 512 of the container 500, which may allow the base label leading edge 102 and base label trailing edge 104 to abut rather than overlap. However, it is also possible that the length of the base label 100 may be shorter than the circumference of the recessed surface 512, resulting in a gap 702 between the base label leading edge 102 and the base label trailing edge 104 when the base label 100 is affixed to the recessed surface as illustrated in FIG. 7. In both of these instances, the base label trailing edge adhesive strip 204 may adhere to the recessed surface 512 of the container 500, rather than the base label leading edge 102.

In various embodiments, the base label adhesive strips 202, 204 may comprise a permanent adhesive. In general, a permanent adhesive is one that does not readily release from a surface to which it adheres after the adhesive dries or cures. Using the base label 100 as an example, the permanent adhesive 202, 204 will tend not to release from the recessed surface 512, nor will it tend to release the base label leading edge 102 or trailing edge 104 once dried or cured. In order to remove the base label from the recessed surface 512, the base label 100 may have to be torn from the adhesive, or the adhesive layer 202, 204 may have to be fractured which may leave some of the adhesive on the recessed surface 512 and some of the adhesive on the base label leading edge 102 or trailing edge 104. Once the surfaces affixed with the permanent adhesive are separated, they may not be reattached.

Figure 8:
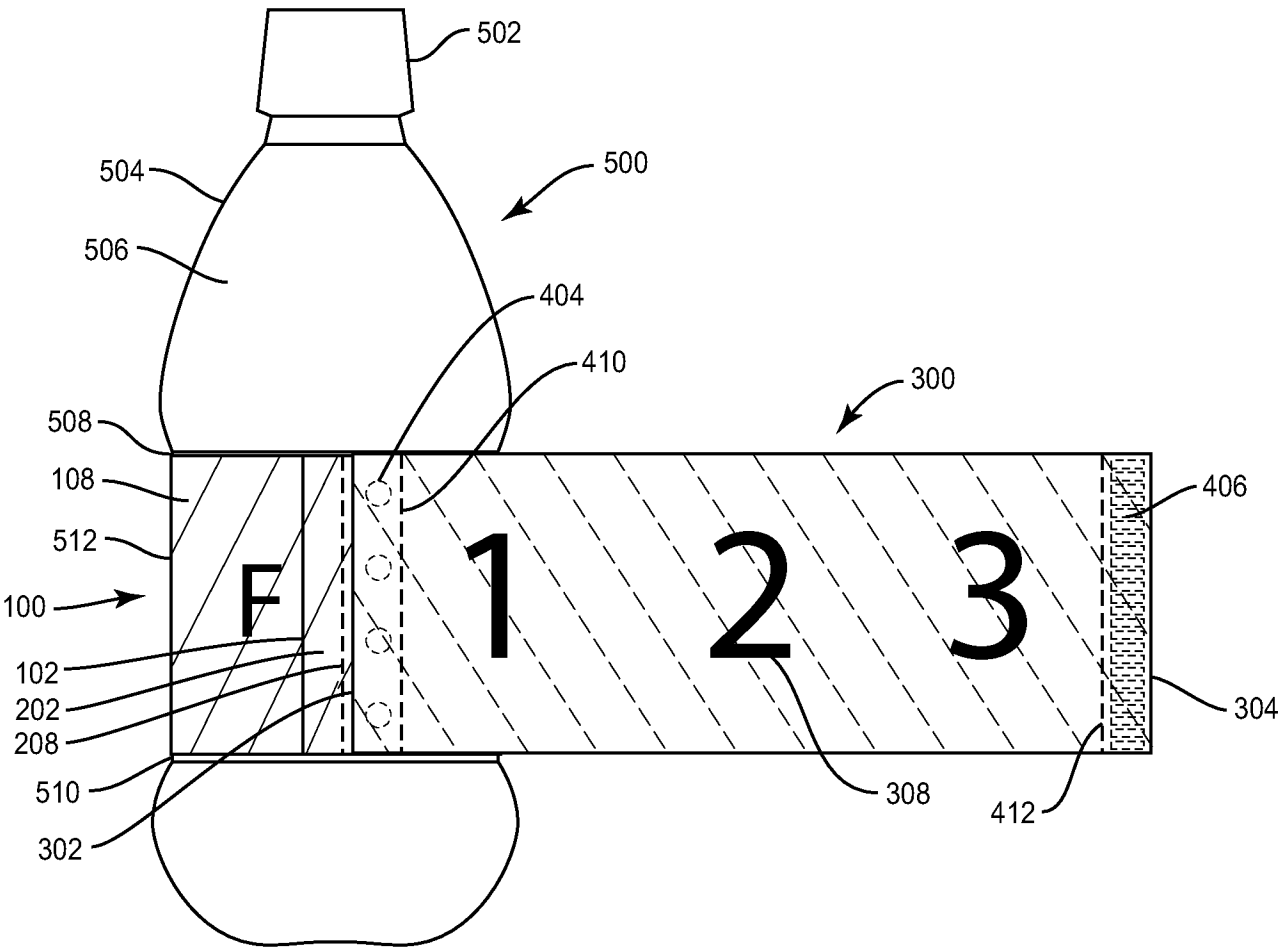
FIG. 8 illustrates a leading edge of an exemplary top label affixed to an exemplary base label according to various embodiments.

In FIG. 8, the base label 100 is already affixed to the recessed surface 512 of the container 500, and the application of the top label 300 over the base label 100 is illustrated according to various embodiments. The top label leading edge 302 may be placed in contact with any portion of the base label front surface 108 and affixed to the base label front surface 108 by the top label leading edge adhesive strip 404. With relative motion between the container 500 and the top label 300, the top label 300 may be wrapped around the container 500 with the top label trailing edge 304 now overlapping the top label leading edge 302 such that the top label leading edge adhesive strip 404 holds the top label leading edge 302 to the base label 100 while the top label trailing edge adhesive strip 406 holds the top label trailing edge 304 to the overlapped top label leading edge 302.

Figure 9:
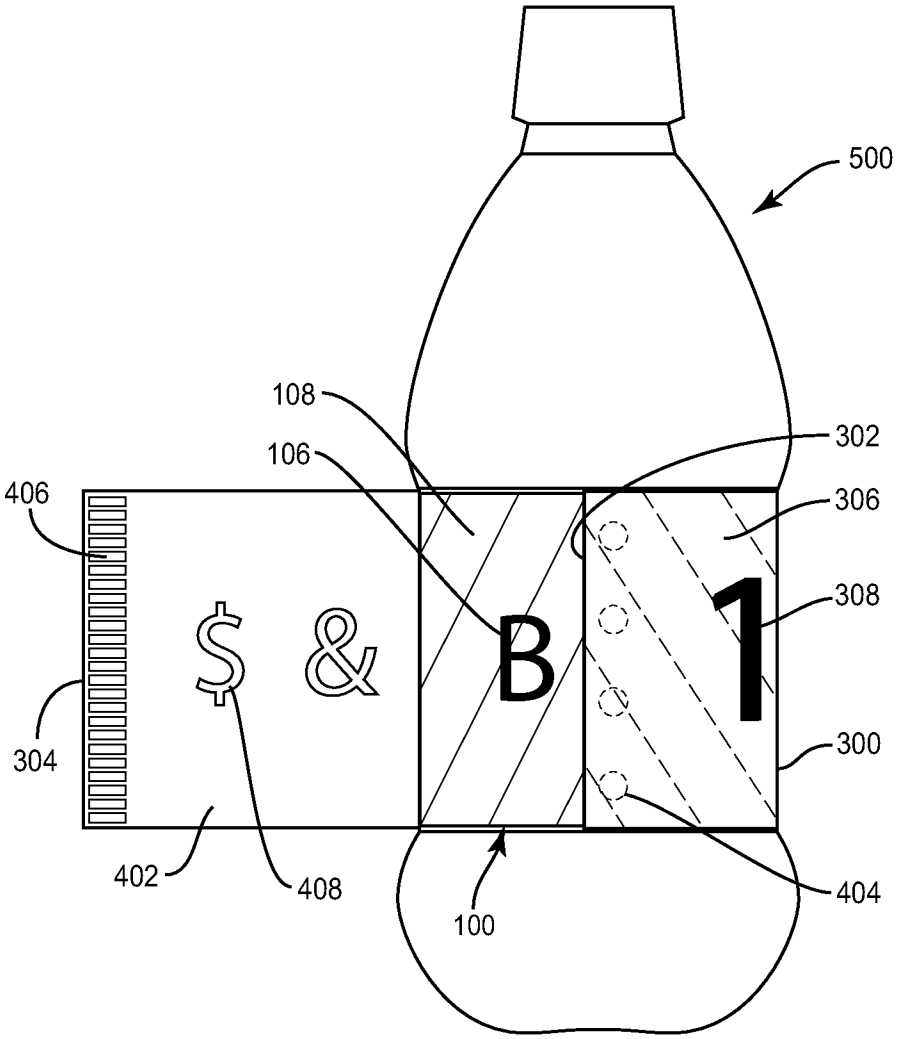
FIG. 9 illustrates an exemplary top label affixed to an exemplary base label and partially wrapped about a container according to various embodiments.

FIG. 9 illustrates the operation of the base label 100 and the top label 300 according to various embodiments. Beginning with the container 500 with the base label 100 and the top label 300 in place as shown, for example, in FIG. 6, the top label trailing edge 304 may be detached from the top label leading edge 302 and at least partially peeled back as shown in FIG. 9. The combination of the base label 100 and the top label 300 in this configuration increases the amount of surface area available for viewing by a consumer or user of the container 500. Prior to detaching the top label trailing edge 304, the consumer may view the top label front surface 306. Upon detaching the top label trailing edge 304, the consumer may now view the top label back surface 402 and the base label front surface 108 in addition to the top label front surface 306.

One of at least three types of adhesive may be used for the top label leading edge adhesive 404. A first type of adhesive is the permanent adhesive as described above for the base label 100. When a permanent adhesive is used for the top label leading edge adhesive 404, the top label leading edge generally cannot be detached without inflicting damage to one or both of the top label 300 or the base label 100. This may be desirable for various embodiments where the top label 300 is not intended to be removed from the container 500.

A second type of adhesive that may be used for the top label leading edge adhesive 404 is a releasable adhesive. A releasable adhesive is one that will release from a surface to which it is attached once a sufficient mechanical force is applied. A releasable adhesive may be used, for example, when the top label back surface 402 comprises a coupon for a subsequent purchase of a product. The releasable adhesive may allow the consumer to easily remove the top label 300 for later use. In various embodiments, the releasable adhesive may be a breakaway adhesive. A breakaway adhesive may have limited ability to withstand shear stresses. Shear stresses may cause the adhesive bond created between the label (e.g., top label 300) and the surface to which it is affixed (e.g., the base label 100 or container 500) to fail along the adhesive. In general, a releasable or breakaway adhesive may not re-attach to a surface once removed.

A third type of adhesive that may be used for the top label leading edge adhesive 404 is a resealable adhesive. A resealable adhesive may release from a surface to which it is attached once a sufficient mechanical force is applied, similar to the releasable adhesive described above. However, the resealable adhesive may be re-attached to a surface by applying pressure. A resealable adhesive may be desirable when the top label back surface 402 or the base label front surface 108 comprise information that may be needed only on occasion. Thus, the consumer or user may detach the top label 300 when the information is needed, then re-attach the top label 300.

In various embodiments, the top label trailing edge adhesive 406 may be a releasable adhesive or a resealable adhesive, depending on the intended use of the top label 300. As described above, if the surfaces 108, 402 comprise information that is intended to stay with the container, the top label trailing edge adhesive 406 may be a resealable adhesive. In contrast, if the top label 300 is intended to be removed from the container 500, a releasable adhesive may be desirable.

Figure 10:
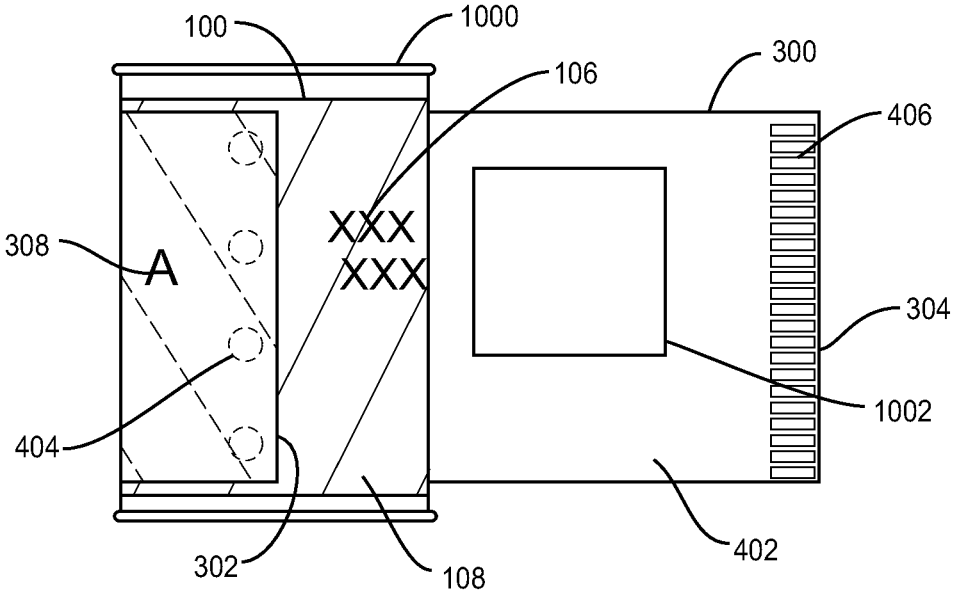
FIG. 10 illustrates an exemplary top label with a window affixed to an exemplary base label and partially wrapped about a container according to various embodiments.

FIG. 10 illustrates various embodiments of the top label 300 comprising a window 1002. The window 1002 may comprise a void in the top label 300 such that a portion of the base label 100 may be visible through the window. In various embodiments, the window 1002 may have a transparent covering (not shown). In various other embodiments, the window may comprise a transparent section of the top label 300 itself rather than a void. FIG. 10 illustrates the top label 300 partially wrapped about a container 1000, and base label 100 already in place on the container 1000. As shown, the top label leading edge adhesive 404 maintains the top label 300 coupled to the base label 100. The top label 300 may then be moved from the position illustrated in FIG. 10 to the position illustrated in FIG. 11 to secure the top label 300 about the container 1000. Top label trailing edge adhesive 406 may couple to the top label leading edge 302 if the top label leading edge 302 and trailing edge 304 overlap; otherwise, the top label trailing edge adhesive 406 may be coupled to the base label front surface 108.

Figure 11:
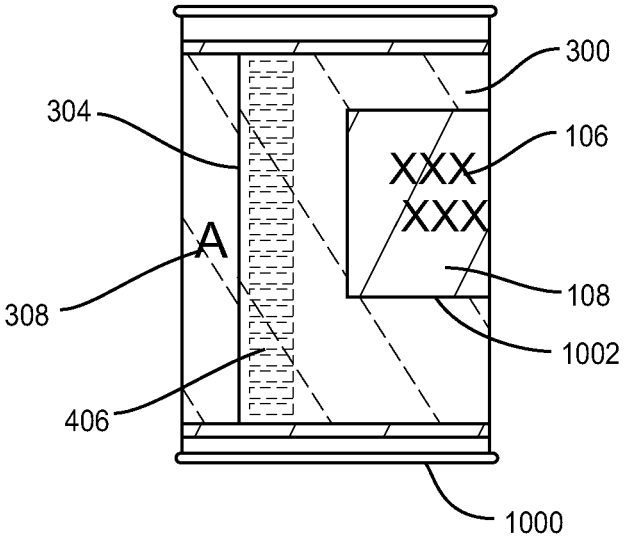
FIG. 11 illustrates an exemplary top label with a window secured about a container and a portion of a base label visible through the window according to various embodiments.

Once the top label 300 is in position on the container 1000 as illustrated in FIG. 11, at least a portion of the base label front surface indicia 106 may be visible through the window 1002. This may allow viewing of a first portion of the base label 100 without removing the top label 300. In various embodiments, the top label leading edge adhesive 404 may be a breakaway adhesive. Rotation of the top label 300 relative to the base label 100 may exert shear stresses on the breakaway adhesive, causing the adhesive bond affixing the top label leading edge 302 to the base label 100 to fail. The top label 300 may then be freely rotatable about the base label 100, and a second portion of the base label 100 may be visible when the top label 300 is rotated to a second position. The window 1002 may be rectangular as illustrated in FIGS. 10 and 11, or any other shape as needed for a particular application. For example, the window 1002 may be a slit that reveals an alphanumeric string on the base label 100. In various embodiments, the top label 300 may comprise more than one window 1002. Various embodiments in which the top label trailing edge adhesive 406 is a resealable or releasable adhesive may allow the top label 300 to be peeled back to reveal the top label back surface 402 and essentially the entire base label front surface 108 or to be removed from the container 1000, in addition to being rotatable.

One skilled in the art will readily recognize that labels may be applied to containers using a variety of methods and that there may be a variety of single-label and multi-label systems other than those described above. Any such application methods or label systems may be used with the present disclosure. The above descriptions are exemplary and not to be construed as limiting in any way. Examples of other application methods and label systems may be disclosed in U.S. Pat. Nos. 5,884,421, 6,086,697, 6,237,269, 6,402,872, 6,631,578, 6,649,007, 7,087,298, and 7,172,668.

Figure 12:
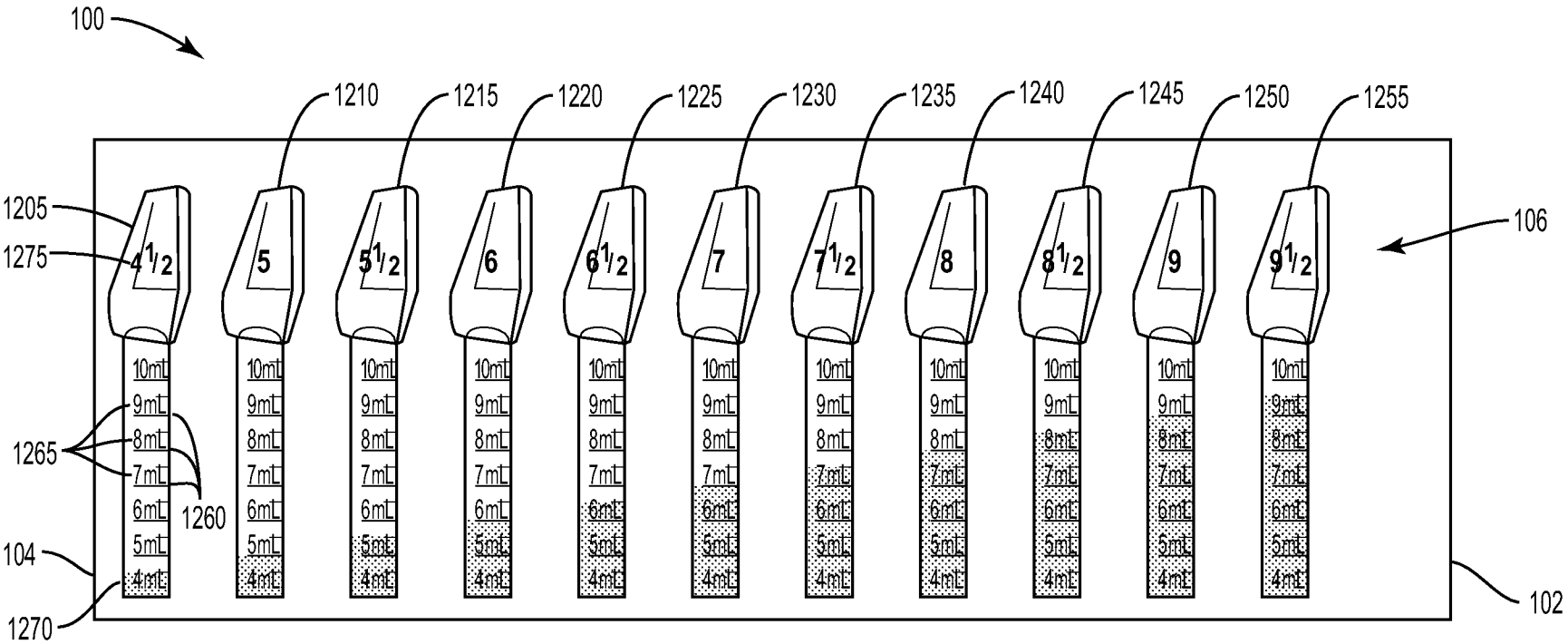
FIG. 12 is a front view of a base label according to various embodiments.
Figure 13:
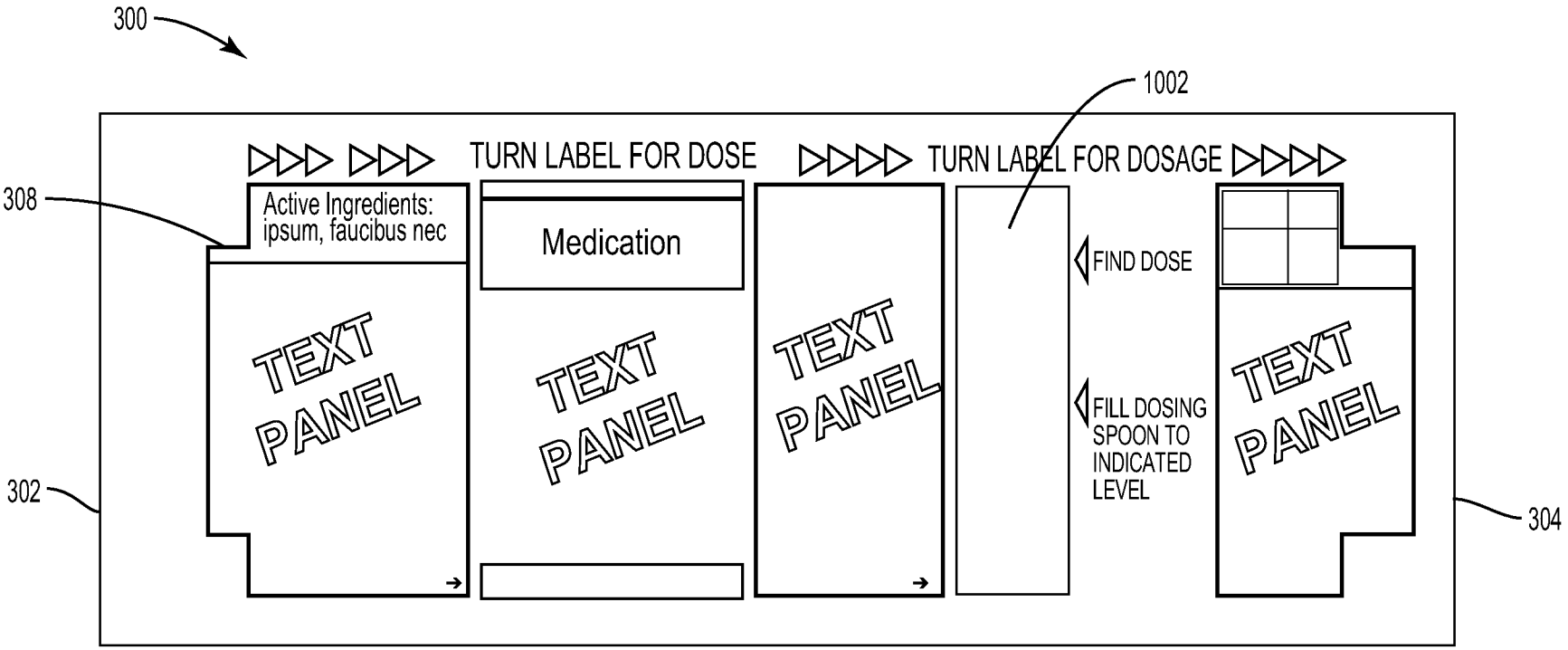
FIG. 13 is a front view of a top label according to various embodiments.

FIGS. 12 and 13 illustrate a base label 100 and top label 300, respectively, that may comprise a label measurement system for a container, such as a medication container 1405 (see FIG. 14) according to various embodiments. The base label indicia 106 may comprise a plurality of individual measurement information indicia 1205-1255 printed thereon. The top label 300 may comprise indicia 308 relaying product-related information, safety-related information, manufacturer-related information, and the like. In various embodiments, the top label may contain a transparent window 1002 as described previously (see FIG. 10).

In various embodiments, the plurality of measurement information indicia 1205-1255 may comprise illustrations of a second container, such as a measurement spoon, measurement cup, spray dispenser, inhaler, and the like used to dispense the contents of the container 1405. For example, as shown in FIG. 12, the measurement information indicia 1205-1255 may comprise illustrations of a measurement spoon. Each measurement information indicia 1205-1255 may illustrate a different dose amount. Additionally, the measurement information indicia 1205-1255 may indicate the dose in a variety of formats, such as pictorial, graphical, and numerical.

Referring to the first measurement information indicia 1205 of a measurement spoon, the indicia 1205 may comprise a series of gradient lines 1260 that divide the measurement spoon into dose amounts or portions of dose amounts. In the embodiments illustrated in FIG. 12, the gradient lines 1260 indicate dose amounts of milliliters (mL) and half milliliters between each milliliter gradient line 1260. Corresponding to at least a portion of the gradient lines 1260, the measurement information indicia 1205 may comprise numerical indicia for the specific unit of measurement 1265. As shown in FIG. 12, the specific units of measurement 1265 indicate each milliliter of volume (i.e., 4 mL, 5 mL, 6 mL, 7 mL, etc.). One skilled in the art will readily recognize that any unit of measurement (e.g., milliliters, ounces, teaspoons, tablespoons, etc.) may be used in various embodiments, and the gradient lines 1260 may indicate any whole number (e.g., 1, 2, 3, etc.) of units or partial units (e.g., ½, ⅓, ¼, etc.).

In various embodiments, each measurement information indicia 1205-1255 may comprise a shaded section 1270 that visually indicates to a user the proper amount to dispense from the container 1405 (i.e., the proper level to fill the second container) for the indicated dose. For example, the shaded section 1270 of the measurement information indicia 1205 indicates 4½ mL, the shaded section 1270 of measurement information indicia 1210 indicates 5 mL, the shaded section 1270 of measurement information indicia 1215 indicates 5½ mL, and so on. Each measurement information indicia 1205-1255 may also comprise numerical representation of the dosage 1275. In various embodiments, the numerical representation of the dosage 1275 may be spaced apart from the gradient lines 1260 and the specific units of measurement 1265 such that the numerical representation of the dosage 1275 may be displayed separately or independently. For example, the user may not be familiar with the abbreviation "mL" as shown in FIG. 12. However, the user may instead match the number "5" of numerical representation of the dosage 1275 in the measurement information indicia 1210 with the specific unit of measurement 1265 that also indicates "5" and fill the second container to the gradient line 1260 corresponding to "5" and obtain the correct dose.

Figure 14:
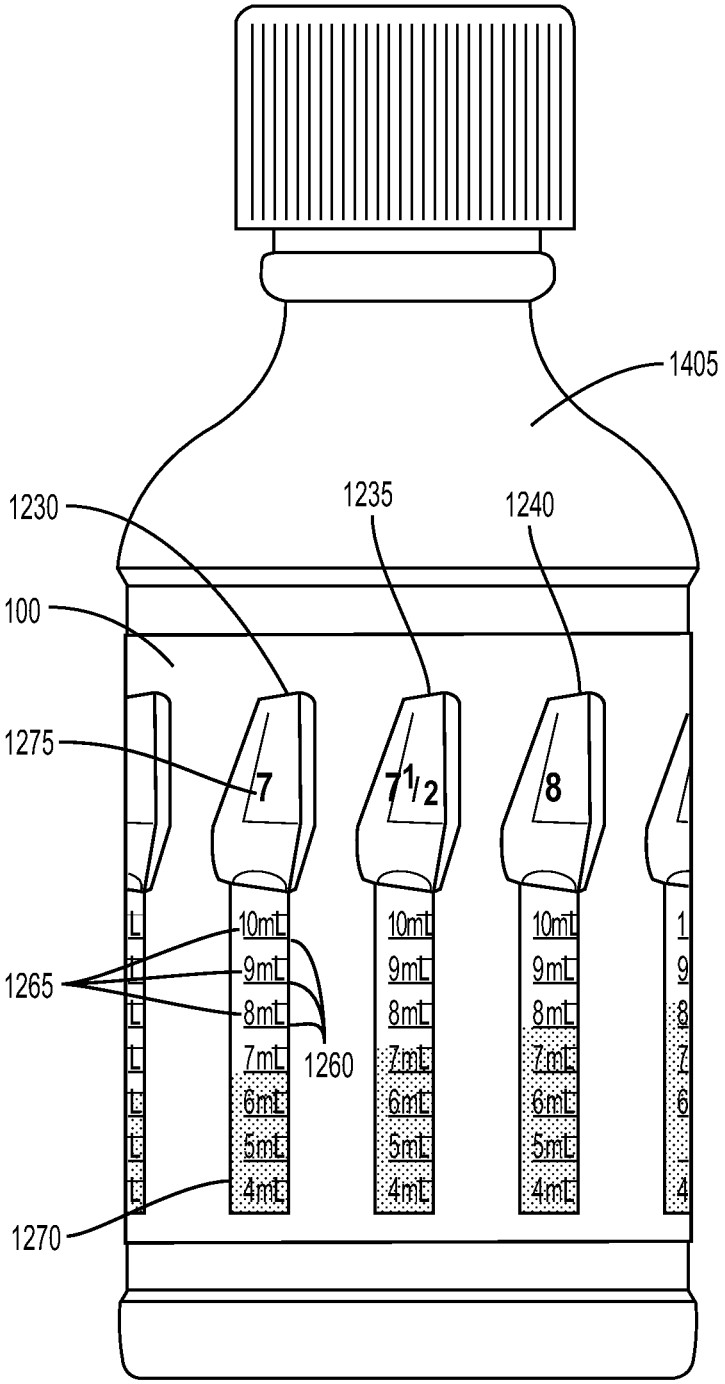
FIG. 14 illustrates an exemplary base label secured about a container according to various embodiments.
Figure 15A:
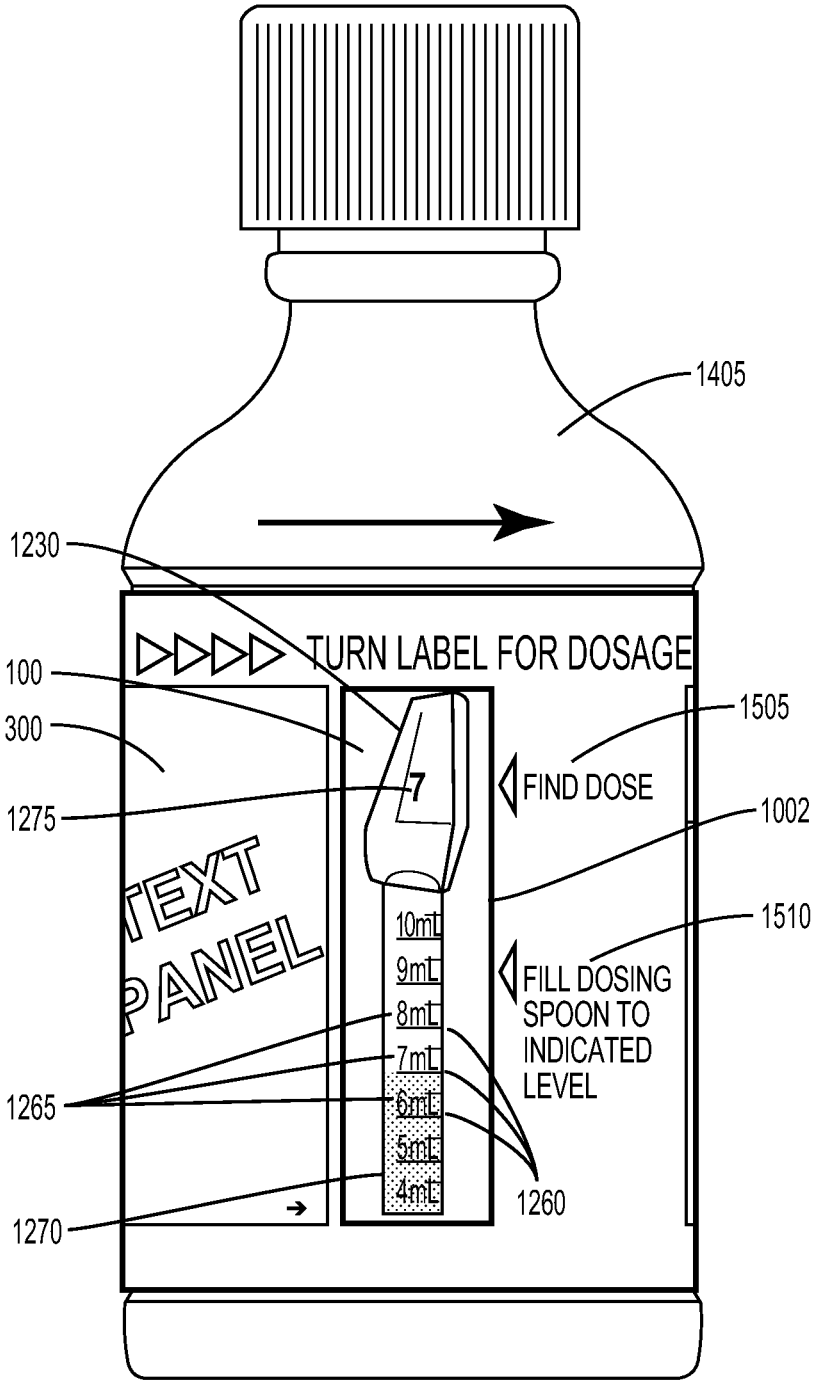
FIG. 15A illustrates an exemplary base label and top label secured about a container according to various embodiments.
Figure 15B:
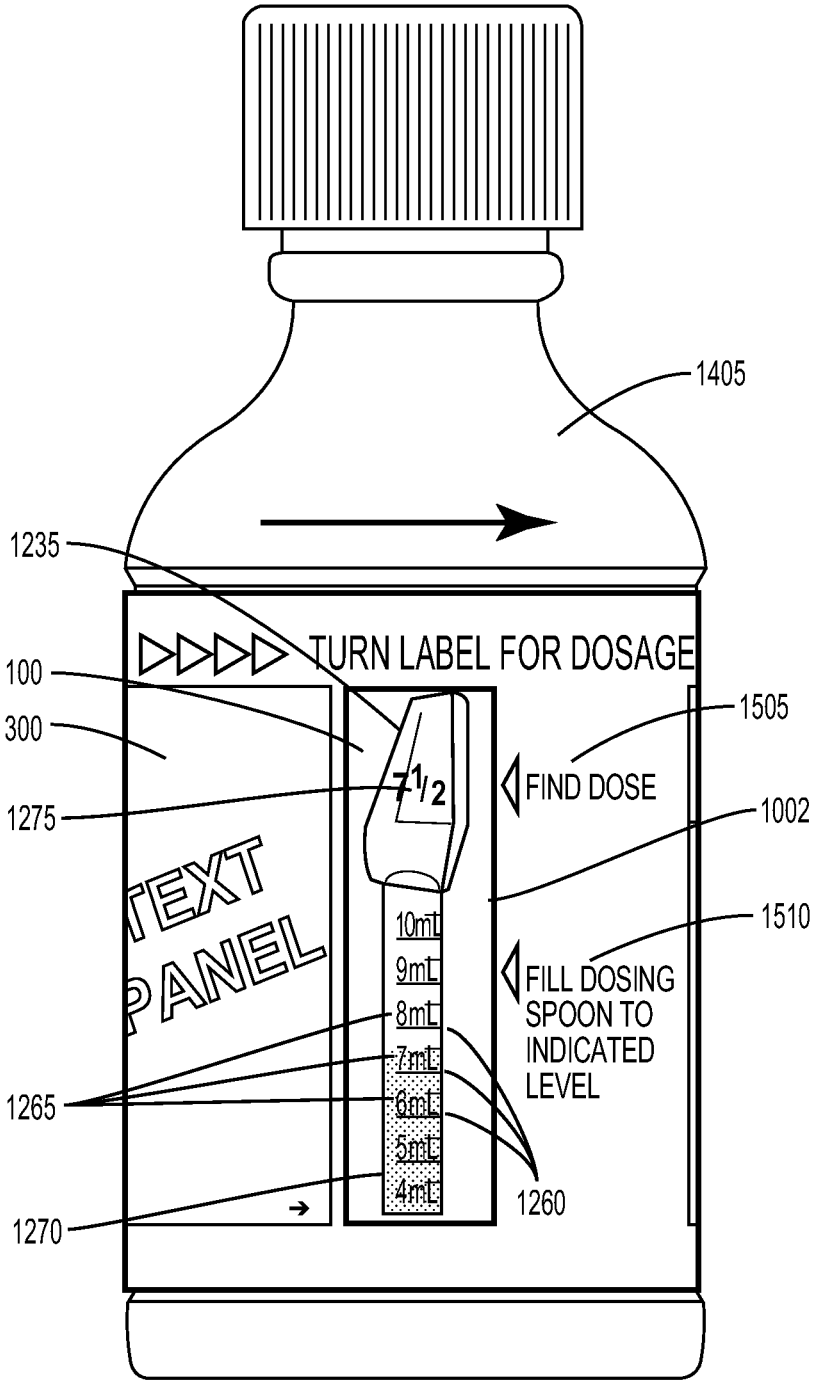
FIG. 15B illustrates an exemplary base label and top label secured about a container according to various embodiments.
Figure 15C:
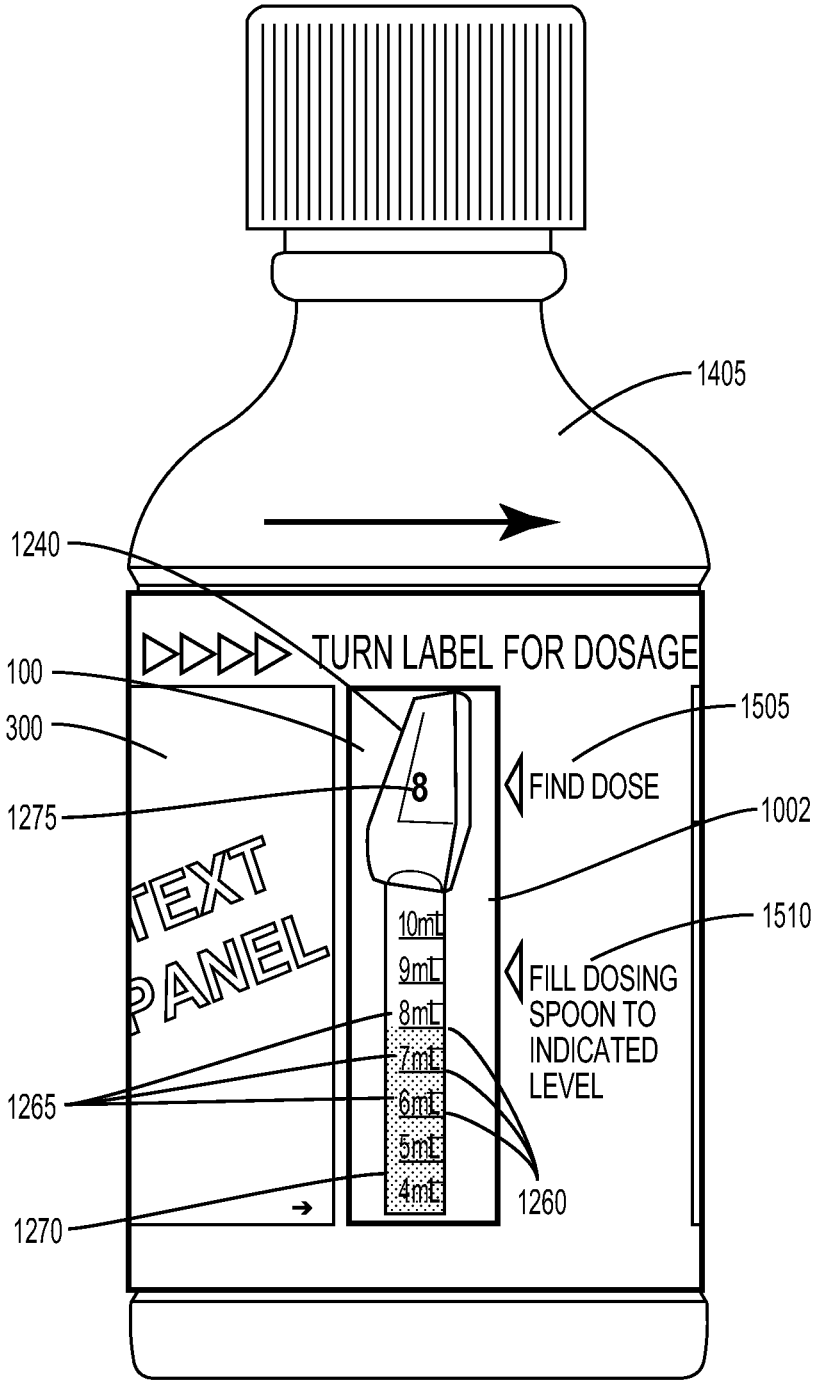
FIG. 15C illustrates an exemplary base label and top label secured about a container according to various embodiments

FIG. 14 illustrates the base label 100 positioned on the container 1405 according to various embodiments. As discussed above, the base label 100 may comprise a plurality of measurement information indicia 1205-1255 printed on the front surface such that the measurement information indicia 1205-1255 at least partially encircle the container 1405. FIGS. 15A through 15C illustrate the top label 300 in place over the base label 100 the container 1405 according to various embodiments. The base label 100 and the top label 300 may comprise a label measurement system that may be used, for example, on a medication container 1405 to provide additional functionality that may allow a consumer to obtain a wide variety of information about the product in the container 1405 in addition to the label measurement system. For example, the base label 100 and the top label 300 may provide information concerning the company that produced the product, drug facts, drug interactions, games, contests, information on related products or services, or any other information. FIG. 15A illustrates the top label 300 in place over the base label 100. As described previously, the top label 300 may be applied such that the top label 300 is rotatable around a circumference of the container 1405. In FIG. 15A, the top label 300 has been rotated in the direction of the arrow revealing at least one of the measurement information indicia 1205-1255 through the transparent window 1002 in the top label 300. Similarly, FIGS. 15B and 15C illustrate the top label 300 further rotated in the direction of the arrow, thus revealing a different one of the measurement information indicia 1205-1255 through the transparent window 1002 of the top label 300. The top label 300 may be rotated until the desired measurement information indicia 1205-1255 is visible in the transparent window 1002. Although FIGS. 15A-15C illustrate a single measurement information indicia 1205-1255 visible through the transparent window 1002, two or more measurement information indicia 1205-1255 may simultaneously be visible through the transparent window 1002 in various embodiments.

The measurement information indicia 1205-1255 as shown in FIGS. 15A through 15C illustrate a measuring spoon (also known as a dosing spoon) commonly used to dispense a liquid medication. Such measuring spoons are often used when the patient taking the medication is a child in order to facilitate measuring the medication and administering it to the child. The measuring spoon is often packaged with the medication and delivered to the consumer. Instructions detailing the proper dose may be printed on the top label 300. However, the consumer may not read the instructions, may misunderstand the instructions, or may be unable to read the instructions, all of which may lead to the administering of a dangerously low or high dose.

In various embodiments, the health care provider dispensing the medication may rotate the outer label 300 until the measurement information indicia 1205-1255 corresponding to the proper dose is visible through the transparent window 1002. The consumer may then simply look at the measurement information indicia 1205-1255 and determine the correct dose, which may be accomplished in a number of ways without reading any instructions or even being able to read the instructions. In the exemplary situation where the prescribed dose is 8 mL, the outer label 300 may be rotated to the position shown in FIG. 15C. The consumer may observe that the shaded section 1270 of the measurement information indicia 1240 is at the specific unit of measurement 1265 at the 8 mL mark, and then fill the second container (e.g., the measuring spoon) to the 8 mL mark. Alternatively, the consumer may fill the second container until the amount of material in the second container is approximately the same as that indicated by the shaded section 1270. The consumer may also fill the second container until the material fills the second container to the same gradient line 1260 indicated in the measurement information indicia 1240. Finally, the consumer may observe the numerical representation of the dose 1275 and fill the second container to the matching number. It should be noted that although the above discussion is in reference to a liquid medication dispensed from the container 1405, the present technology is not limited to liquids. For example, the container 1405 may contain a powder that is dispensed in a volumetric dose similar to a liquid. Additionally, as described further below, the container 1405 may contain solids in other forms such as tablets, pills, capsules, and the like.

In various embodiments, the top label 300 may include instructions to aid the consumer in the use and interpretation of the measurement information indicia 1205-1255 visible in the transparent window 1002. For example, the top label 300 in FIG. 15A may comprise first instruction 1505 associated with the numerical representation of the dosage 1275, such as "Find Dose" or other similar instruction. The first instruction 1505 instructs the consumer to find the dose corresponding to the numerical representation of the dosage 1275 (in this case, 7) on the second container (e.g., the measuring spoon) and fill the second container to that level. Various embodiments of the top label 300 may also comprise a second instruction 1510 to facilitate the use of the gradient lines 1260, the specific unit of measurement 1265, and the shaded section 1270. For example, the top label 300 in FIG. 15A may comprise second instruction 1510 such as "Fill Dosing Spoon to Indicated Level" or other similar instruction. The second instruction 1510 may instruct the consumer to fill the second container until it approximately matches the measurement information indicia 1240.

Figure 16:
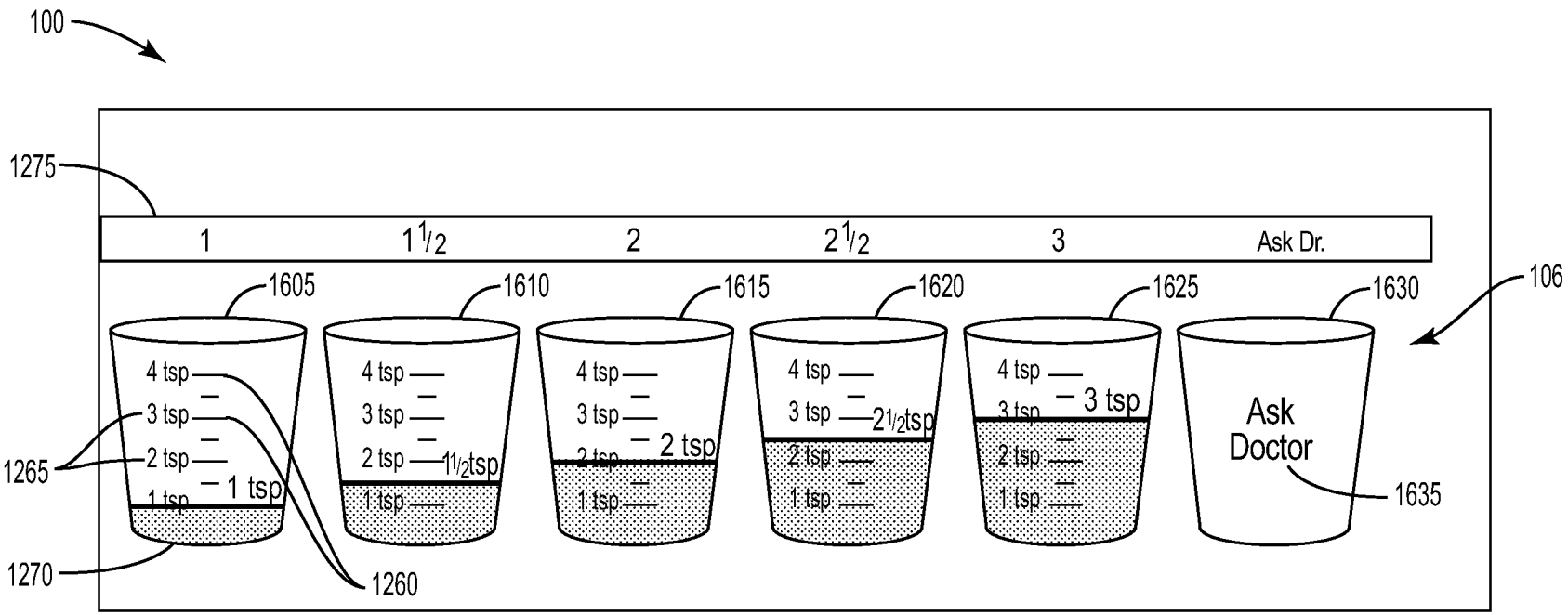
FIG. 16 is a front view of a base label according to various embodiments.
Figure 17:
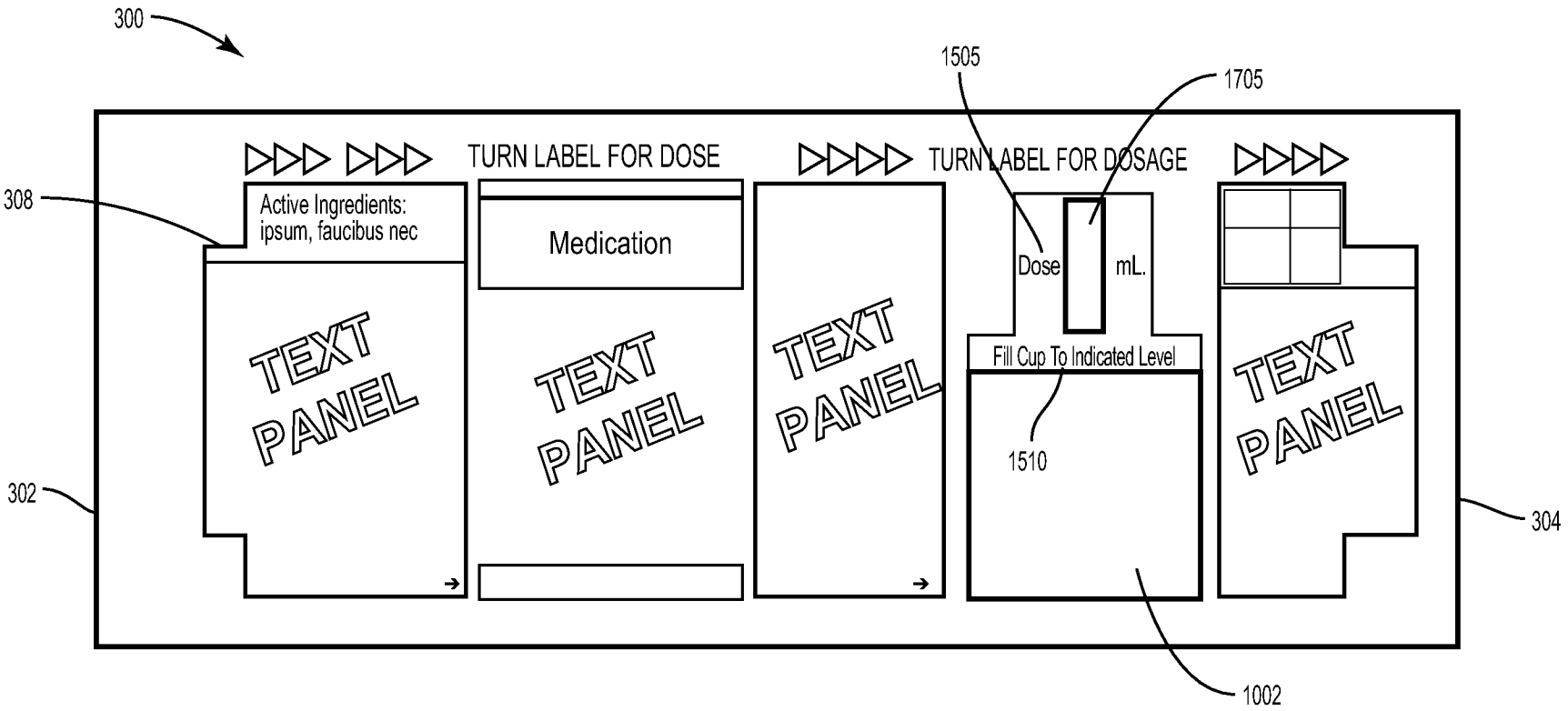
FIG. 17 is a front view of a top label according to various embodiments.
Figure 18:
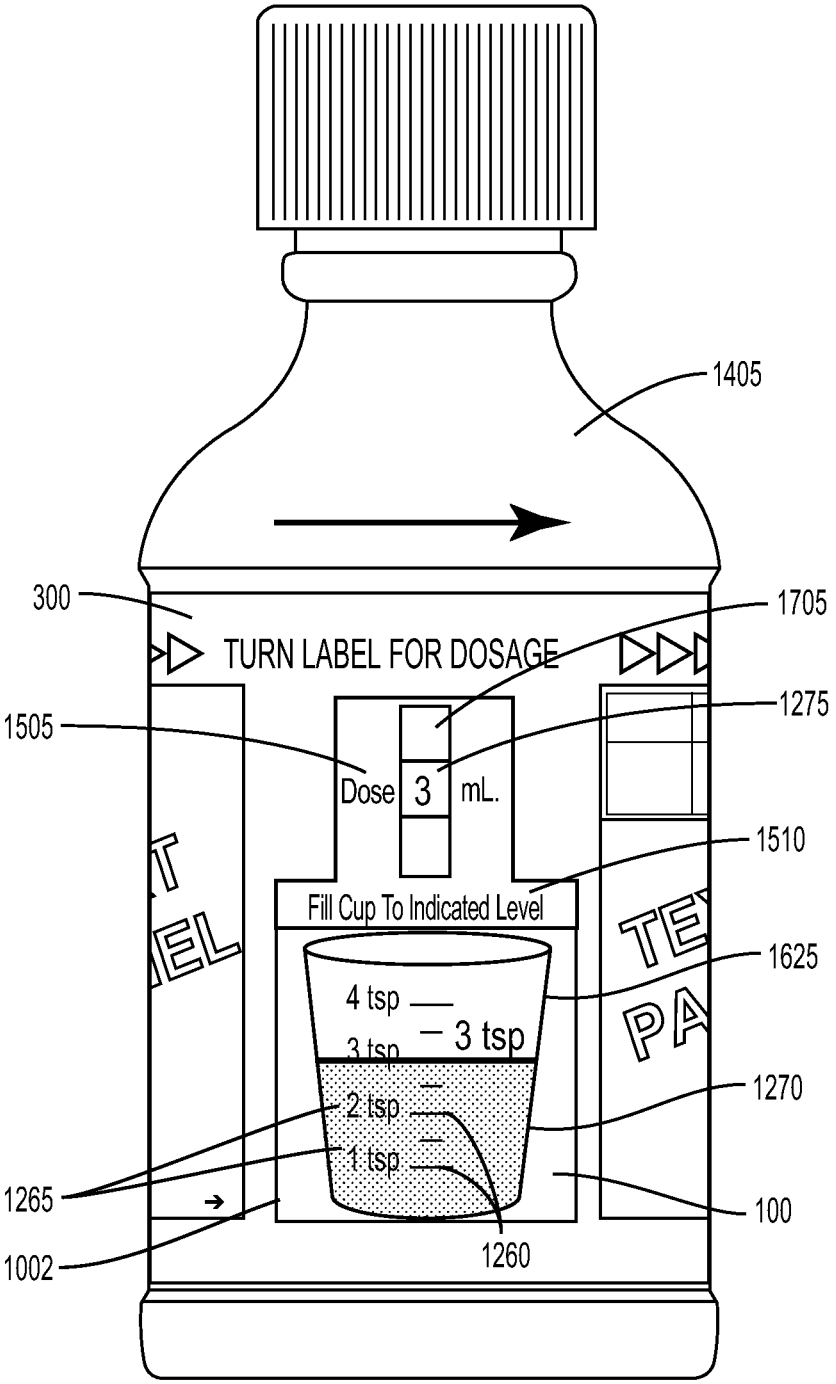
FIG. 18 illustrates an exemplary base label and top label secured about a container according to various embodiments.

Another common form of dispensing medication is by a cup. FIGS. 16 through 18 illustrates various embodiments in which the base label indicia 106 comprises a plurality of individual measurement information indicia 1605-1630 printed thereon in the form of a measurement cup. The individual measurement information indicia 1605-1630 may also comprise gradient lines 1260, specific units of measurement 1265, and shaded section 1270. The base label 100 may also comprise numerical representation of the dosage 1275 as described previously for FIG. 12. In certain situations, consultation with a health care provider may be required before consuming the medication. In various embodiments as illustrated in FIG. 16, at least one of the measurement information indicia 1630 may include directions such as "Ask Doctor" or "Consult Health Care Provider" or other similar instruction instead of a specific dose.

Various embodiments of the top label 100 may comprise a second transparent window 1705 in addition to the transparent window 1002 described previously. For example, as illustrated in FIG. 18, the transparent window 1002 may display one or more of the measurement information indicia 1605-1630, while the second transparent window 1705 may display the numerical representation of the dose 1275. The second transparent window 1705 may be used to highlight the numerical representation of the dose so that the numerical value is more readily apparent.

Figure 19:
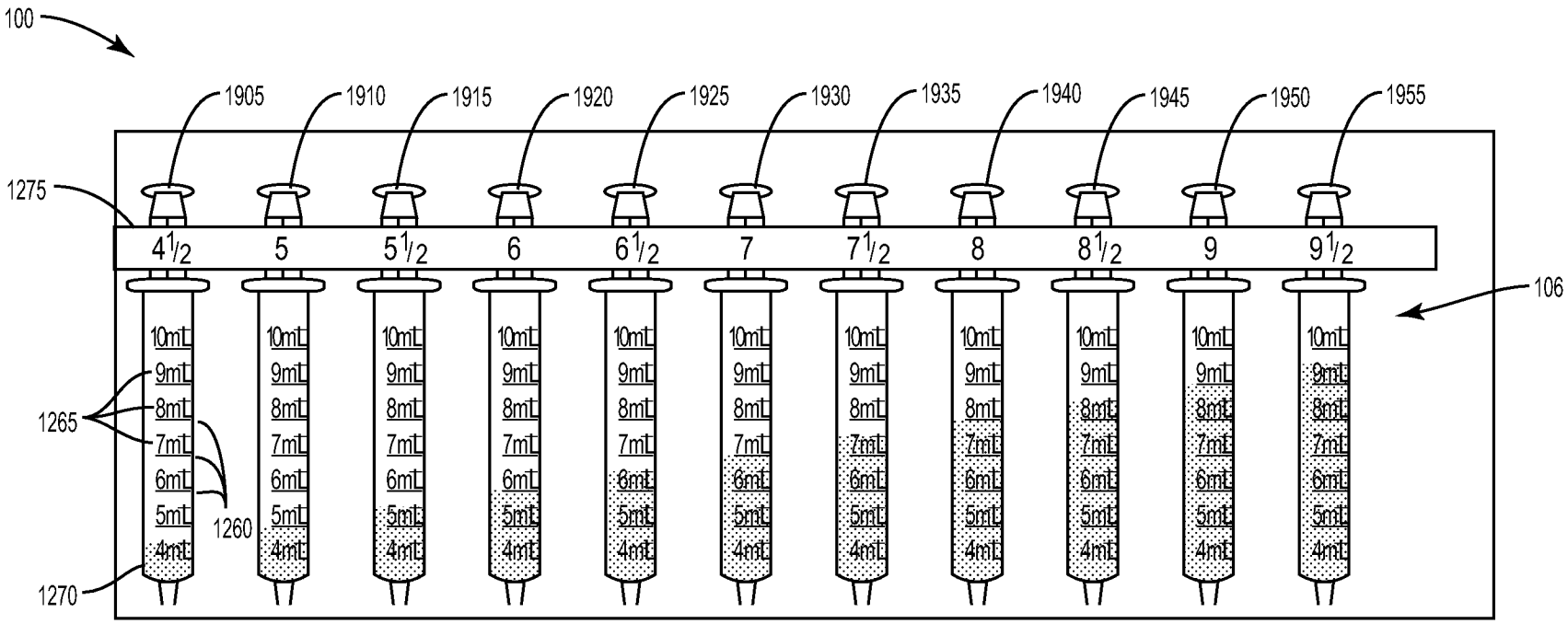
FIG. 19 is a front view of a base label according to various embodiments.
Figure 20:
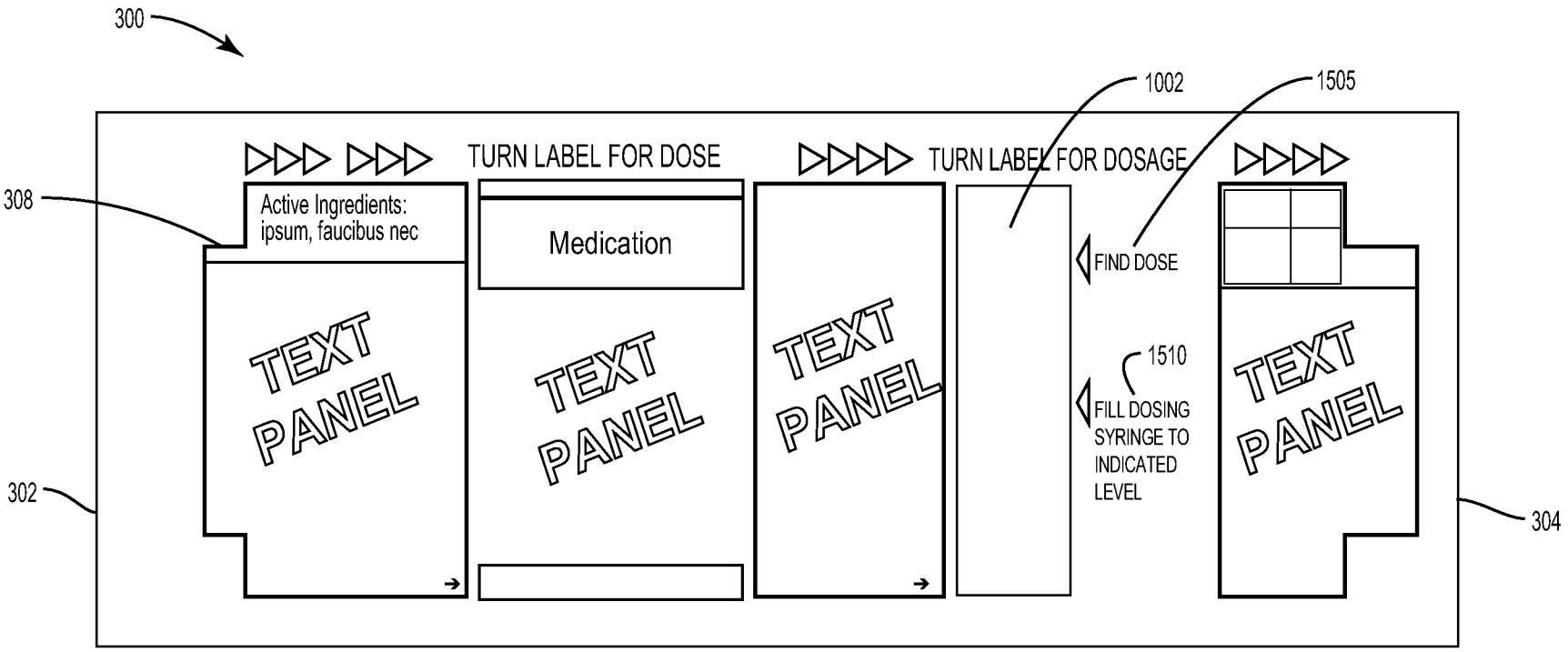
FIG. 20 is a front view of a top label according to various embodiments.
Figure 21:
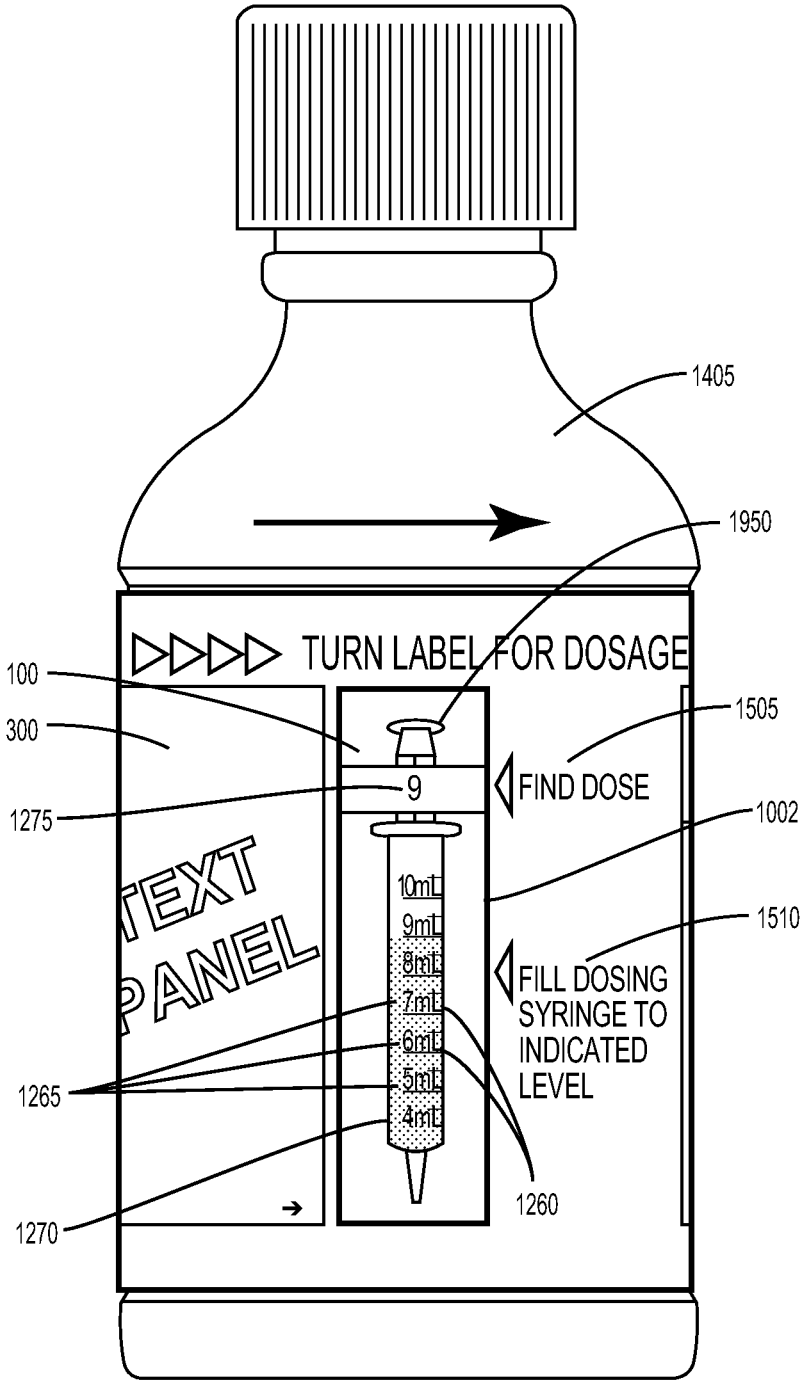
FIG. 21 illustrates an exemplary base label and top label secured about a container according to various embodiments.

Medications may also be administered by a syringe, and FIGS. 19 through 21 illustrates the label measurement system adapted for such a delivery system according to various embodiments. The measurement information indicia 1905-1955 of the base label 100 may comprise illustrations of syringes having gradient lines 1260, specific units of measurement 1265, and shaded sections 1270 representing increasing size of the dose as described previously. The base label 100 may also comprise numerical representations of the dosage 1275 that may be visible through a transparent window 1002 as illustrated in FIG. 21, or a second transparent window 1705 as illustrated in FIG. 17. FIG. 20 illustrates various embodiments in which the size of the transparent window 1002 may be adapted to correspond to the general shape of each measurement information indicia 1905-1955. For example, the measurement information indicia 1905-1955 of FIG. 19 depicts syringes, which are generally long and narrow in shape and the transparent window 1002 conforms to the same general shape. However, in FIG. 16, the measurement information indicia 1605-1630 depict measurement cups which have a more square shape and the transparent window 1002 in FIG. 17 conforms to the generally square shape.

Figure 22:
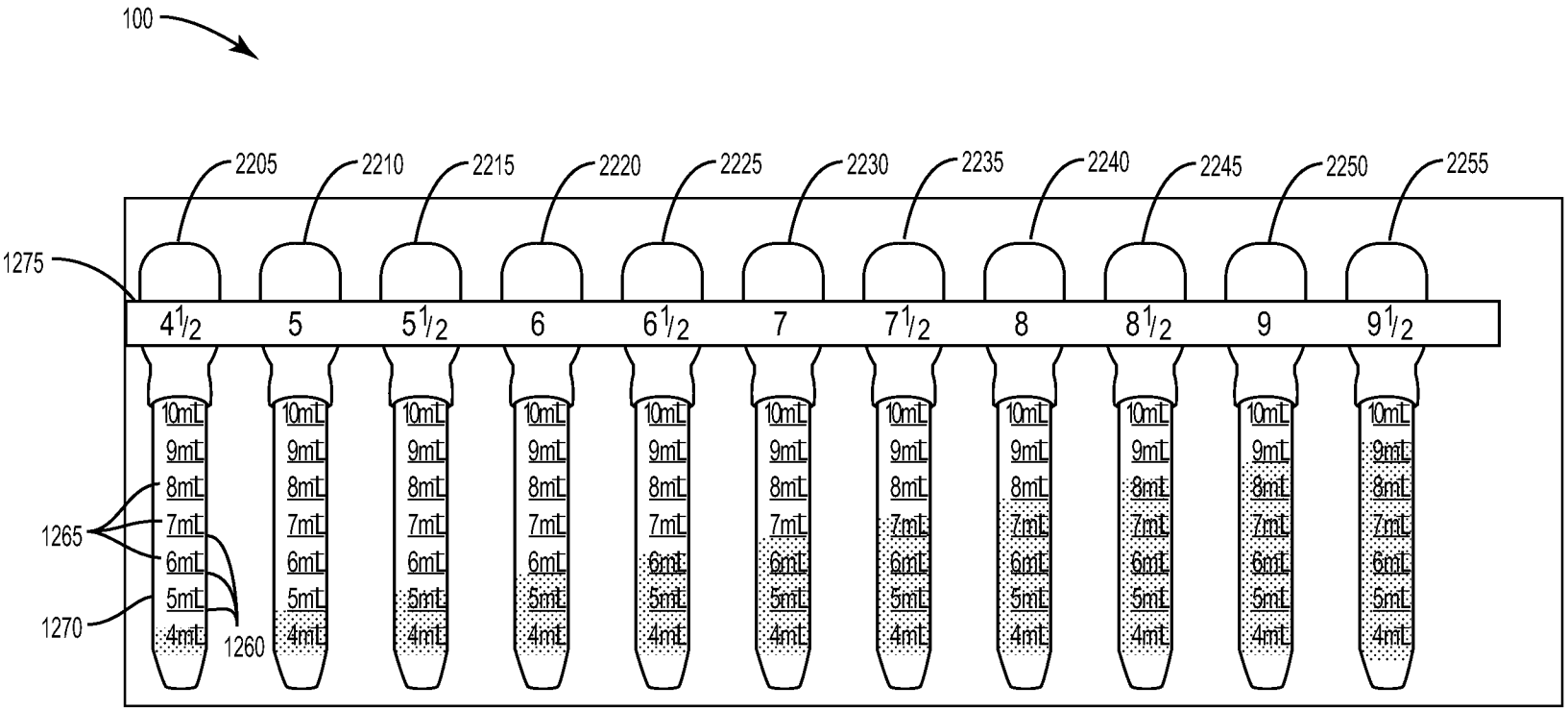
FIG. 22 is a front view of a base label according to various embodiments.
Figure 23:
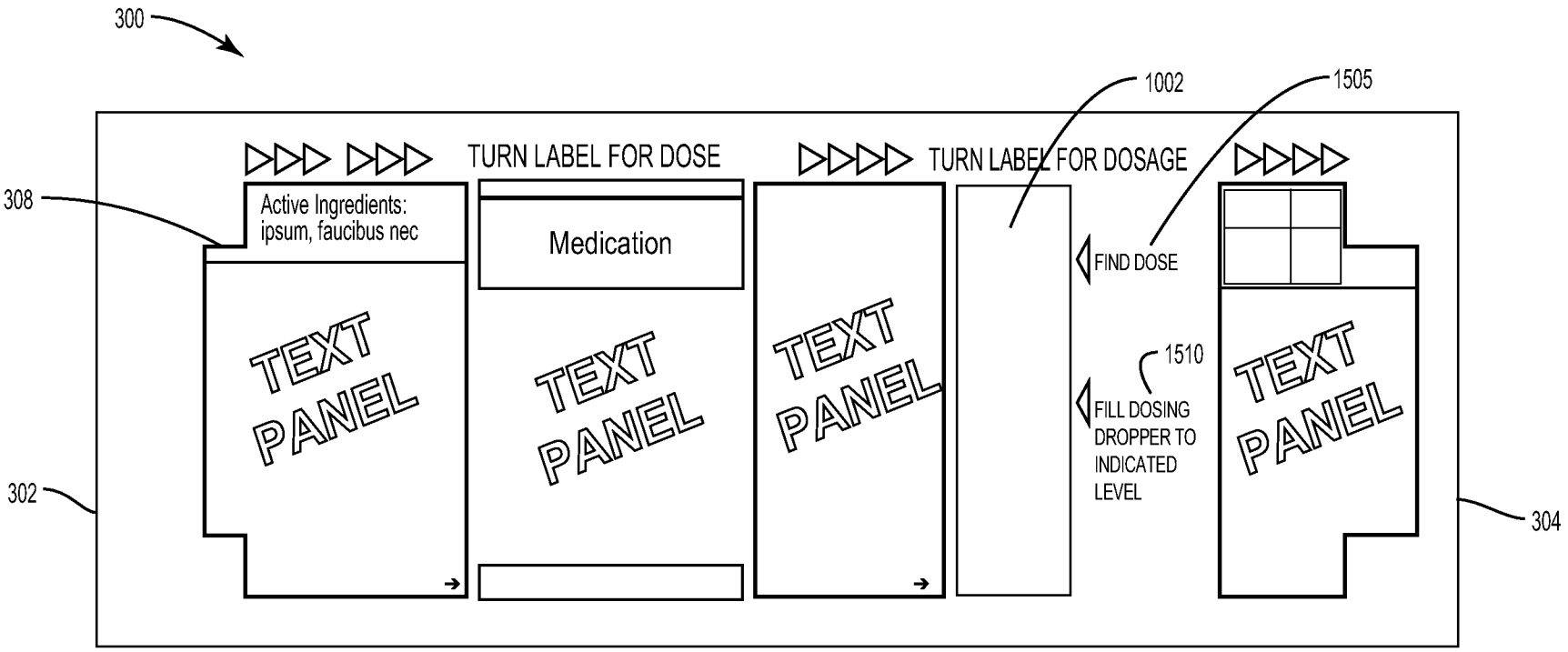
FIG. 23 is a front view of a top label according to various embodiments.
Figure 24:
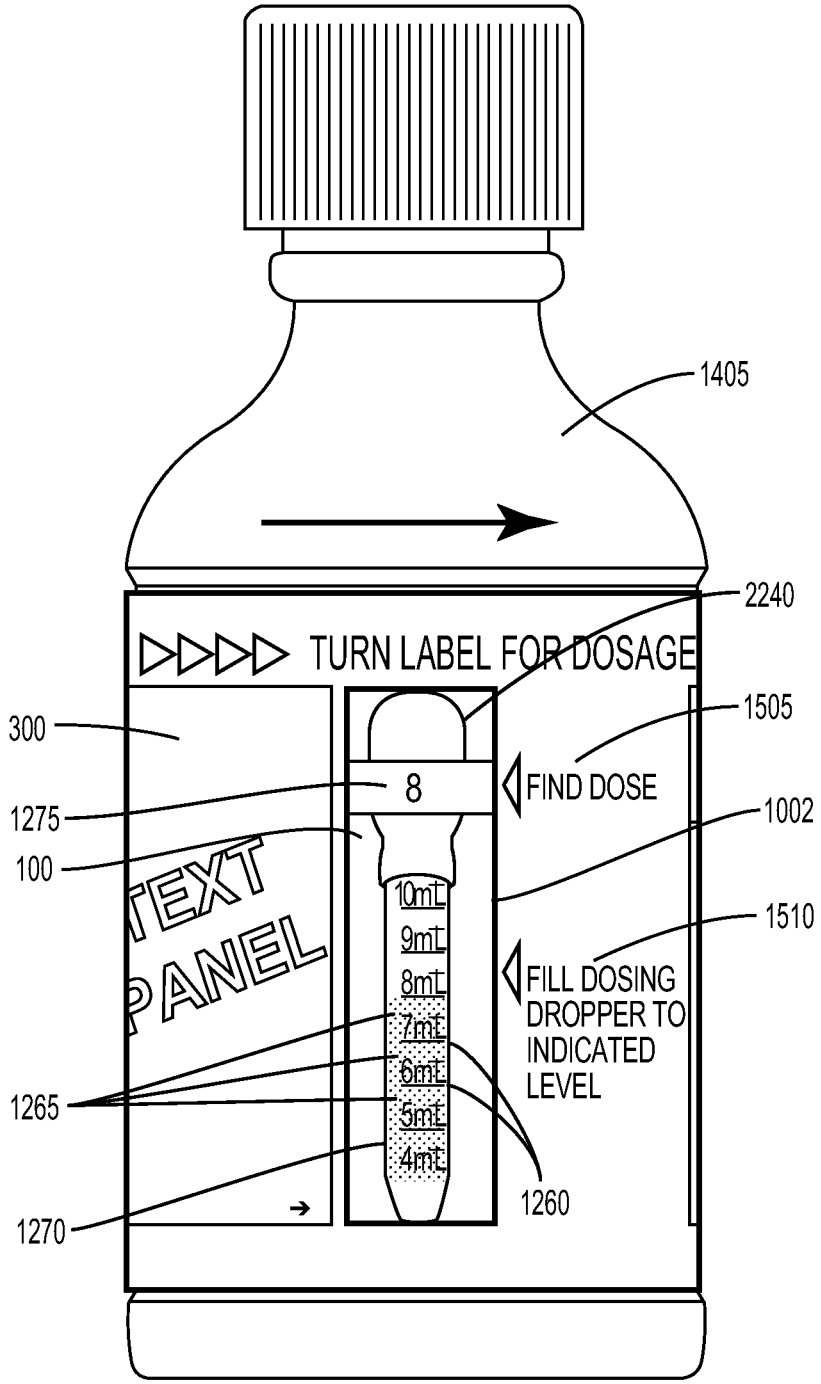
FIG. 24 illustrates an exemplary base label and top label secured about a container according to various embodiments.

Similar to the syringe described above, a dropper may also be used to dispense the medication, and FIGS. 22 through 24 illustrates the label measurement system adapted for such a delivery system according to various embodiments. The measurement information indicia 2205-2255 of the base label 100 may comprise illustrations of droppers having gradient lines 1260, specific units of measurement 1265, and shaded sections 1270 to represent increasing size of the dosage as described previously. The base label 100 may also comprise numerical representations of the dosage 1275 that may be visible through a transparent window 1002 as illustrated in FIG. 23, or a second transparent window 1705 as illustrated in FIG. 17.

Figure 25:
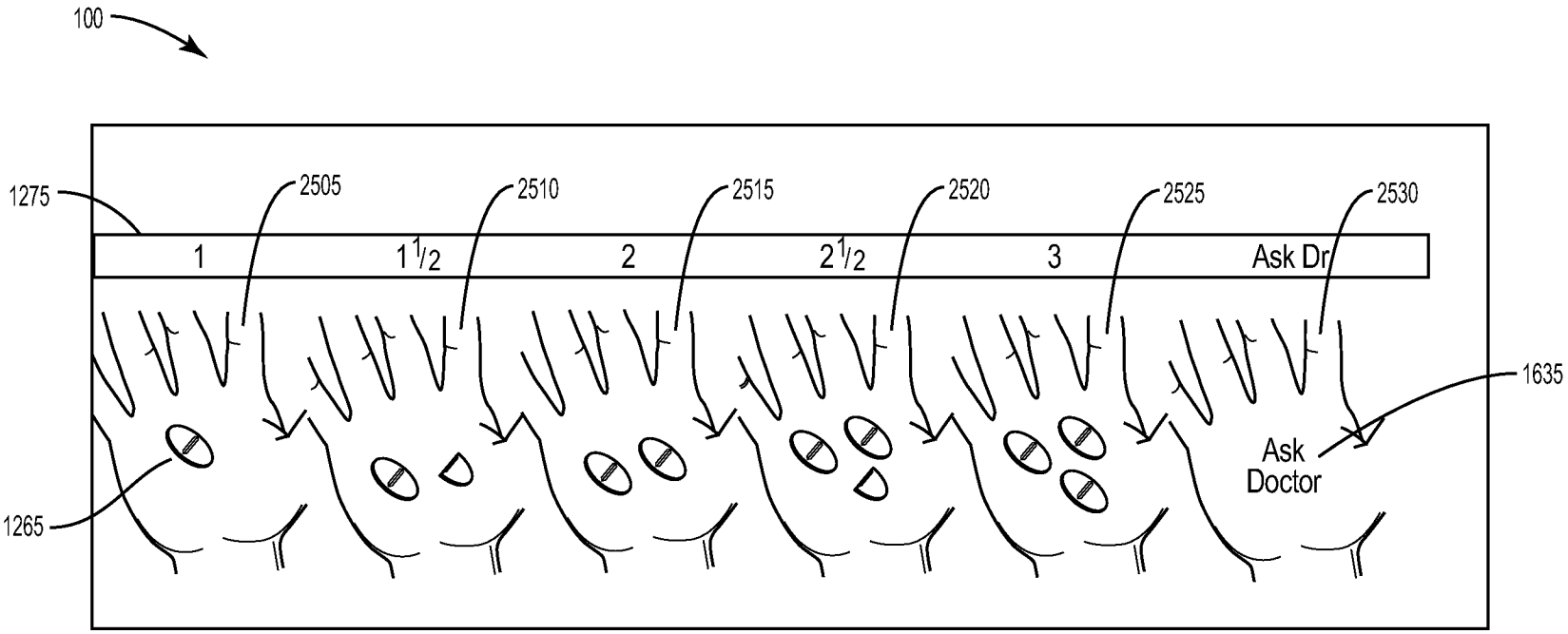
FIG. 25 is a front view of a base label according to various embodiments.
Figure 26:
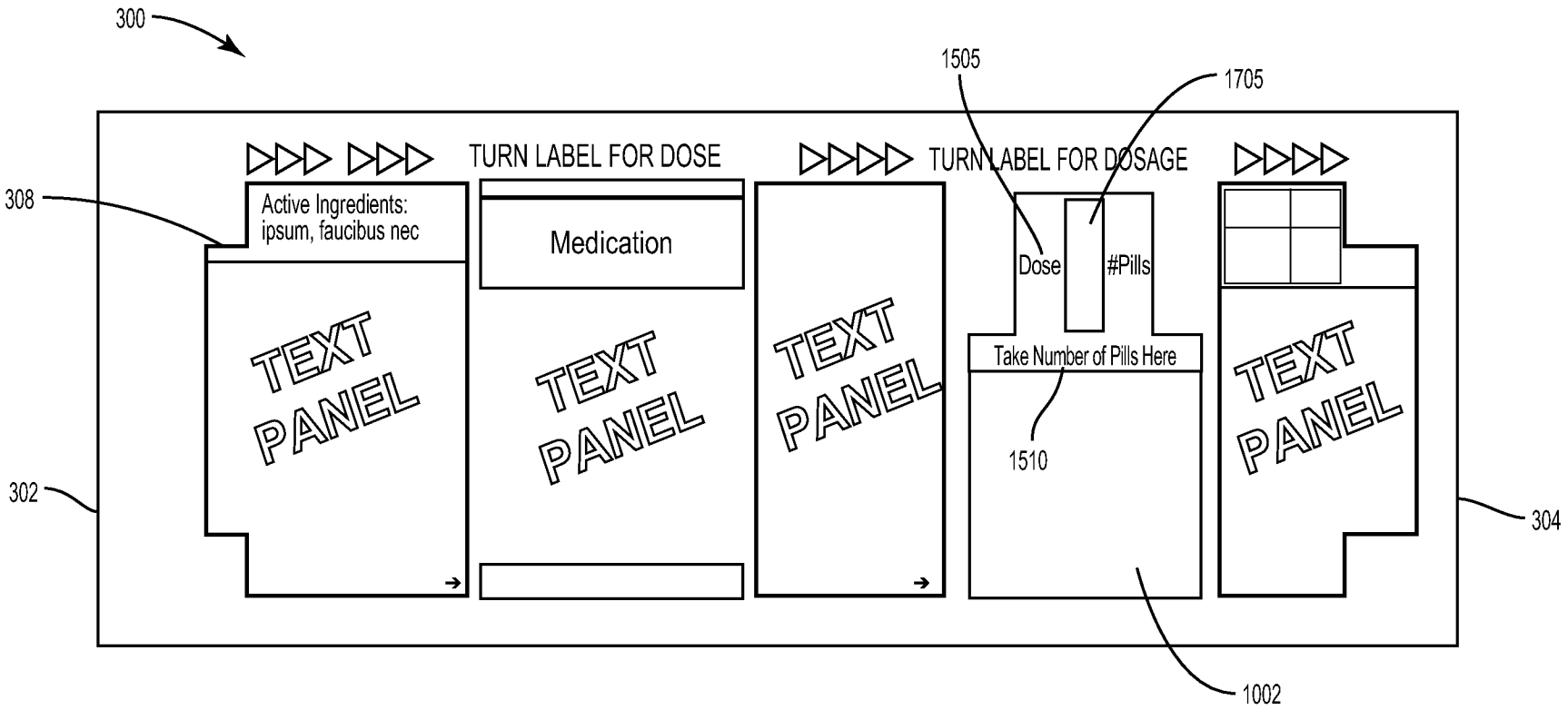
FIG. 26 is a front view of a top label according to various embodiments.
Figure 27:
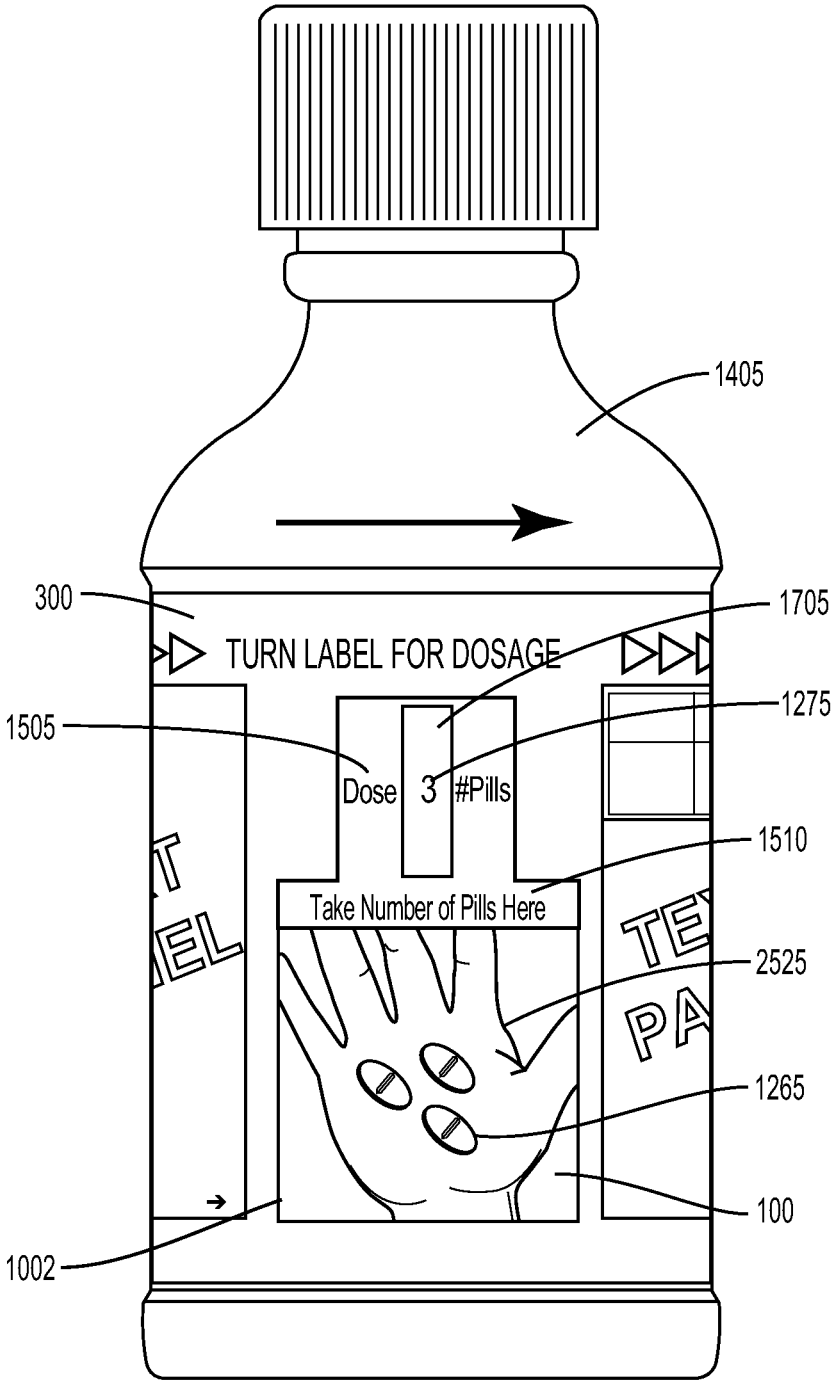
FIG. 27 illustrates an exemplary base label and top label secured about a container according to various embodiments.

While FIGS. 12 through 24 illustrate various embodiments adapted for liquid medications, the label measurement system may also be adapted for use with solid medications such as pills, tablets, capsules, powders, and the like. For example, the measurement information indicia 2505-2530 of FIG. 25 may depict pills, tablets, or capsules in the palm of a hand in the same way the consumer may shake pills, tablets, or capsules out of the container 1405 into their hand. Consequently, there may be no need for gradient lines 1260 or shaded sections 1270 as there may be no second container for dispensing the medication as with liquid medication. The measurement information indicia 2505-2530 may comprise specific units of measurement 1265 in the form of pictorial representations of the number of pills, tablets, or capsules in each dose. For example, measurement information indicia 2505 depicts one pill, measurement information indicia 2510 depicts 1½ pills, measurement information indicia 2515 depicts 2 tablets, and so on. The base label 100 may also comprise numerical representations of the dosage 1275 corresponding to the specific units of measurement 1265.

Figure 28:
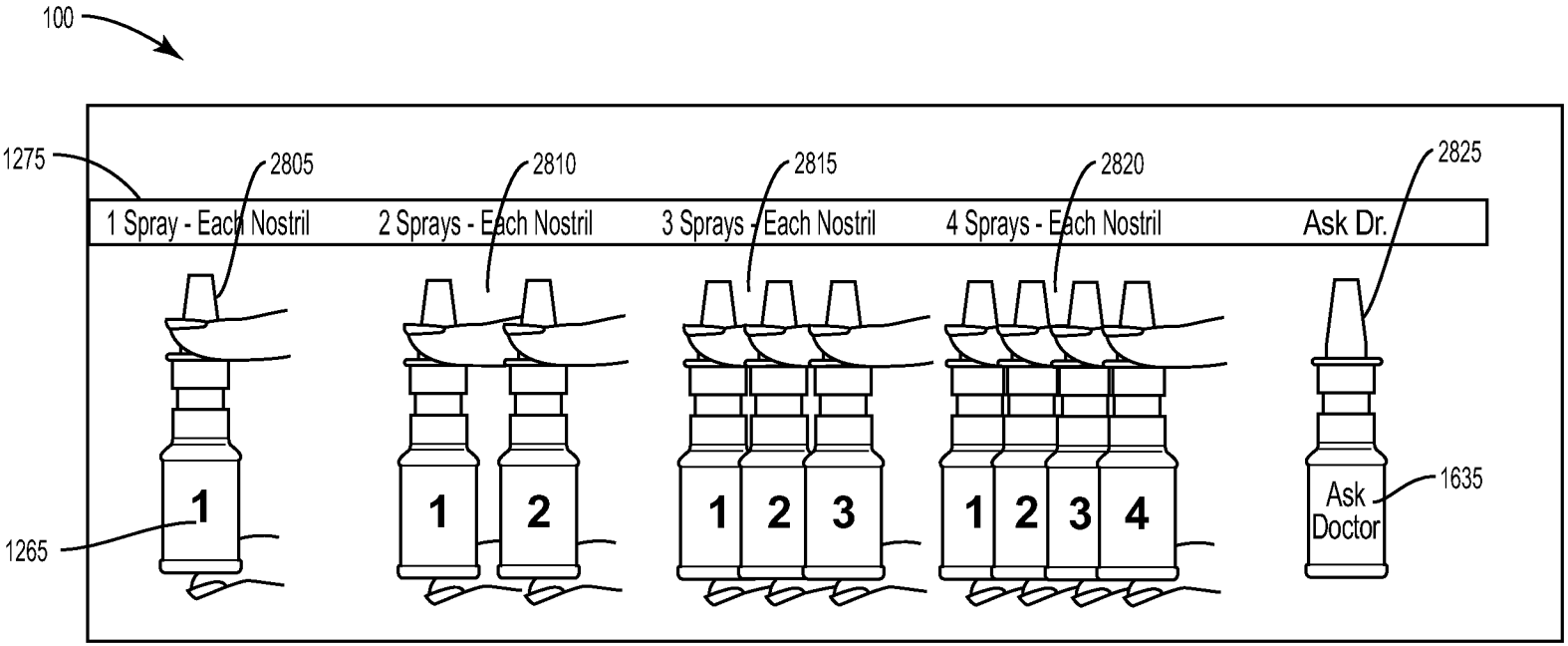
FIG. 28 is a front view of a base label according to various embodiments.
Figure 29:
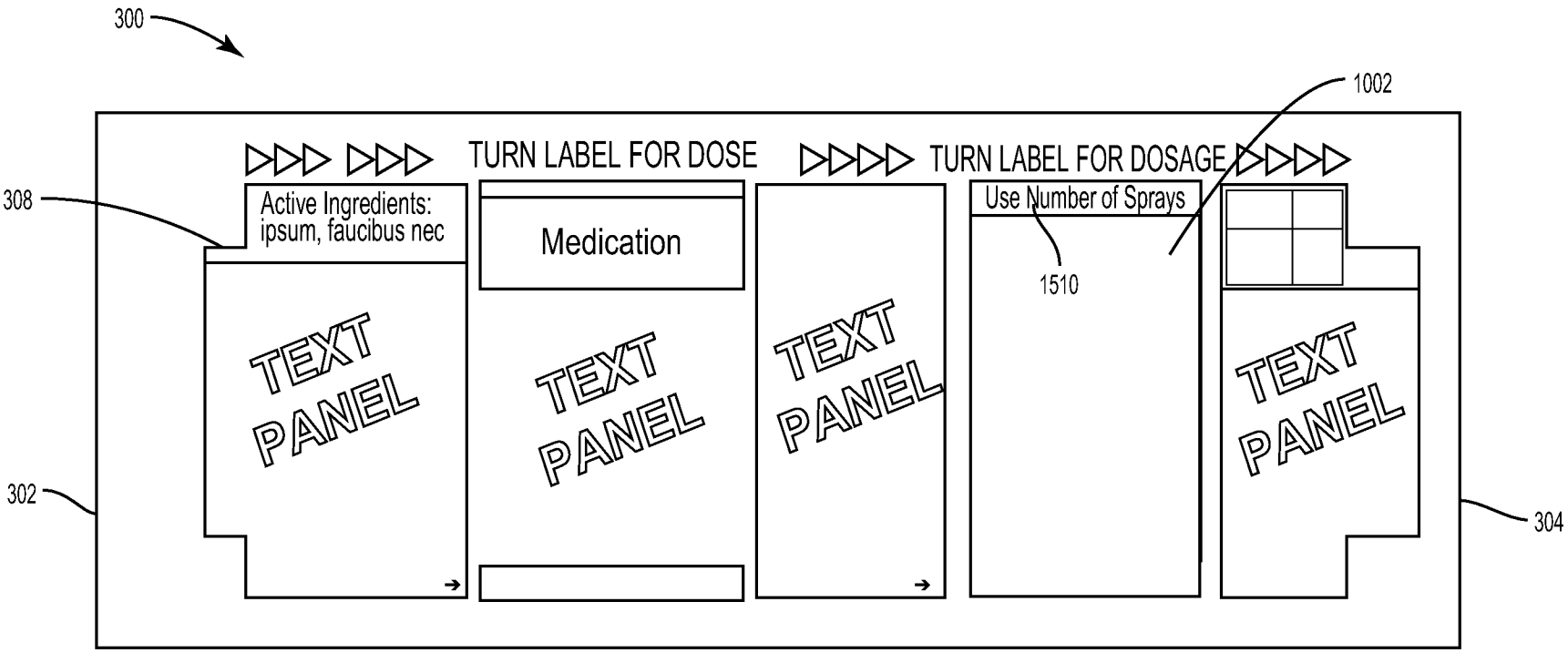
FIG. 29 is a front view of a top label according to various embodiments.
Figure 30:
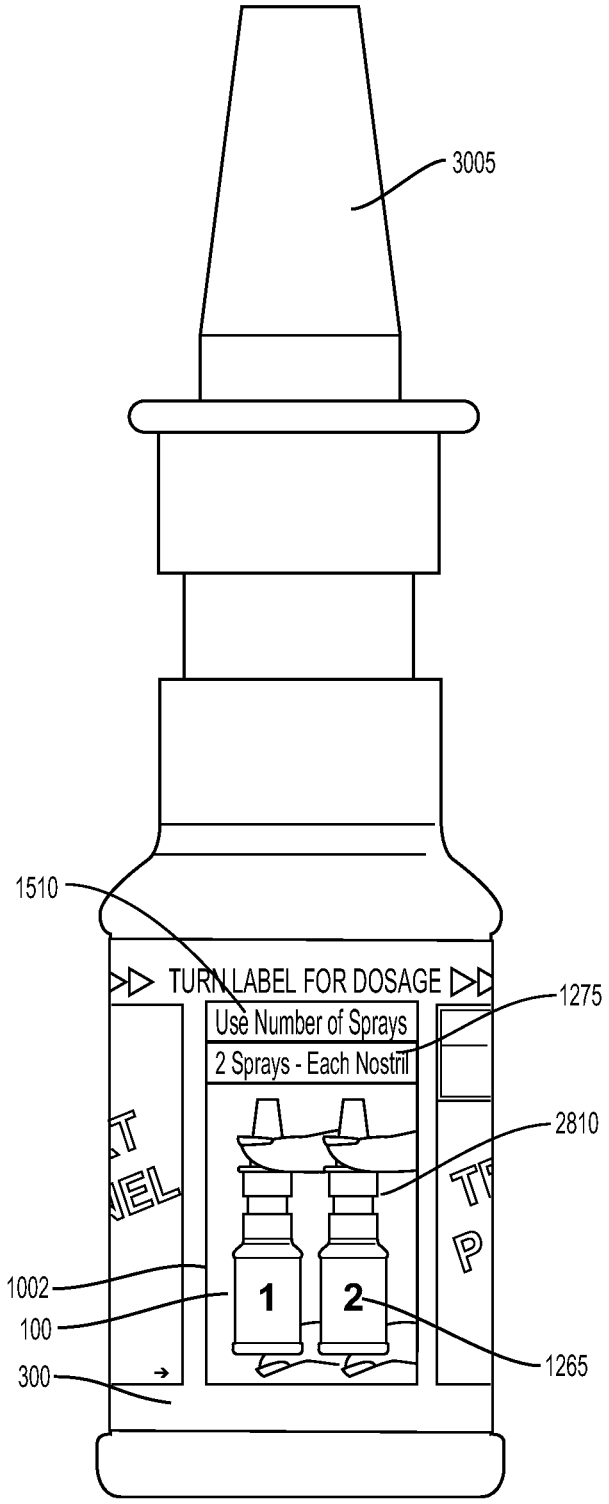
FIG. 30 illustrates an exemplary base label and top label secured about a container according to various embodiments.

Returning to liquid medications, a nasal inhaler may also be used to dispense medications by spraying the medication one or more times from the inhaler. FIGS. 28-30 illustrate various embodiments of the label measurement system adapted for inhalers. The specific units of measurement 1265 may depict the number of sprays in each dose, and the dose may be further depicted in the number of inhalers in each of the measurement information indicia 2805-2825 in FIG. 28. For example, measurement information indicia 2805 depicts a single inhaler for a one-spray dose and the corresponding number "1" as the specific unit of measurement 1265, measurement information indicia 2810 depicts two inhalers for a two-spray dose and the corresponding number "2" as the specific unit of measurement 1265, measurement information indicia 2815 depicts three inhalers for a three-spray dose and the corresponding number "3" as the specific unit of measurement 1265, and so on. The base label 100 may also comprise numerical representations of the dosage 1275 corresponding to the specific units of measurement 1265.

Various embodiments may also be used to determine a proper dose based on consumer-related information. For example, the base label 100 may comprise a plurality of values related to the consumer-related information. The plurality of values may be presented numerically, graphically, or both. The consumer-related information may be, for example, height, weight, age, blood pressure, body temperature, level of pain or other discomfort, level of energy, level of mobility, and the like. The plurality of consumer-related information values may be positioned on the base label 100 such that when the top label 300 is rotated to a position where the desired consumer-related information value is visible in the transparent window 1002, 1705, the proper dose is also visible in the transparent window 1002, 1705.

In addition to the dispensing of liquids or solids as described above, the label measurement system may be used with containers 1405 of mixtures of liquids and solids, such as solids dissolved in liquids and solids dispersed in a liquid.

The top label 300 may comprise a dual ply (or multi-ply) construction in which a ply in contact with the base label 100 is a material selected for low sliding friction characteristics. The low sliding friction characteristics may enhance the ease of rotating and sliding the top label 300 about the base label 100. In various embodiments, the top label 300 ply in contact with the base label 100 may be coated with a substance to impart the low sliding friction characteristics.

Figure 31:
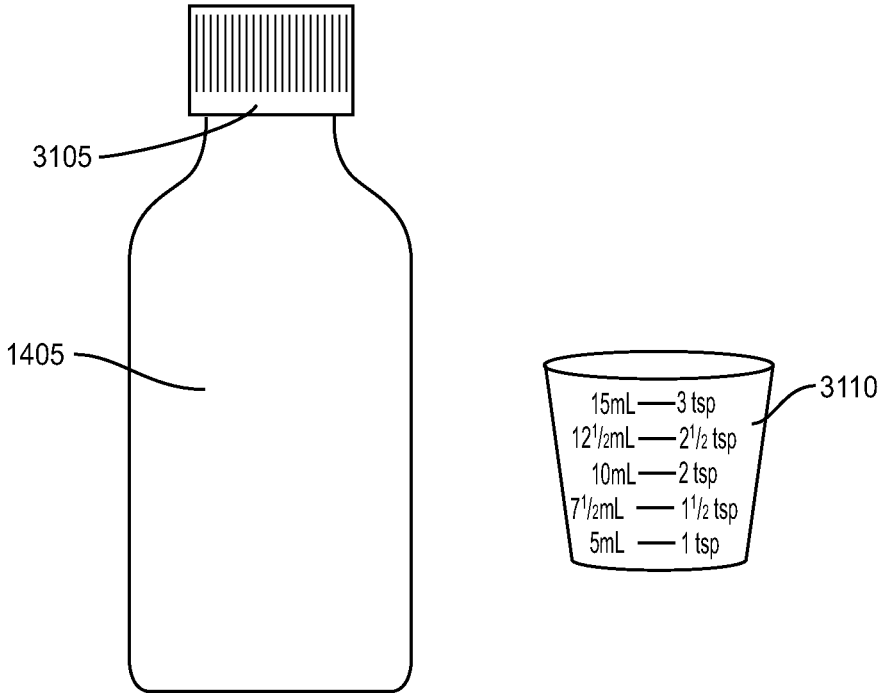
FIG. 31 is a front view of container and a second container according to various embodiments.
Figure 32:
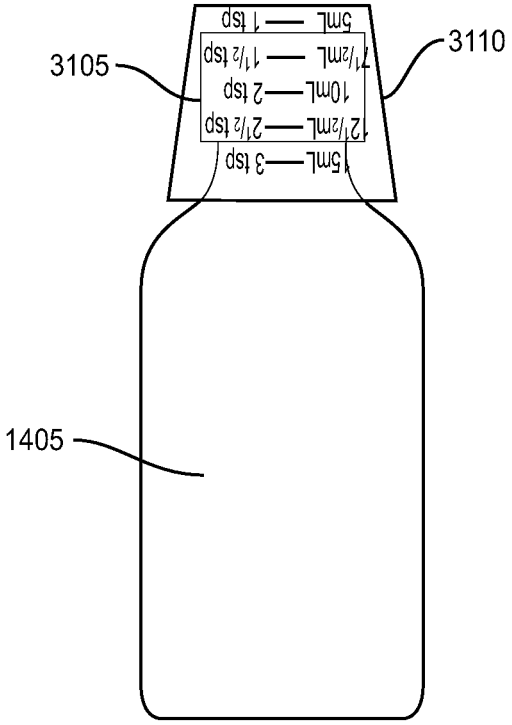
FIG. 32 is a front view of a container and a second container according to various embodiments.

FIG. 31 illustrates various embodiments of the container 1405 with a cap 3105 for a liquid medication. The manufacturer of the medication may additionally provide a second container which may be used as a dosing device along with the medication, such as a measuring cup 3110. The measuring cup 3110 may be sized to fit over a cap or closure device 3105 as illustrated in FIG. 32 for efficient packaging. While providing the measuring cup 3110 may be advantageous for the consumer, certain challenges are presented for the manufacturer, such as reliably coupling the measuring cup 3110 to the container 1405 such that tampering of the measuring cup 3110 or the container 1405 is evident and that the measuring cup 3110 remains relatively protected from dirt and debris. Various embodiments of the label system described herein may provide solutions to these problems, as well as providing the manufacturer with expanded labeling space to present information to the consumer without resorting to separate inserts, leaflets, or other packaging.

Figure 33:
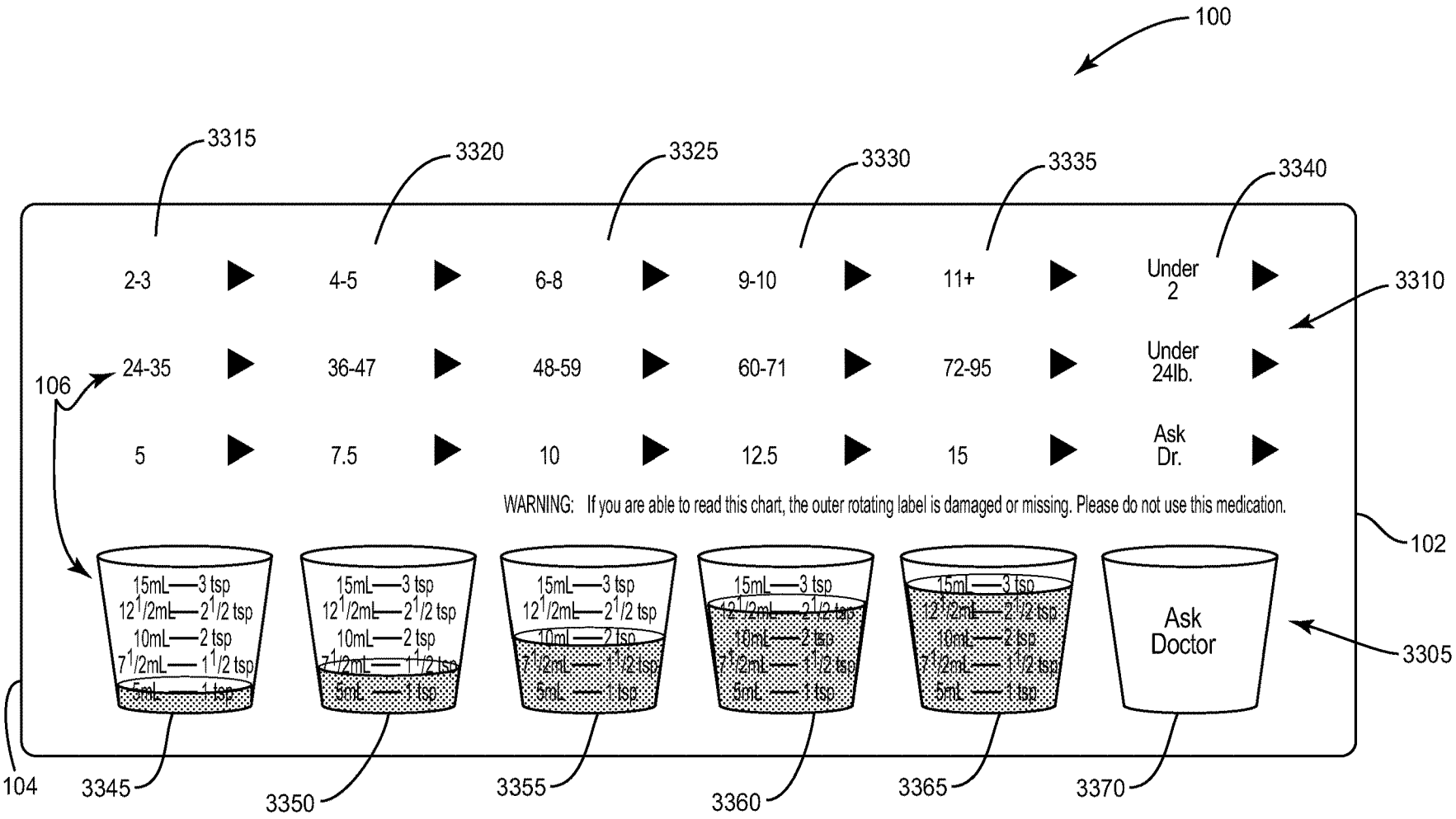
FIG. 33 is a front view of a base label according to various embodiments.
Figure 35:
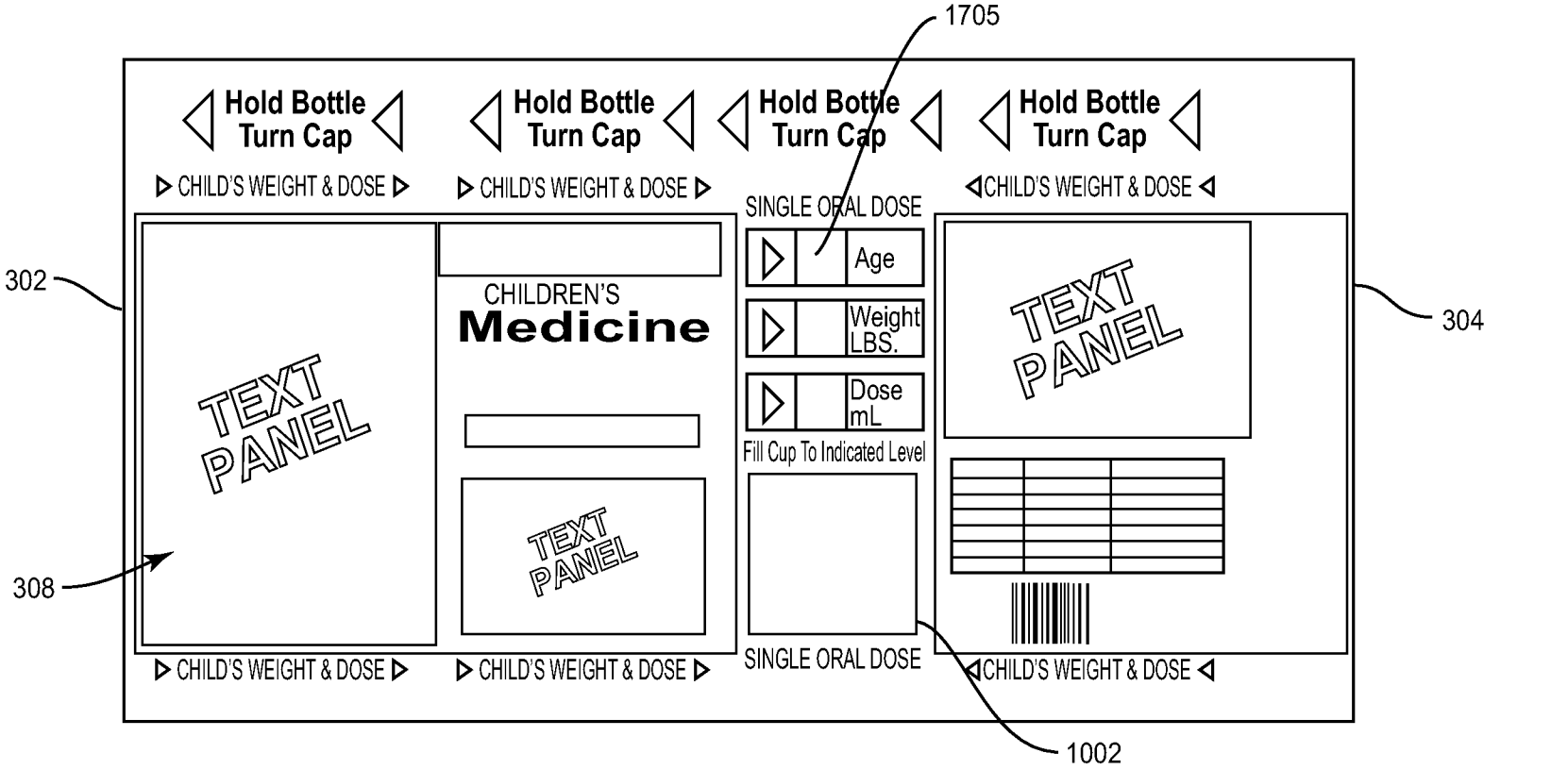
FIG. 35 is a front view of a top label according to various embodiments.

FIGS. 33 and 35 illustrate a base label 100 and a top label 300, respectively, that may comprise a label measurement system for a container, such as a medication container 1405 according to various embodiments in which the top label 300 comprises a shrink label. The base label indicia 106 may comprise a plurality of sets of printed measurement information in graphical (or pictorial) form 3305 or numerical form 3310. Although both the graphical form 3305 and numerical form 3310 of the measurement information are shown in FIG. 33, various embodiments may include only one of the graphical form 3305 or numerical form 3310.

The numerical form 3310 of the measurement information may comprise a plurality of individual groups of numerical measurements 3315-3340. In various embodiments, the individual groups of numerical measurements 3315-3340 may comprise information as described above about the consumer of the medication to determine the correct dosage, such as age, weight, height, body temperature, blood pressure, blood glucose level, level of pain or discomfort, level of mobility, gender, and the like. The age and weight may be particularly important for determining the correct dosage for a child. Proper dosages of many medications, particularly ones for children, are based on the weight of the child. However, physical development among individual children can vary widely, such that although an average weight of a four year old child is 40 pounds, it is not uncommon for a four year old to weigh 30 or even 50 pounds. Thus, a dosage based on an "average" four year old child of 40 pounds may be 33% too high for a four year old weighing 30 pounds, or 20% too low for the 50 pound four year old. Severe medical complications could result in either case due to improper dosage. Therefore, it is imperative that a caregiver be able to not only determine dosage by age, but also to be able to determine what weight of the child corresponds to that dosage. In this way, the caregiver can double check that the proper dosage is being administered, at least be aware that a discrepancy in dosage may exist so that a medical professional may be contacted.

Each individual group of numerical measurements 3315-3340 may comprise a plurality of rows of information. As illustrated in FIG. 33, a first row of information may list the age of the consumer (2-3, 4-5, etc.), a second row may list the weight of the consumer (24-35, 36-47, etc.), and a third row may list the dosage (5, 7.5, etc.) corresponding to the age in the first row or the weight in the second row. Thus, for example as illustrated in FIG. 33, the proper dosage for a consumer age 2-3 or weighing 24-35 pounds would be 5 mL. Each successive individual group of numerical measurements 3315-3340 may indicate progressively larger doses in equal increments (as illustrated in FIG. 33), or may vary in another manner, such as according to a geometric progression, arithmetic progression, harmonic progression, logarithmic function, or the like.

The graphical form 3305 of the measurement information may comprise a plurality of illustrations of a dosing device 3345-3370, each dosing device filled to a level corresponding to the dosage in the individual groups of numerical measurements 3315-3340 immediately above. In various embodiments, the amount each illustration of a dosing device 3345-3370 is shown to be filled may vary in a manner similar to the variation between the dosage listed in the numerical form 3310 of the measurement information (such as linear, geometric, arithmetic, etc.).

The groups of numerical measurements 3315-3340 and the illustrations of a dosing device 3345-3370 may be positioned on the base label 100 such that each numerical measurement 3315-3340 is aligned with an illustration of a dosing device 3345-3370, thus forming a set of measurement information. For example, the embodiments of FIG. 33 illustrate a vertical alignment between the groups of numerical measurements 3315-3340 and the illustrations of a dosing device 3345-3370. In this example, numerical measurement 3315 is aligned with illustration of a dosing device 3345 forming a first set of measurement information, numerical measurement 3320 is aligned with illustration of a dosing device 3350 forming a second set of measurement information, and so on. In various embodiments, the alignment between the groups of numerical measurements 3315-3340 and the illustrations of a dosing device 3345-3370 may be horizontal, diagonal, helical, or any other alignment known in the art.

Figure 34:
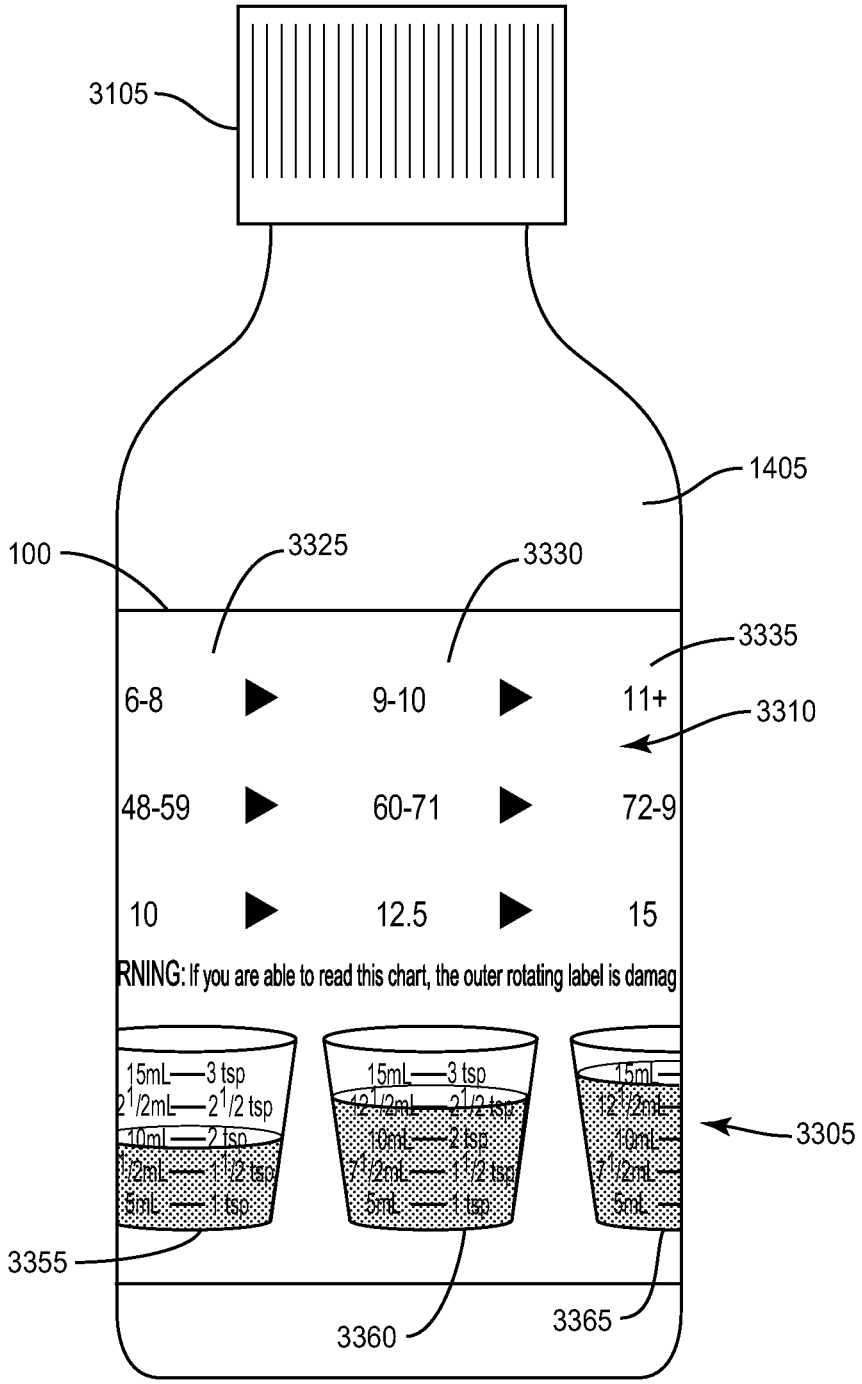
FIG. 34 illustrates an exemplary base label secured about a container according to various embodiments.

FIG. 34 illustrates the base label 100 positioned on the container 1405 according to various embodiments. As discussed above, the base label 100 may comprise sets of measurement information in graphical form 3305 and numerical form 3310 printed on the front surface 108 such that the measurement information 3305, 3310 at least partially encircle the container 1405.

As illustrated in FIG. 35, various embodiments of the top label 300 may comprise indicia 308 relaying product-related information, safety-related information, manufacturer-related information, and the like. In various embodiments, the top label 300 may contain transparent window 1002 as described previously (see FIG. 10). The top label 300 may also contain second transparent window 1705 as described previously (see FIG. 17). The second transparent window 1705 may comprise opaque markings thereon. The opaque markings may comprise descriptions for the individual groups of numerical measurements 3315-3340 visible in the second transparent window 1705. For example, as shown in FIG. 35, the opaque markings may indicate age, weight, and dose. In various embodiments, each of the first and second transparent windows 1002, 1705 may be divided into two or more transparent windows. For example, FIG. 35 illustrates the second transparent window 1705 divided into three separate transparent windows, one to display the age, one to display the weight, and one to display the dose.

The top label 300 in various embodiments may comprise a material that dimensionally shrinks when exposed to an energy source. Such a material, commonly known as "shrink wrap," may comprise a thermoplastic packaging film (or polymer film) manufactured from resins such as polyolefins or polyvinyl chlorides. The shrink wrap may also comprise, individually or in mixtures, ionomers, polyesters, polystyrenes, and polyvinylidene chlorides, among others. The shrink wrap material may comprise a monolayer or a multilayer construction. The energy source may be heat provided by a source such as hot air or hot water stream, and may include irradiation when cross-linking of the resin is desired. In various embodiments, the base label 100 may also comprise a shrink wrap material.

Figure 36:
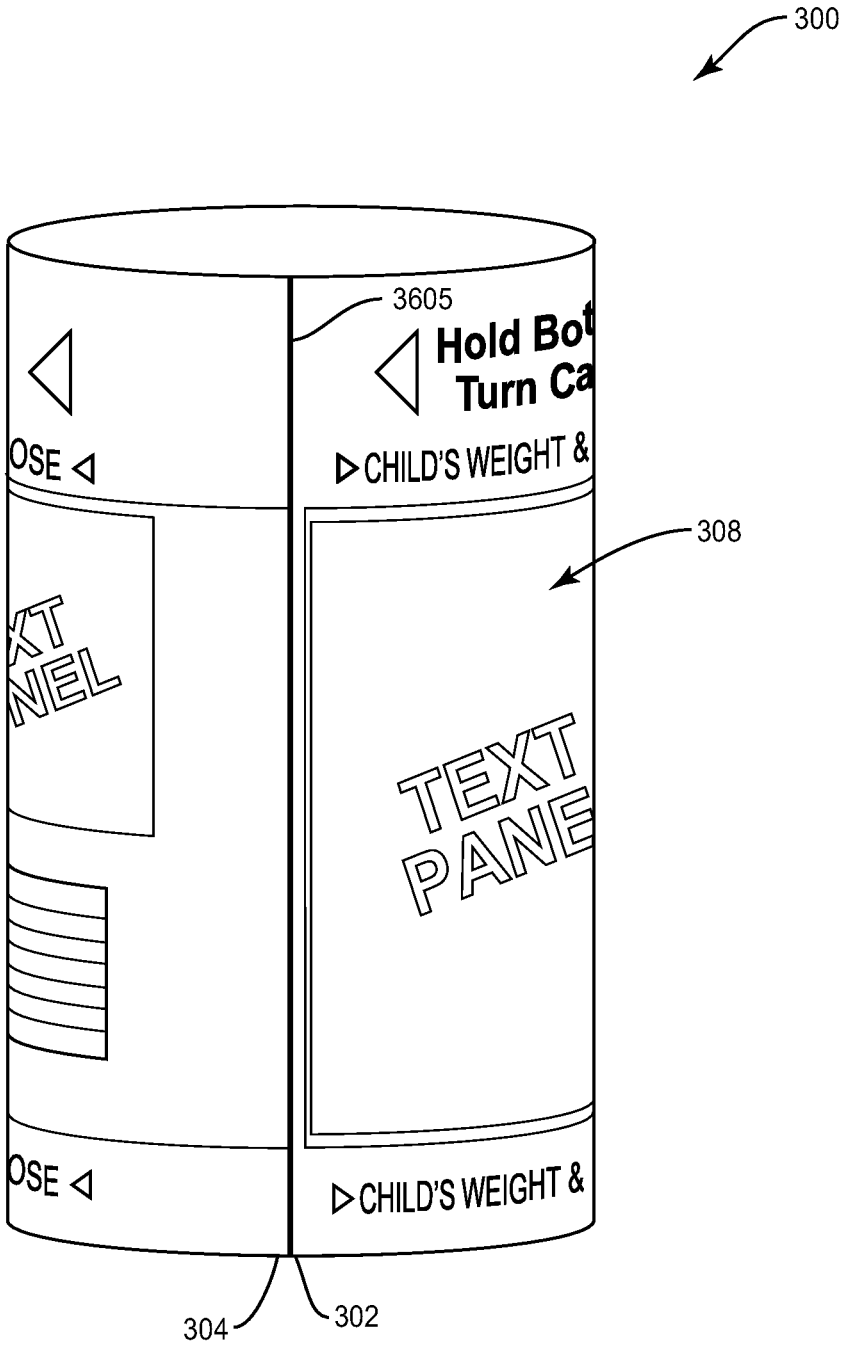
FIG. 36 is a front view of a top label formed into a cylindrical shape according to various embodiments.
Figure 37:
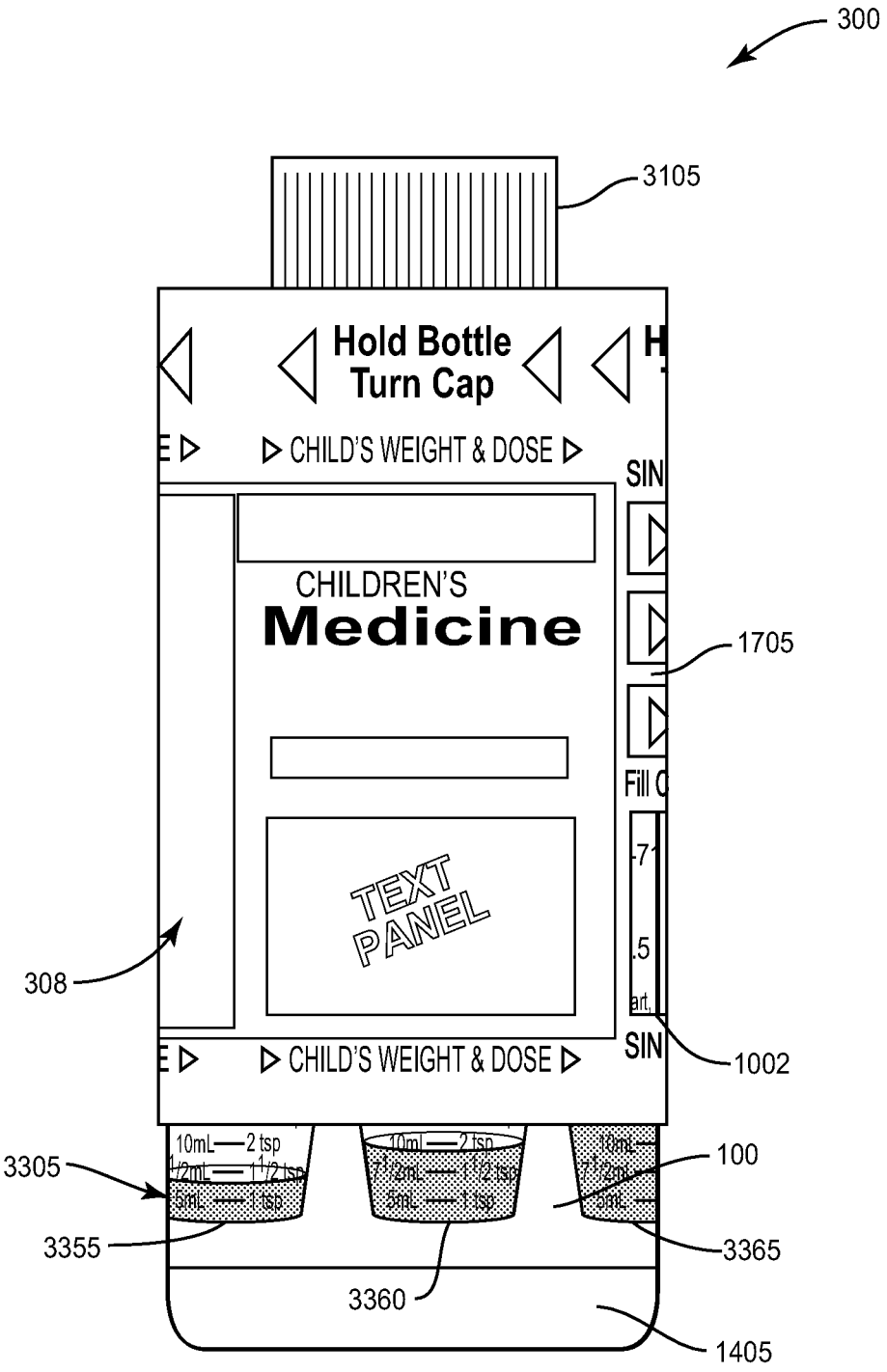
FIG. 37 illustrates the top label of FIG. 36 being positioned on a container according to various embodiments.
Figure 38:
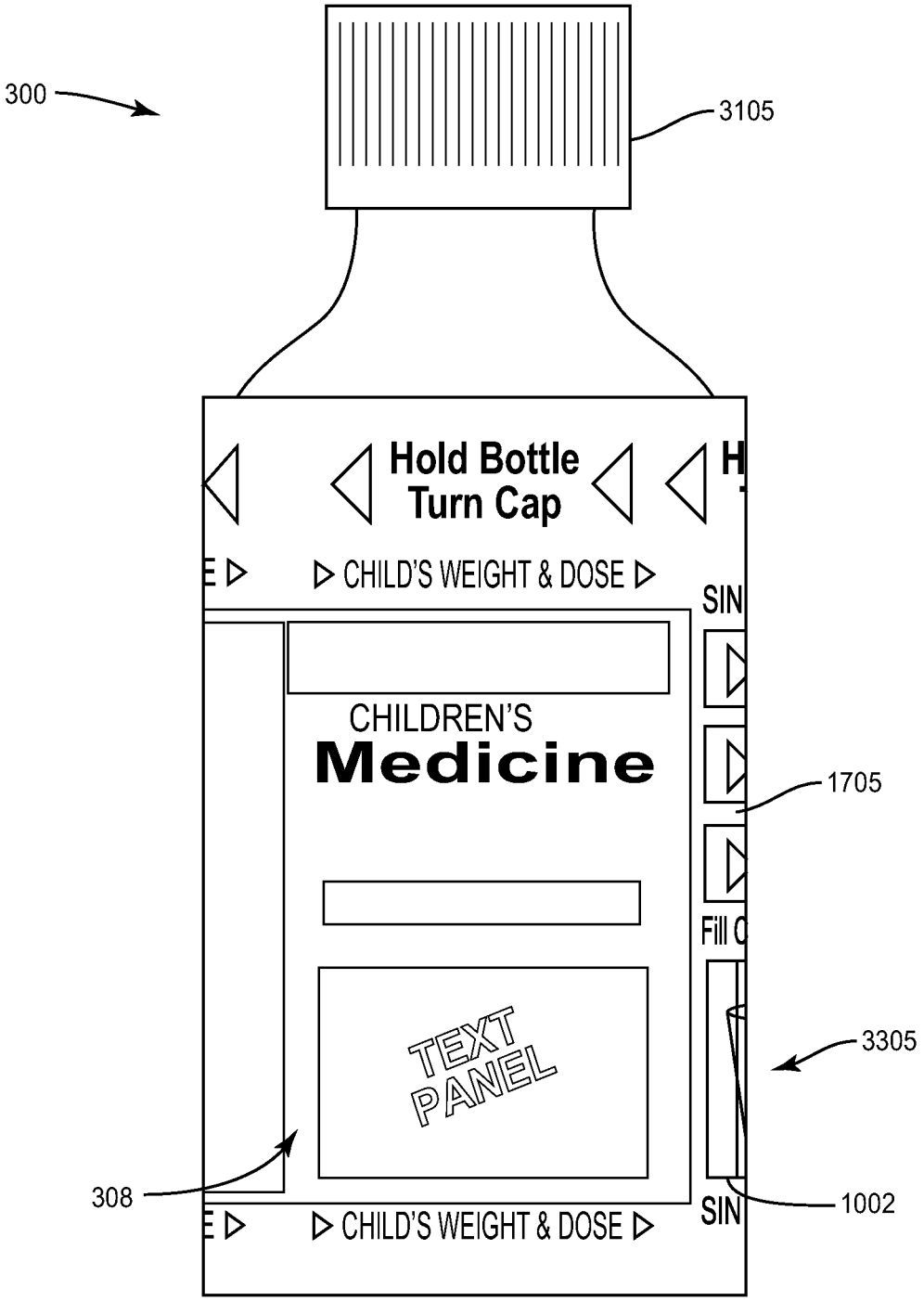
FIG. 38 illustrates the top label of FIG. 36 fully in place about a container according to various embodiments.
Figure 39:
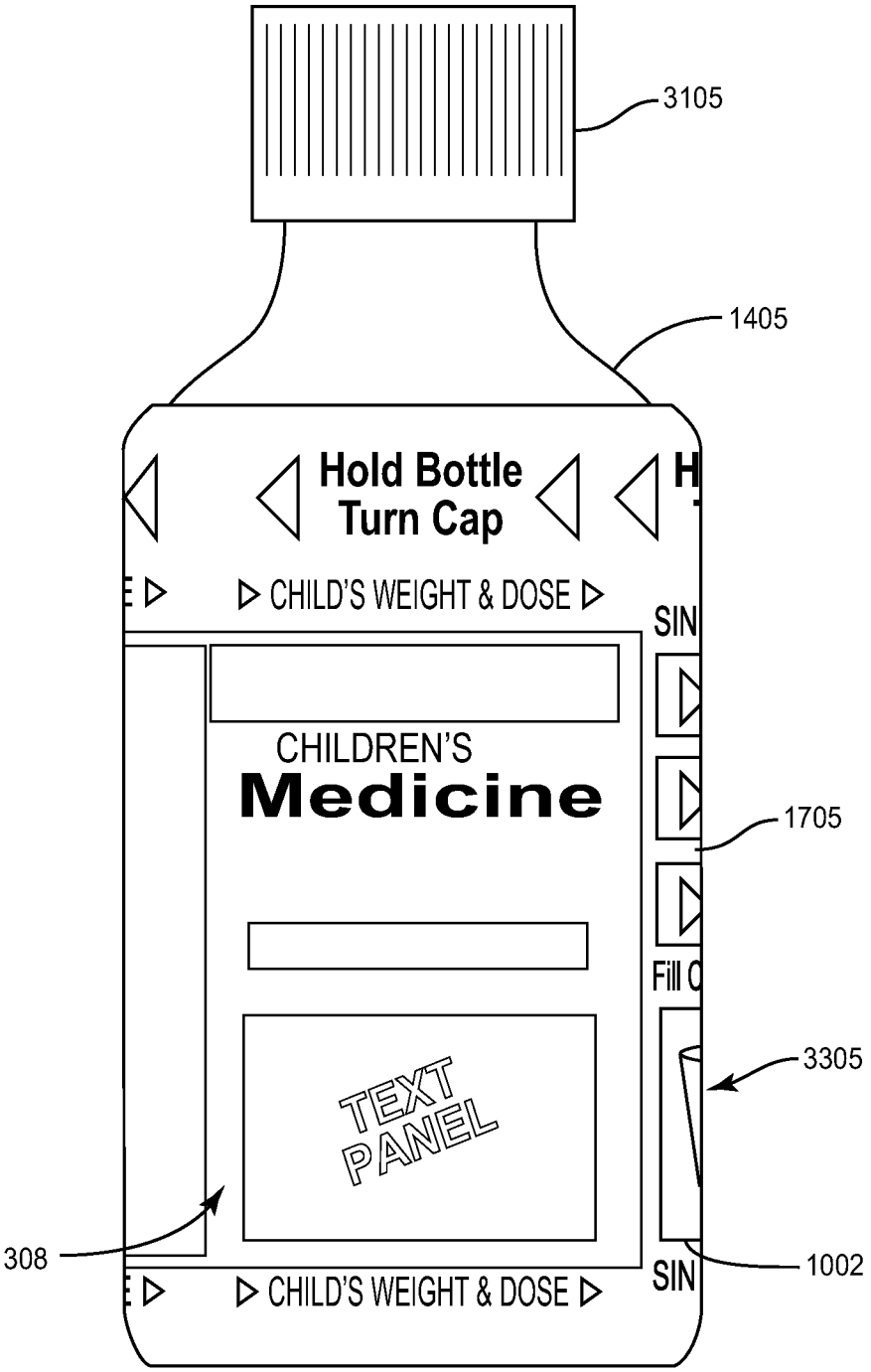
FIG. 39 illustrates a top label shrunk to conform to a container according to various embodiments.

In FIG. 36, the top label 300 may be formed into a cylindrical shape by coupling the leading edge 302 and the trailing edge 304 to form seam 3605. The cylindrical top label 300 may then be placed over the container 1405 as illustrated in FIGS. 37 and 38. The top label 300 may then be exposed to heat (or other energy source), causing the shrink wrap material to shrink and conform to the contours of the container 1405 illustrated in FIG. 39. In order to allow the top label 300 to rotate about the base label 100, the tension of the shrink wrap material after shrinking may be controlled so that the top label 300 conforms to the shape of the container 1405 but not so tightly that it cannot rotate. During the heating process, the tension may be controlled by varying the temperature to which the top label 300 is exposed such that the top label 300 shrinks but does not adhere to the container 1405 or the base label 100.

Figure 40:
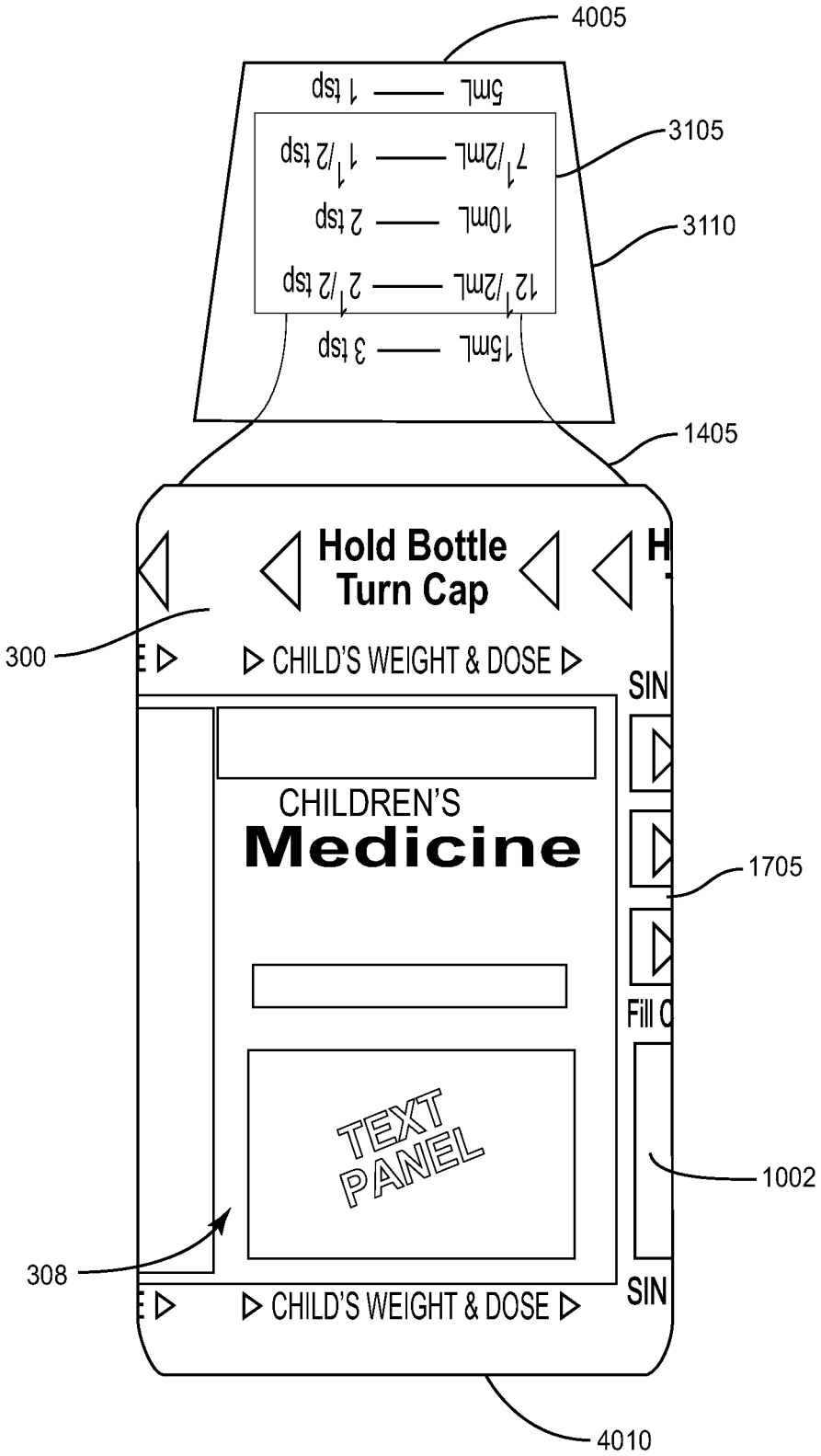
FIG. 40 illustrates a top label shrunk to conform to a container and a second container coupled to the container according to various embodiments.
Figure 41:
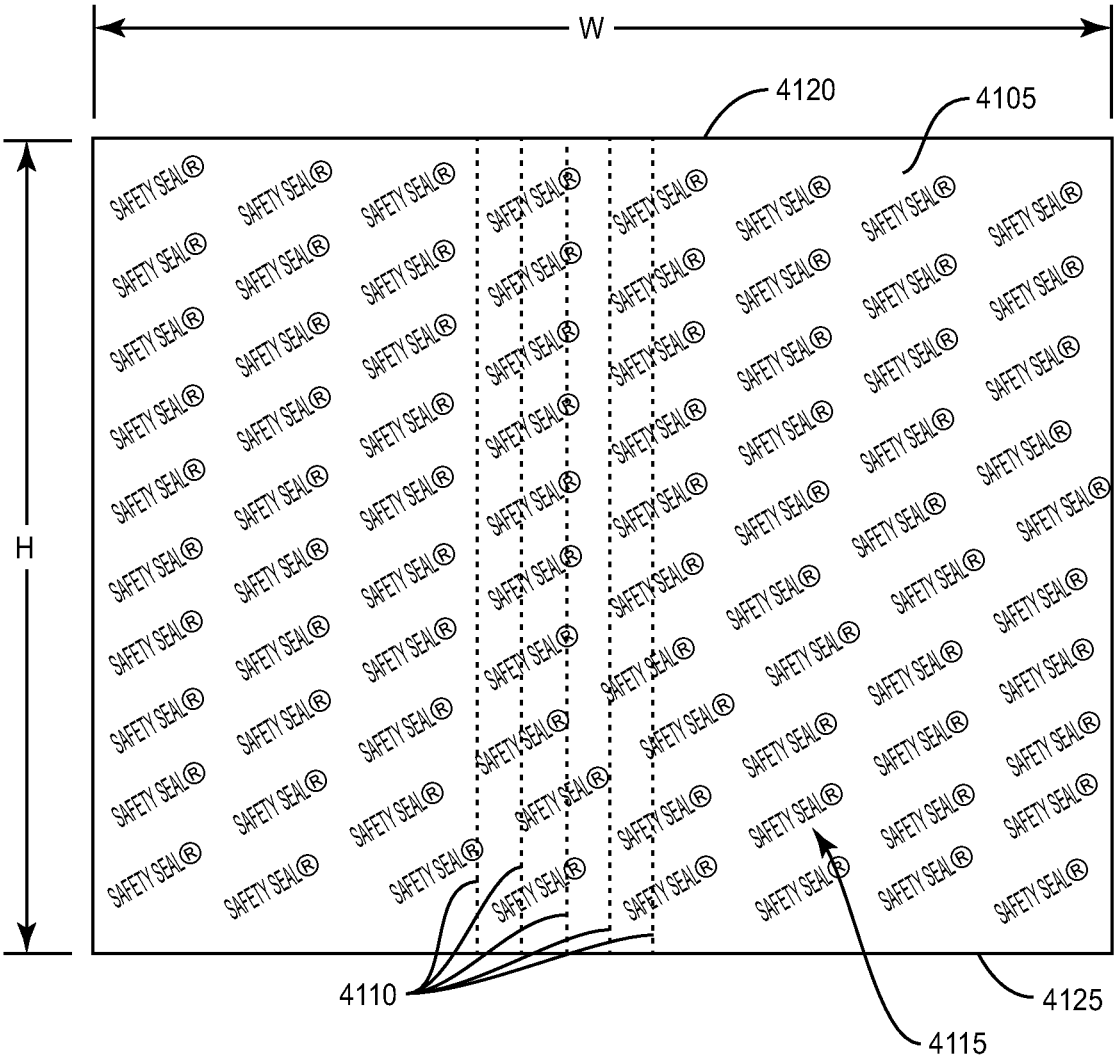
FIG. 41 is a front view of a sheet of tamper evident sleeve material according to various embodiments.

Referring now to FIG. 40, once the base label 100 and top shrink label 300 have been positioned on the container 1405, the measuring cup 3110 may be placed over the cap 3105 in preparation for a next packaging step. It may be desirable to securely couple the measuring cup 3110 to the container 1405, as well as to provide a tamper evident feature. Such results may be achieved by enclosing the container 1405 and measuring cup 3110 (or any other dispensing device) either entirely or partially with a sleeve comprising a polymer film shrink wrap material as described previously for the top label 300. FIG. 41 illustrates a sheet of tamper evident sleeve material 4105. The sheet 4105 may have a height H slightly greater than a height of the container 1405 and measuring cup 3110 combination of FIG. 40 such that when the sheet 4105 shrinks, a top edge 4120 of the sheet 4105 overlaps a bottom edge 4005 of the measuring cup 3110, and a bottom edge 4125 of the sheet 4105 overlaps a bottom edge 4010 of the container 1405. However, in certain embodiments the height H of the sheet 4105 may be less than the height of the container 1405 and measuring cup 3110 combination, but sufficient to enclose at least a portion of the container 1405 and a portion of the measuring cup 3110. Additionally, the sheet may have a width W large enough such that when the sheet 4105 is formed into a cylinder, the cylinder will readily slide over the container 1405 and measuring cup 3110 combination as describe below with reference to FIGS. 42 and 43.

FIG. 41 also illustrates one or more perforations 4110 generally running the entire height H of the sheet 4105. The perforations 4110 may facilitate removal of the sheet 4105 from the container 1405 and measuring cup 3110 combination, as well as comprise a tamper evident feature as will be described below. Additionally, in various embodiments the sheet 4105 may comprise essentially transparent polymer film shrink wrap material. In order to make the presence of the sheet 4105 readily apparent to the consumer, identification indicia 4115 may be printer on the sheet 4105, such as the "SAFETY SEAL" wording shown in FIG. 41.

Figure 42:
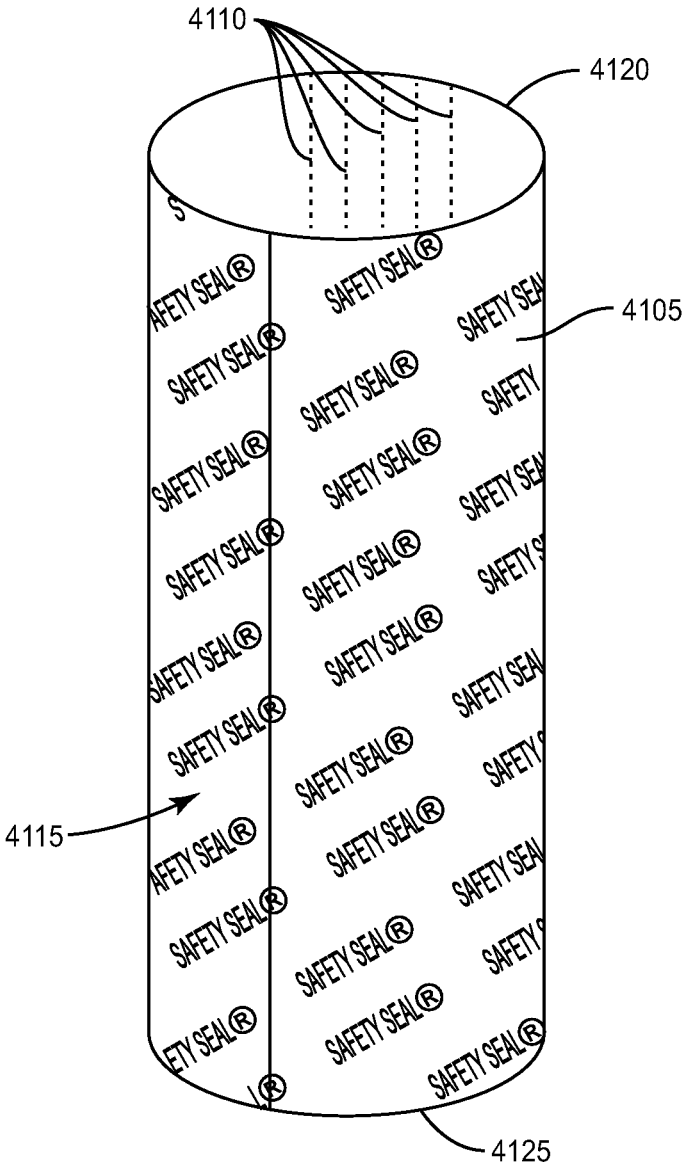
FIG. 42 is a front view of a sheet of tamper evident sleeve material formed into a cylindrical shape according to various embodiments.
Figure 43:
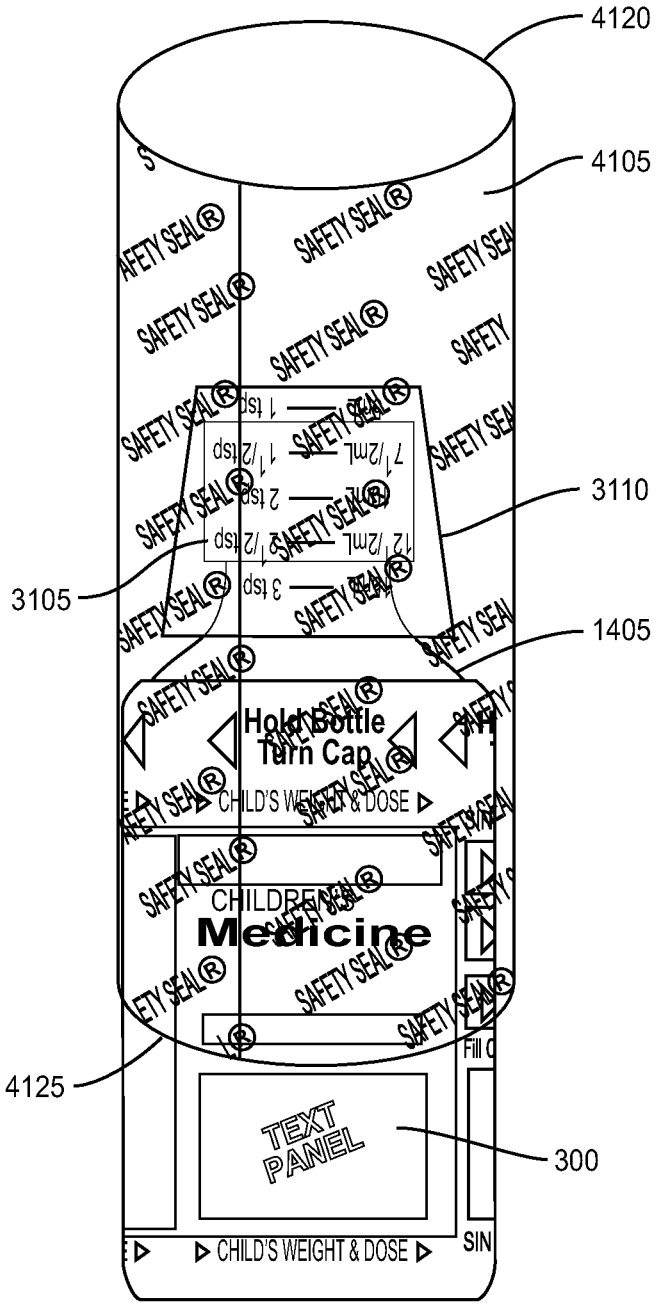
FIG. 43 illustrates the sleeve of FIG. 42 being positioned in place about a container according to various embodiments.
Figure 44:
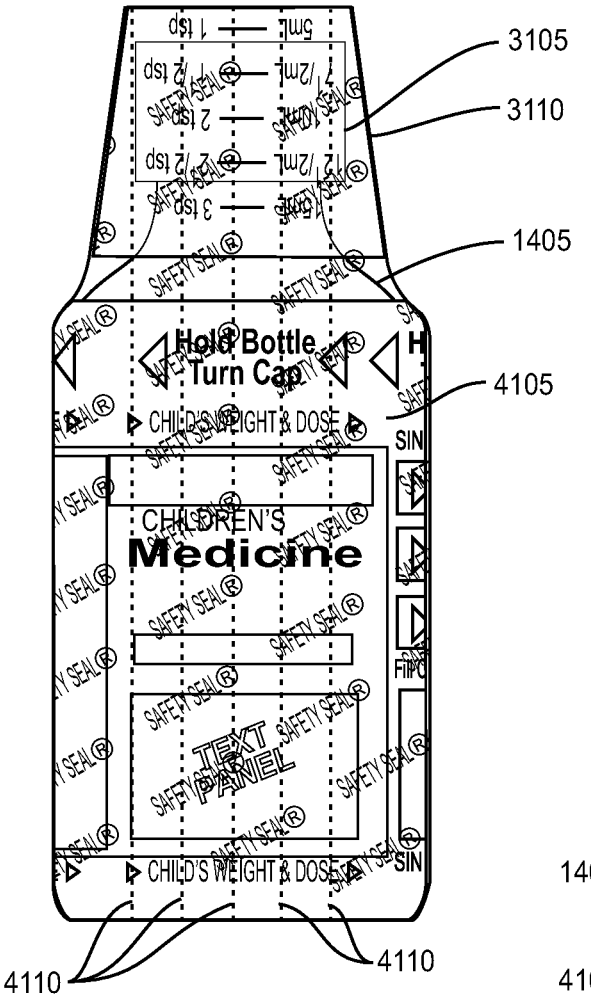
FIG. 44 illustrates the sleeve of FIG. 42 fully in place about a container according to various embodiments.

Referring now to FIGS. 42 through 44, application of the sheet 4105 to the container 1405 and measuring cup 3110 will be described. First, the sheet 4105 may be formed into a cylindrical shape (similar to the top label 300 as described previously) as shown in FIG. 42. The cylindrical sheet 4105 may then be placed over the container 1405 and measuring cup 3110 combination as shown in FIG. 43. The sheet 4105 may then be exposed to an energy source, causing the sheet 4105 to shrink and conform to the container 1405 and measuring cup 3110 combination as illustrated in FIG. 44. As such, the shrunken sheet 4105 may enclose at least a portion of each of the container 1405, top label 300, and measuring cup 3110.

Figure 45:
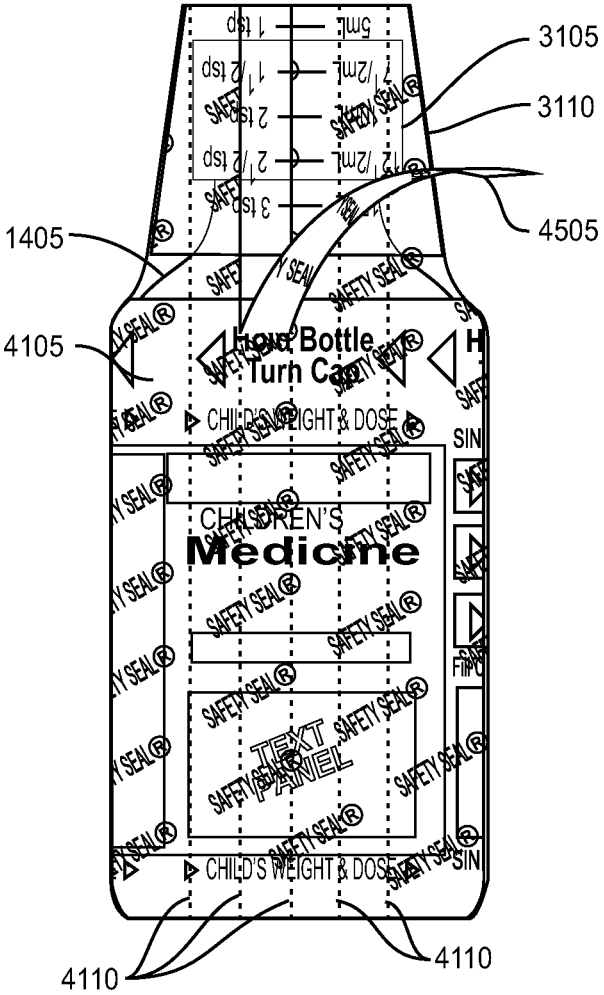
FIG. 45 is a front view of the sleeve of FIG. 44 shrunk to conform to a shape of a container and second container according to various embodiments.

FIG. 45 illustrates the functionality of the tamper evident perforations 4110 according to various embodiments. Once the sheet 4105 is shrunk to conform to the container 1405 and measuring cup 3110 combination, any attempt to remove the sleeve will be evident by tearing at the tamper evident perforations 4110. Continuing to tear along the perforations 4110 may create a strip 4505 of sheet 4105 material that makes it evident that someone tampered with the sheet 4105. For the consumer, tearing along the perforations 4110 and removing the strip 4505 (or not removing the strip 4505 and simply using the perforations 4110 to open the sheet 4105 so that it may be removed) allows the container 1405 and measuring cup 3110 to be accessed. The consumer may then remove the measuring cup 3110, rotate the top label 300 to determine the proper dose, then dispense that dose into the measuring cup 3110.

Figure 46:
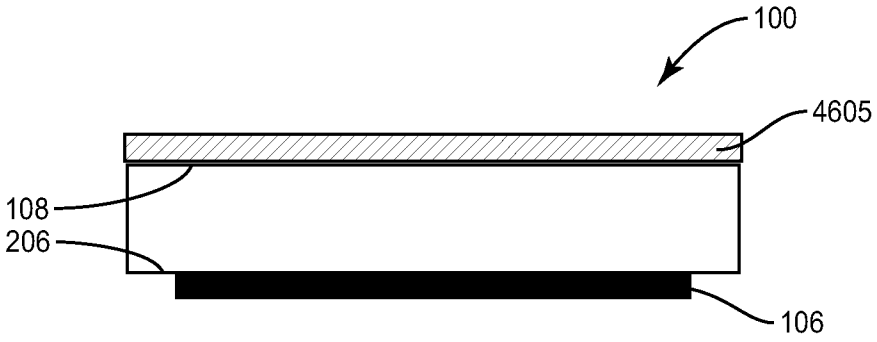
FIG. 46 is cross-sectional view of a base label according to various embodiments.
Figure 47:
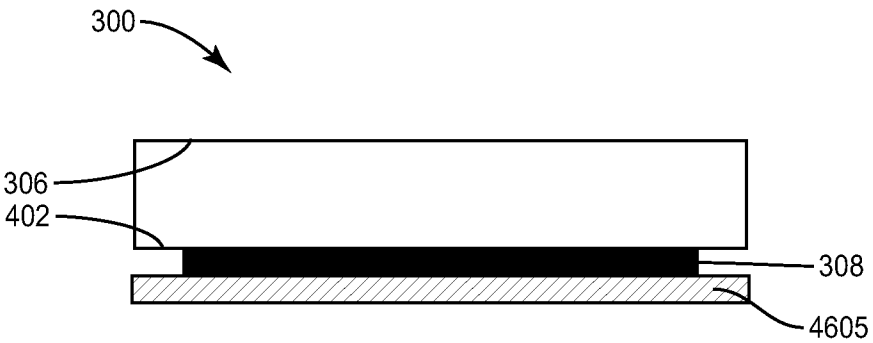
FIG. 47 is a cross-sectional view of a top label according to various embodiments.

Because the top label 300 comprises a shrinkable material, after shrinking there may be intimate contact between the top label back surface 402 and the base label front surface 108. This contact may create a strong frictional force that impedes rotation of the top label 300. Additionally, the frictional contact may abrade any printed information 308 on the top label 300 or printed information 106 on the base label 100. According to various embodiments as illustrated in FIG. 46, the base label 300 may comprise a transparent material which may allow the printed information 106 of the base label 300 to be printed on the base label back surface 208 such that printed information 106 is adjacent to the outer surface of the container 1405 and will be visible through the transparent material. The printed information 106 would be positioned away from the top label 300 such that the printed information 106 would not be abraded by the rotating top label 300. A friction reducing coating 4605 may be placed on the base label front surface 108 to reduce friction with the rotating top label 300. As illustrated by various embodiments in FIG. 47, the top label 300 may also comprise a transparent material. The printed information 308 of the top label 300 may be printed on the top label back surface 402 such that the printed information 308 is visible through the transparent material. Placing the printed information 308 on the top label back surface 402 protects the printed information 308 from abrasion due to handling. In addition, the friction reducing coating 4605 may be placed over the printed information 308 and the top label back surface 402 to protect the printed information 308 from abrasion when the top label 300 is rotated.

Figure 48:
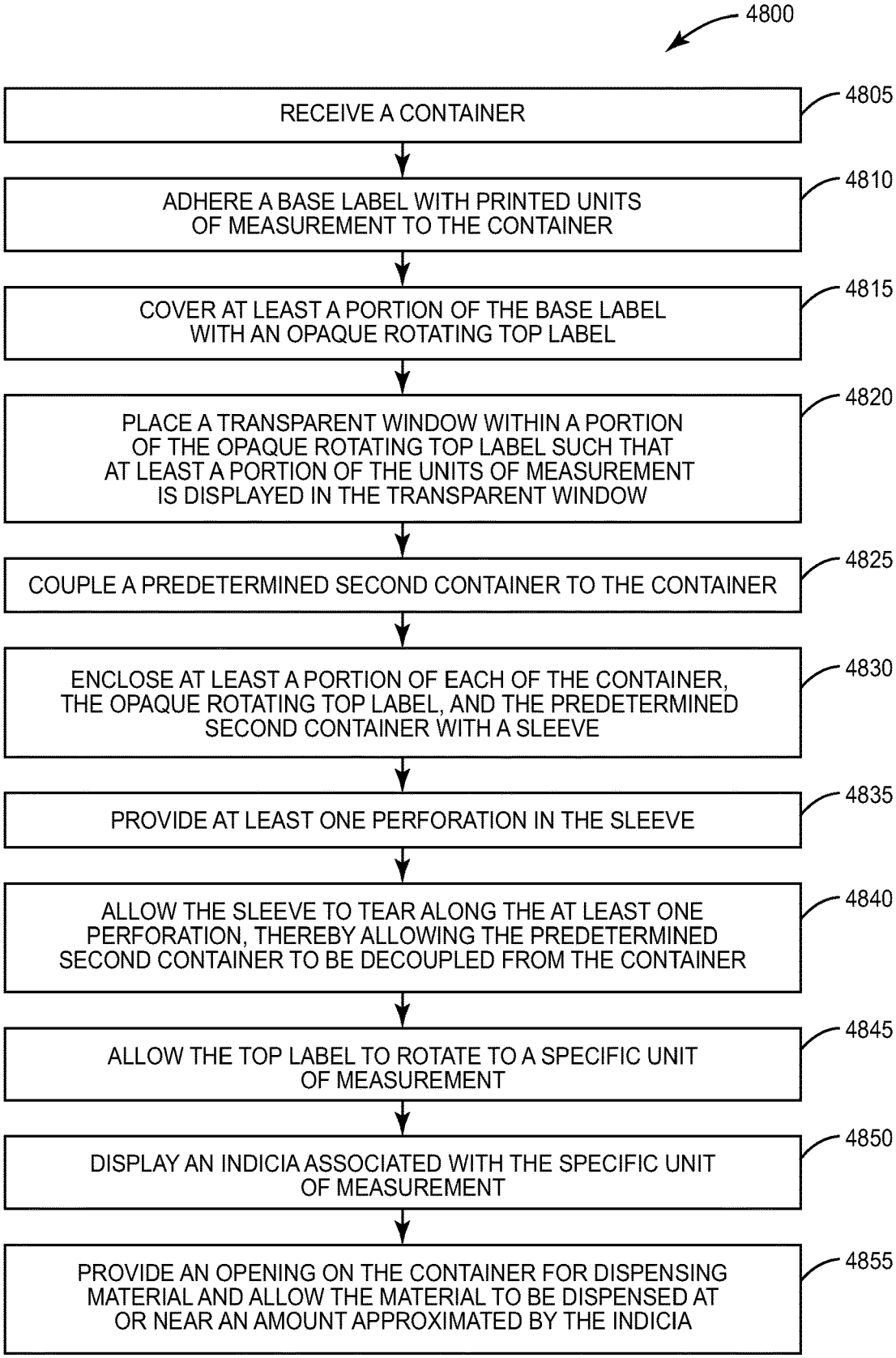
FIG. 48 is an exemplary flow diagram of a method for measuring material dispensed from a container according to various embodiments.

FIG. 48 illustrates a general flow chart of various embodiments of a method 4800 for measuring material dispensed from a container. A container may be received at step 4805, then a base label 100 may be applied to the container 1405 (step 4810). The base label 100 may have a back surface 206 and a front surface 108. A plurality of units of measurement 1265 may be printed on the front surface 108 of the base label 100. Referring, for example, to FIG. 12, the units of measurement may comprise specific units of measurement 1265 such as 1 mL, 2 mL, 3 mL, etc., or any other unit of measurement. At step 4815, at least a portion of the front surface 108 of the base label 100 may be covered with an opaque rotating top label 300. The opaque rotating top label may comprise a polymer film that shrinks when exposed to a light source. In various embodiments, the base label 100 may be coupled to the container 1405 while the top label 300 is free to rotate about the base label 100. A transparent window 1002 may be placed within a portion of the opaque rotating top label 300 at step 4820 such that at least a portion of the printed units of measurement 1265 is visible through the transparent window 1002. As the top label 100 is rotated about the base label 100, one or more of the other printed units of measurement may alternately be visible through the transparent window 1002. In various embodiments, more than one of the printed units of measurement 1265 may be visible through the transparent window 1002. In various other embodiments, the top label 300 may comprise at least a second transparent window 1705 such that multiple indicia may be visible simultaneously through the multiple transparent windows 1002, 1705. At step 4825, a predetermined second container may be coupled to the container 1405. In various embodiments, the predetermined second container may comprise a measuring device or cup 3110. The measuring cup 3110 may be inverted and placed over a closure device or cap 3105 of the container, such that the cap 3105 is positioned inside the inverted measuring cup 3110. At step 4830, a sleeve comprising a polymer film that shrinks when exposed to an energy source may enclose at least a portion of each of the container 1405, the opaque rotating top label 300, and the predetermined second container 3110. By way of example, the sleeve may comprise a sheet 4105 of polymer film shrink wrap. The sheet 4105 may be formed into a cylindrical shape and placed over the container 1405 and the predetermined second container 3110. The sheet 4105 may then be exposed to a heat source, causing the sheet to shrink and conform to the container 1405 and the predetermined second container 3110, thereby enclosing at least a portion of each of the container 1405, top label 300, and predetermined second container 3110. At least one perforation 4110 may be provided in the sleeve at step 4835, the at least one perforation 4110 generally running from top to bottom of the sheet 4105 as viewed when the sheet 4105 is enclosing the container 1405, although other orientations of the at least one perforation 4110 are contemplated. The sleeve may be allowed to tear along one of the perforations 4110 at step 4840, thereby allowing predetermined second container 3110 to be decoupled from the container 1405. The top label 300 may be allowed to rotate at step 4845 to a specific unit of measurement 1265 that may correspond to a desired dose. When the top label 300 is rotated to the desired specific unit of measurement 1265, an indicia associated with the specific unit of measurement 1265 may be displayed in the transparent window 1002 or the second transparent window 1705 (step 4850). Referring to FIG. 33, the indicia may comprise a graphical or pictorial representation 3305 of the dosage 1275. At step 4855, an opening may be provided in the container 1405 for dispensing material from the container 1405. The material may be dispensed from the container 1405 until an amount dispensed is at or near an amount approximated by the indicia 3305.

Figure 49:
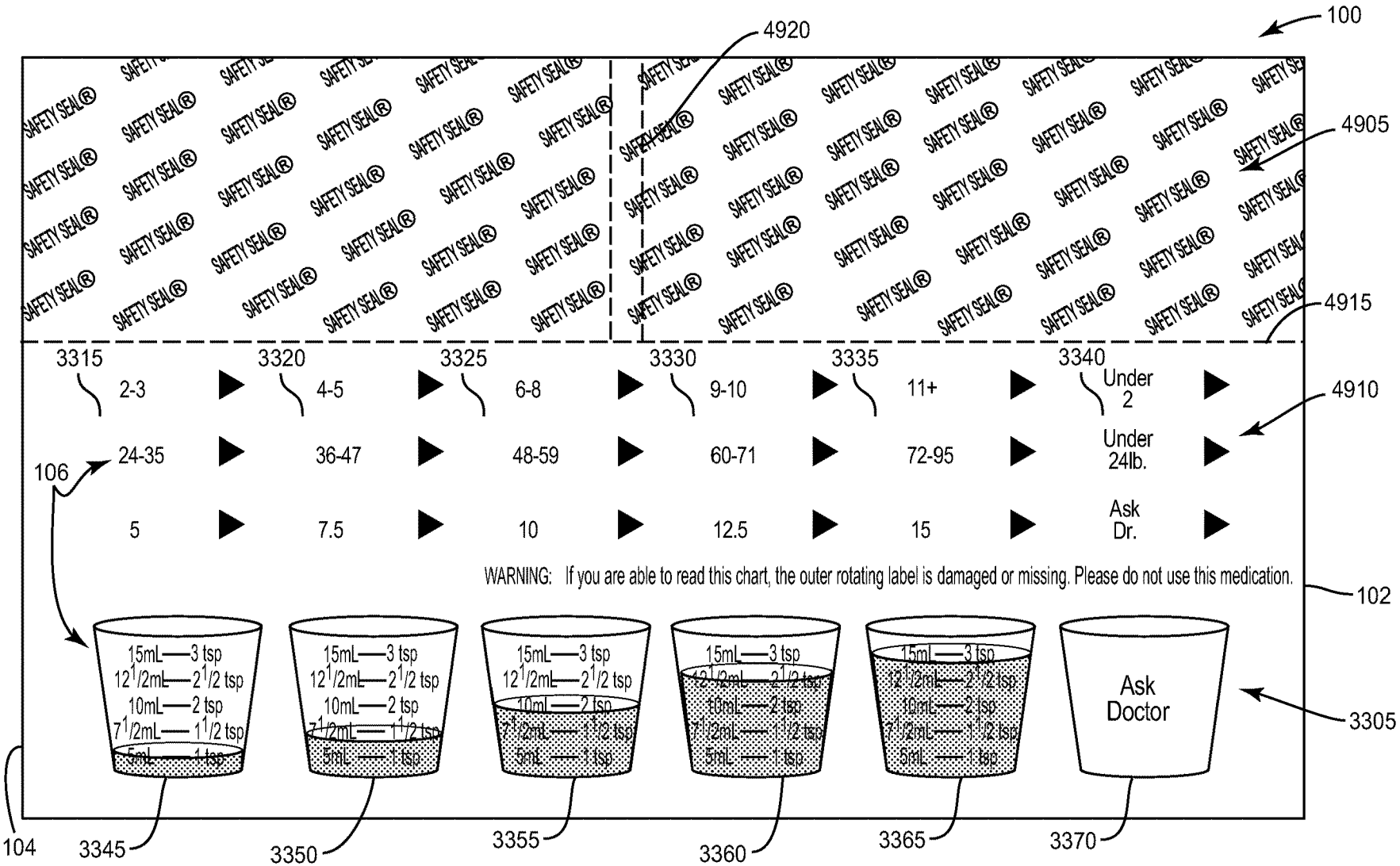
FIG. 49 illustrates a base label comprising a first section and a second section.

Various embodiments of the base label 100 as illustrated in FIG. 49 may comprise a first section 4905 and a second section 4910. The first section 4905 may be position about a top portion of the container 1405, which may include the cap 3105 and, if present, measuring cup 3110. The second section 4910 may be positioned around a bottom portion of the container 1405. The first section 4905 and the second section 4910 of the base label 100 may be coupled to one another by a first perforation 4915. The first perforation 4915 may allow the consumer to decouple the first section 4905 to reveal the cap 3105 and/or the measuring cup 3110. The first section 4905 may also comprise one or more tamper evident perforations 4920 that may intersect the first perforation 4915. In various embodiments, it may be difficult to remove the first section 4905 without tearing or separating the first section 4905 along the tamper evident perforation 4920. Thus, any tearing or separating of the tamper evident perforation 4920 may indicate previous tampering. In various embodiments, the base label 100 may comprise a heat shrinkable material as described previously for the top label 300.

Figure 50:
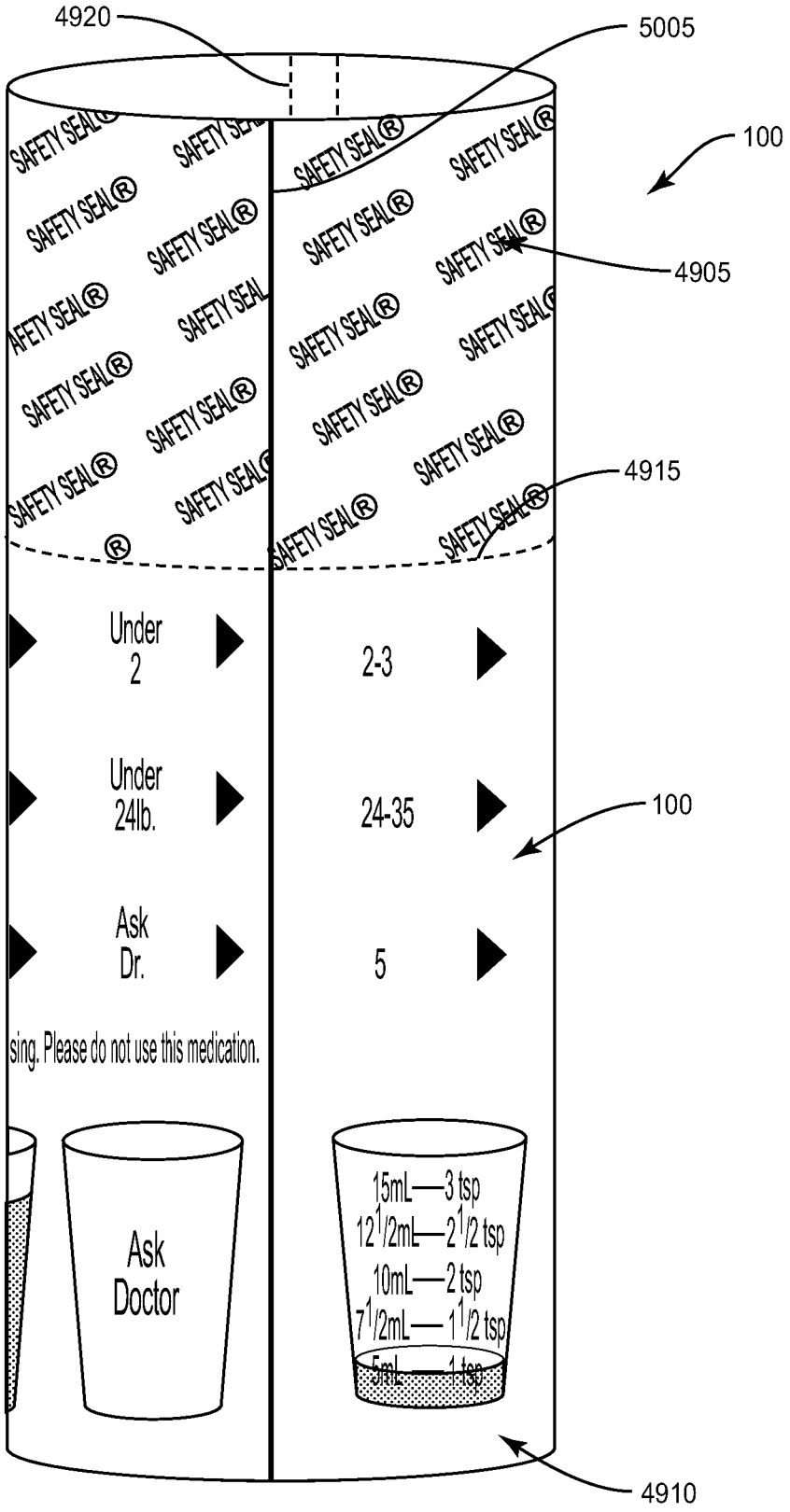
FIG. 50 illustrates the base label of FIG. 49 formed into a cylindrical shape.
Figure 51:
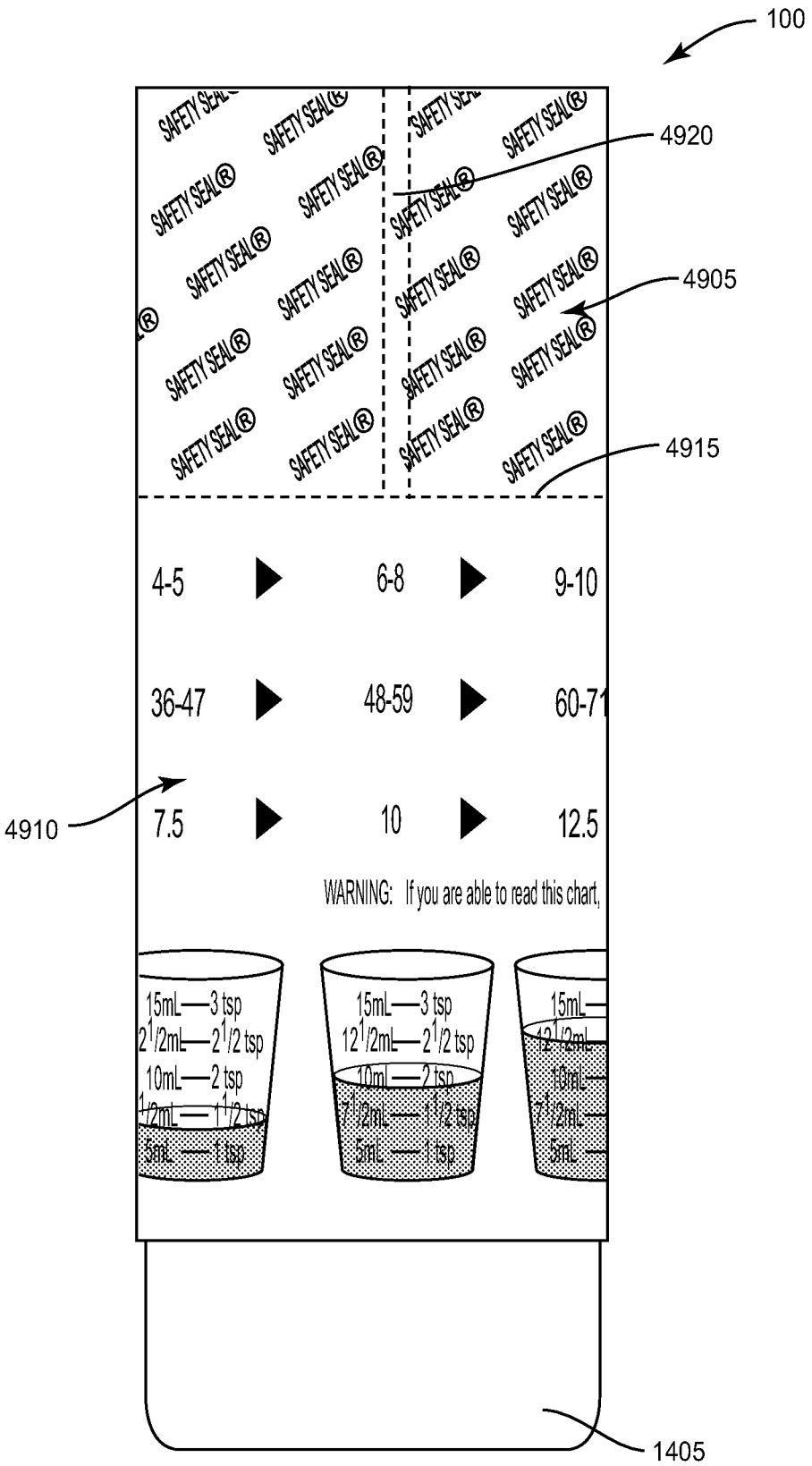
FIG. 51 illustrates the base label of FIG. 50 being placed over a container.
Figure 52:
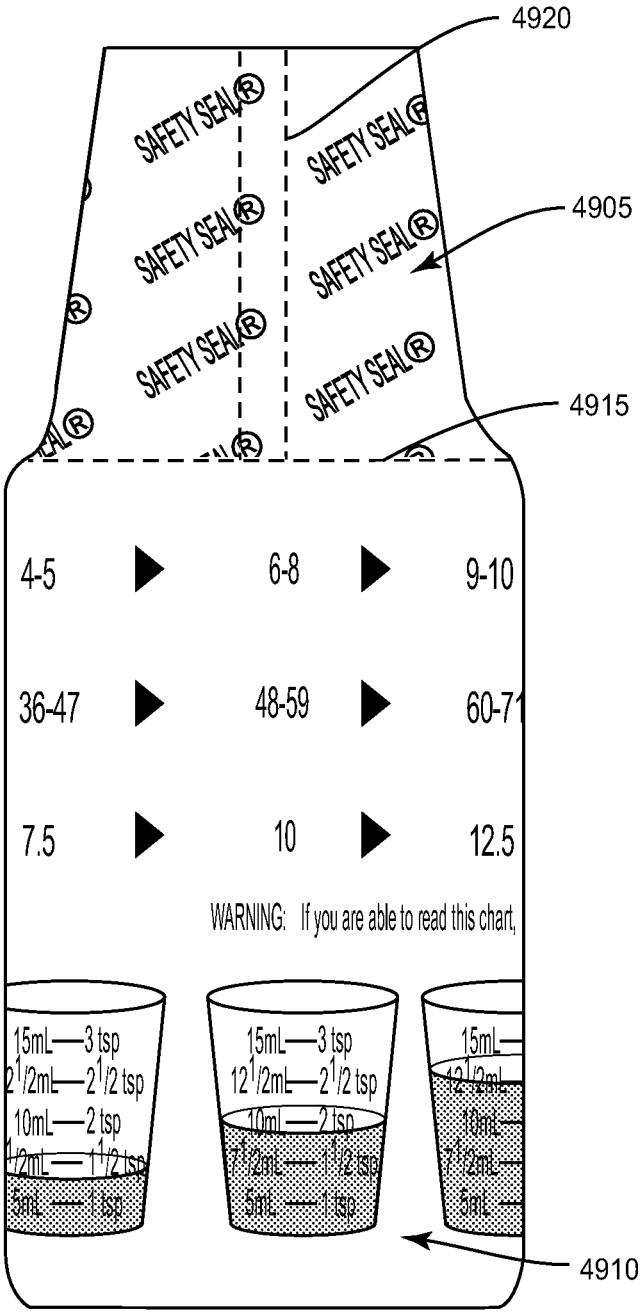
FIG. 52 illustrates the base label of FIG. 51 heat shrunk to conform to the container.

In FIG. 50, the base label 100 maybe formed into a cylindrical shape by coupling the leading edge 102 and the trailing edge 104 to form a seam 5005. The cylindrical base label 100 may then be placed over the container 1405 as illustrated in FIG. 51. The base label 100 may then be exposed to heat (or other energy source), causing the shrink wrap material to shrink and conform to the contours of the container 1405, cap 3105, and measuring cup 3110 if present as illustrated in FIG. 52. During the heating process, the tension shrink wrap material may be controlled by varying the temperature to which the base label 100 is exposed. The first section 4905 of the base label 100 may be exposed to a different temperature than the second section 49101 such that the tension of the first section 4905 is greater than the tension of the second section 4910. Alternatively, the first section 4905 and the second section 4910 may comprise different thermoplastic resins that shrink different amounts when exposed to the same temperature.

Figure 53:
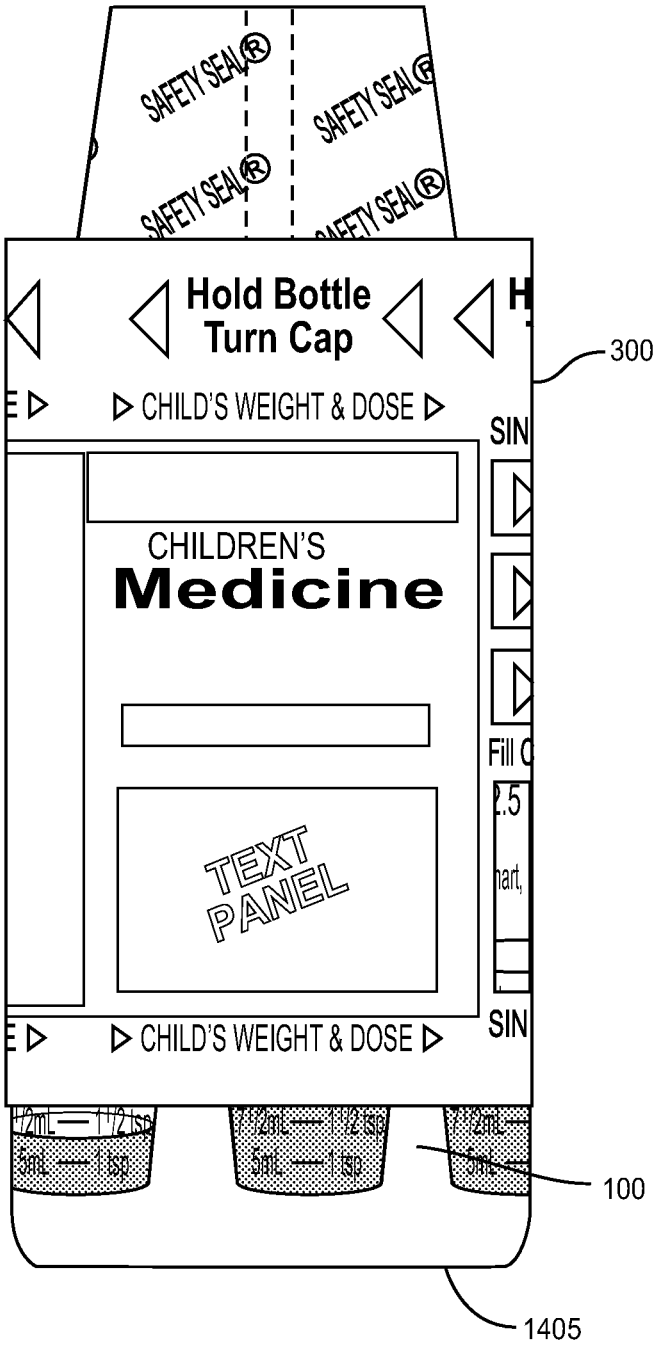
FIG. 53 illustrates a top label being placed over the container and base label of FIG. 52.
Figure 54:
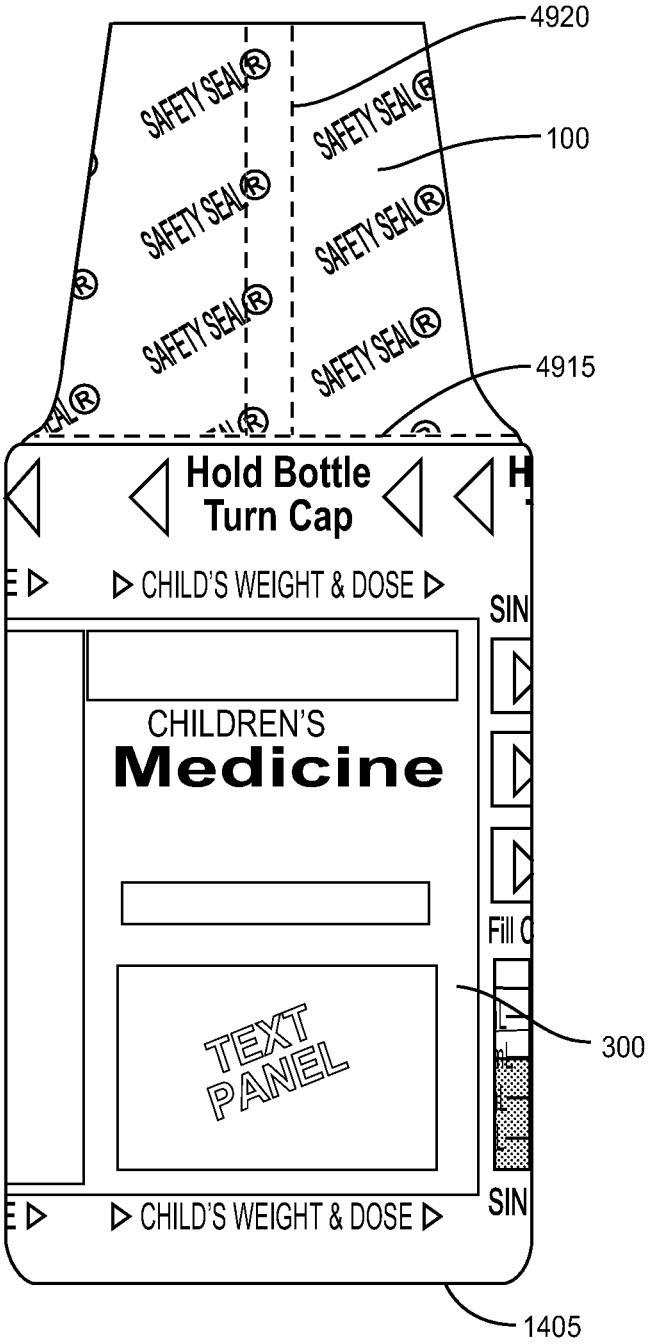
FIG. 54 illustrates the top label of FIG. 53 heat shrunk to conform to the container.

In FIG. 53, the top label 300 may also be formed into a cylindrical shape as described previously and positioned over the container 1405 in which the base label 100 has already been shrink wrapped into place as shown in FIG. 52. The top label 300 may then be exposed to a heat source so that the top label 300 conforms to the container 1405 as shown in FIG. 54. During the heating process, the tension of the top label 300 may be controlled by varying the temperature to which the top label 300 is exposed such that the top label 300 shrinks but does not adhere to the container 1405 or the base label 100, and is able to freely rotate.

Figure 55:
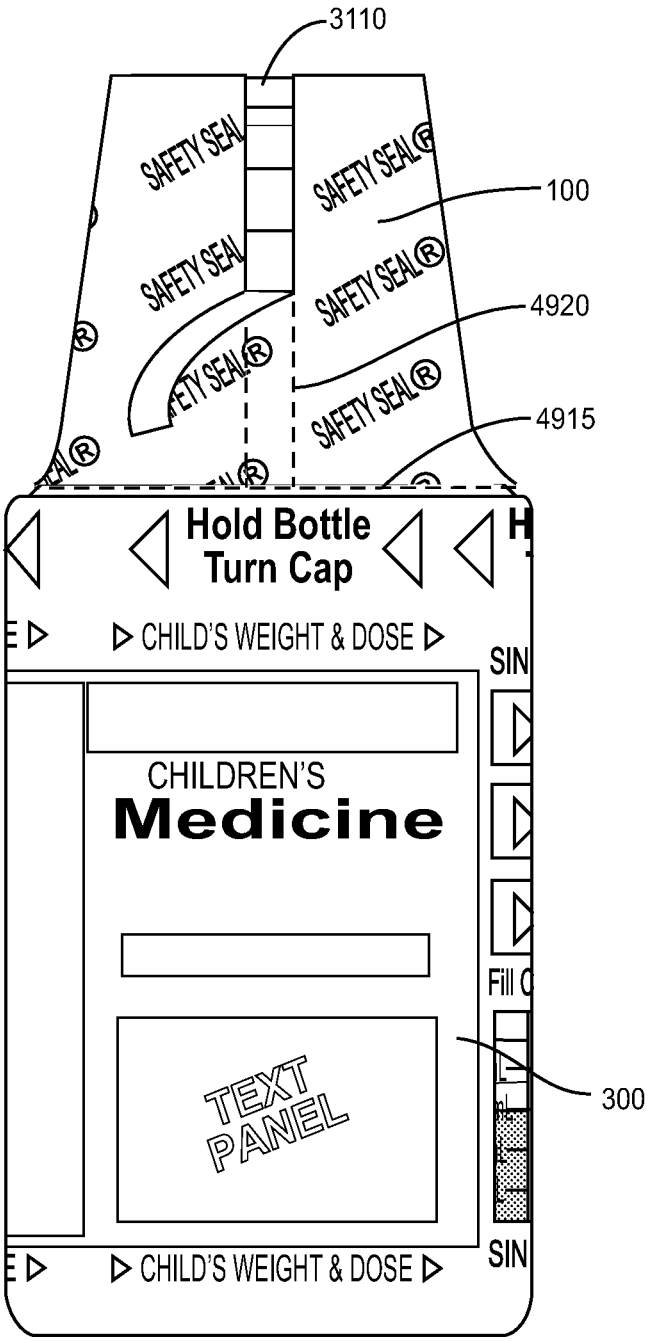
FIGS. 55 and 56 illustrate the functionality of a first perforation and a tamper evident perforation in the base label.
Figure 56:
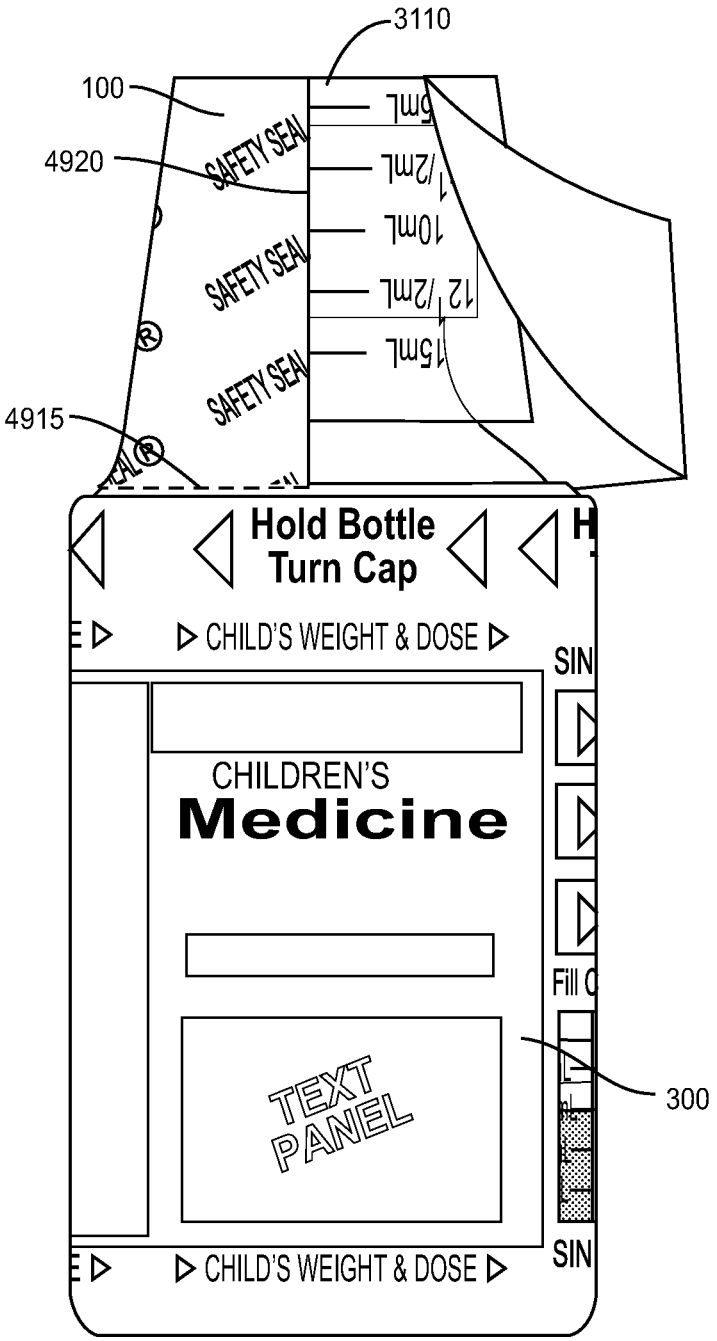

FIG. 55 illustrates the functionality of the tamper evident perforation 4920 according to various embodiments. Once the base label 100 is shrunk to conform to the container 1405, any attempt to remove the first section 4905 of the base label 100 will be evident by the tearing at the tamper evident perforation 4920. As the tearing along the tamper evident perforation 4920 continues, the tear may eventually reach the first perforation 4915, redirecting the tear along the first perforation 4915 as illustrated in FIG. 56. Continuing to tear along the first perforation 4915 around the circumference of the container 1405 may allow the first section 4905 of base label 100 to be decoupled from the second section 4910 of the base label 100, thereby exposing the measuring cup 3110 and the cap 3105. The measuring cup 3110 may then be removed from the cap 3105.

Referring again to FIG. 56, the top label 300 may also serve to prevent or to mitigate undesired tearing of the base label 100 that does not occur along the first perforation 4915 or the tamper evident perforation 4920. On occasion, when the user tears the first section 4905 of the base label 100 along the tamper evident perforation 4920, the base label 100 may continue to tear downwards rather than being redirected along the first perforation 4915. If this undesired tearing were allowed to continue, the entire base label 100 could tear and fall off of the container 1405. Such an outcome may render the label system unusable and may prevent use of the contents of the container 1405. However, because the top label 300 conforms tightly to the container 1405 over the base label 100, the top label 300 may serve to stop the undesired tearing and prevent further tearing beyond a top edge of the top label 300, thus preserving the integrity of the label system.

In various embodiments, all or a portion of the indicia 106 may be imprinted, embossed, or molded directly on an outer surface of the container 1405 in place of all or a portion of the base label 100. The imprinting or embossing may be carried out using any printing or image transfer method known in the art. In various embodiments, the printing or image transfer method may be an offset process in which an image is transferred from a plate to an intermediate carrier, then to the outer surface of the container 1405. The offset process may also involve lithographic techniques. Other printing or image transfer methods may comprise, for example, flexography, pad printing, relief printing, rotogravure, screen printing, and electrophotography. According to various embodiments, the indicia 106 may be digitally printed on the outer surface of the container 1405 using, for example, inkjet printing or laser printing. Chemical printing technologies, such as blueprint or diazo print may also be used in various embodiments.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A rotating shrink label measuring system for a container, comprising:

a first container;

a base label having a front surface, the front surface having measurement information printed thereon, wherein the measurement information includes a plurality of specific measurements, and a graphical representation corresponding to each specific measurement;

a rotating top label covering at least a portion of the front surface of the base label, the top label comprising a front surface and a back surface, wherein the back surface of the top label has printed information;

a transparent window located on the top label, wherein the transparent window is configured to display at least a portion of the measurement information printed on the base label;

wherein rotation of the rotating top label causes the transparent window to display a particular one of the plurality of specific measurements and its corresponding graphical representation;

a predetermined second container; and said predetermined second container coupled to the first container, wherein each graphical representation visually represents the appearance of the predetermined second container when filled with contents from the first container in accordance with the specific measurement to which the graphical representation corresponds.

2. The system of claim 1, further comprising a tamper evident sleeve enclosing at least a portion of each of the first container, the rotating top label, and the predetermined second container, the sleeve comprising a polymer film that shrinks when exposed to an energy source.

3. The system of claim 2, wherein the tamper evident sleeve comprises a perforation, wherein the perforation comprises at least a portion of a tamper evident feature.

4. A method for measuring material dispensed from a container system, the method comprising:

adhering a base label having a front surface to a first container, the front surface having measurement information printed thereon, wherein the measurement information includes a plurality of specific measurements, and a graphical representation corresponding to each specific measurement;

adhering a rotating top label covering at least a portion of the front surface of the base label to the first container, the top label comprising a front surface and a back surface, wherein the back surface of the top label has printed information;

placing a transparent window on the top label, wherein the transparent window is configured to display at least a portion of the measurement information printed on the base label;

rotating the top label to cause the transparent window to display a particular one of the plurality of specific measurements and its corresponding graphical representation;

coupling a predetermined second container to the first container; and wherein each graphical representation visually represents the appearance of the predetermined second container when filled with contents from the first container in accordance with the specific measurement to which the graphical representation corresponds.

5. The system of claim 4, further comprising enclosing at least a portion of each of the first container, the rotating top label, and the predetermined second container in a tamper evident sleeve, the sleeve comprising a polymer film that shrinks when exposed to an energy source.

6. The system of claim 5, further comprising including perforation in the tamper evident sleeve, wherein the perforation comprises at least a portion of a tamper evident feature.

* * * * *